US006596470B2

(12) United States Patent
Matsumoto et al.

(10) Patent No.: US 6,596,470 B2
(45) Date of Patent: Jul. 22, 2003

(54) HEAT-DEVELOPABLE LIGHT-SENSITIVE MATERIAL AND IMAGE-FORMING METHOD USING THE SAME

(75) Inventors: Kazuhiko Matsumoto, Minami-ashigara (JP); Toshio Kawagishi, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/993,701

(22) Filed: Nov. 27, 2001

(65) Prior Publication Data

US 2002/0110763 A1 Aug. 15, 2002

(30) Foreign Application Priority Data

Nov. 27, 2000 (JP) ..... 2000-359593
Jul. 18, 2001 (JP) ..... 2001-218228

(51) Int. Cl.[7] ..... G03C 1/498; G03C 1/40; G03C 7/32

(52) U.S. Cl. ..... 430/350; 430/21; 430/543; 430/546; 430/567; 430/619; 430/631

(58) Field of Search ..... 430/21, 218, 619, 430/203, 631, 350, 566, 546, 543, 567

(56) References Cited

U.S. PATENT DOCUMENTS 4,426,441 A 1/1984 Adin et al.
4,435,499 A 3/1984 Reeves
5,605,785 A * 2/1997 Texter et al. ..... 430/546
6,306,551 B1 * 10/2001 Owczaeczyk et al. ..... 430/21
6,369,873 B1 * 4/2002 Tevy et al. ..... 355/27

FOREIGN PATENT DOCUMENTS

| | | |
|---|---|---|
| GB | 1 570 362 | 7/1980 |
| JP | 60-232547 | 11/1985 |
| JP | 4-289856 | 10/1992 |

* cited by examiner

*Primary Examiner*—Thorl Chea
(74) *Attorney, Agent, or Firm*—Birch, Stewart, Kolasch & Birch, LLP

(57) ABSTRACT

A heat-developable light-sensitive material, which at least contains:

(a) a photosensitive silver halide;
(b) a reducible silver salt;
(c) a dispersion of fine crystalline particles of a color-developing agent;
(d) a dispersion of fine crystalline particles of a coupler capable of reacting with an oxidized product of the color-developing agent, to form a dye;
(e) a dispersion of fine crystalline particles of a thermal solvent; and
(f) a binder, each of which is contained on the same side of a support. An image-forming method, which utilizes the heat-developable light-sensitive material.

19 Claims, No Drawings

HEAT-DEVELOPABLE LIGHT-SENSITIVE MATERIAL AND IMAGE-FORMING METHOD USING THE SAME

FIELD OF THE INVENTION

The present invention relates to a silver halide color photographic light-sensitive material suited to simple and rapid processing. More specifically, the present invention relates to a simple and rapid processing-type heat-developable light-sensitive material for shooting, which material is excellent in storage stability.

BACKGROUND OF THE INVENTION

Heretofore, processes for forming images by heat development are described in, for example, U.S. Pat. Nos. 3,152,904 and 3,457,075, by D. Klosterboer in "Thermally Processed Silver Systems" (Imaging Processes and Materials, Neblette, 8th edition, edited by J. Sturge, V. Walworth, and A. Shepp, Chapter 9, page 279, 1989). These heat-developable light-sensitive materials contain a reducible non-photosensitive silver source (e.g., an organosilver salt), a catalytically active amount of a photocatalyst (e.g., a silver halide), and a reducing agent for silver, which are ordinarily in a state of dispersion in an organic binder matrix. The light-sensitive materials are stable at normal temperature, but when heated to a high temperature (e.g., 80° C. or above) after exposure, silver is formed through an oxidation-reduction reaction between the reducible silver source (acting as an oxidizing agent) and the reducing agent. This oxidation-reduction reaction is accelerated by a catalytic action of the latent image formed by the exposure. Since the silver produced by the reaction of the reducible silver salt in the exposed area becomes black in contrast with the non-exposed area, thereby to form an image.

On the other hand, the method utilizing a coupling reaction between a coupler and an oxidized product of a developing agent is most common, as a color-image-forming method of a photographic light-sensitive material. JP-A-9-10506 ("JP-A" means unexamined published Japanese patent application) and European Patent No. 762,201 describe methods for forming a color image in a light-sensitive material, wherein a small amount of water is fed to the light-sensitive material, which is incorporated with a developing agent and a coupler, and the light-sensitive material is put together with an image-receiving material containing a base precursor, and these materials are heated, so that a development reaction takes place.

Further, U.S. Pat. Nos. 3,761,270, 4,021,240, 4,426,441, and 4,435,499, JP-A-59-231539, JP-A-60-128438, and the like, describe color heat-developable light-sensitive materials capable of forming an image only by heating, without employing a complex construction involving the use of a base precursor and feeding of a small amount of water. In these patents, p-sulfonamidophenols, p-phenylenediamines, hydrazines, and the like are used as developing agents. Since the coupler before the processing has no absorption in a visible region, the light-sensitive materials according to the coupling method are advantageous in terms of sensitivity. Accordingly, such light-sensitive materials are thought to have the advantage that, beyond use for print materials, they can also be used as photographic materials for shooting.

Ordinarily, a heat-developable light-sensitive material contains a thermal solvent, to raise developing activity. The term "thermal solvent" means an organic material that is a solid at ambient temperature but exhibits a mixed melting point at or below the temperature employed for heat development, on its own, or together with another component, and that liquefies at the time of heat development, so that the heat development and the thermal transfer of a dye are accelerated. Thermal solvents that are known to be useful include a compound capable of becoming a solvent for the developing agent, a compound having a high dielectric constant and capable of accelerating the physical development of a silver salt, and a compound compatible with the binder and capable of swelling the binder.

However, in the case of a heat-developable light-sensitive material, using, as a thermal solvent, a compound that is a liquid at normal temperature, or whose melting point is 100° C. or below, such as an alcohol, a polyol, a phenol, a low-molecular-weight urea or amide, or the like, the thermal solvent itself is hygroscopic or is present in a state of a liquid in the light-sensitive material. Because of this, the light-sensitive material tends to be tacky and is liable to cause a phenomenon that the light-sensitive material adheres to the back surface of another light-sensitive material, or to another material, to thereby cause defective image in some cases. To alleviate this problem, for example, JP-A-60-232547 and JP-A-4-289856 describe the use of a dispersion of fine crystalline particles of a thermal solvent that is a solid at normal temperature, and whose melting point is 50° C. to 180° C.

On the other hand, as to the method for introducing, into a light-sensitive material, a hydrophobic organic substance such as a color-developing agent or a coupler, designed to react with an oxidized product of the color-developing agent, so that a dye is formed, the conventional technique includes the following.

U.S. Pat. Nos. 2,322,027, 4,555,470, and 4,599,296, and JP-B-3-62256 ("JP-B" means examined Japanese patent publication), describe a method comprising dissolving a coupler in a high-boiling-point organic solvent listed therein, or, if necessary, in a mixture of such a high-boiling-point organic solvent and a low-boiling-point organic solvent, whose boiling point is 50° C. to 160° C., and emulsifying and dispersing the resulting solution in a suitable binder.

JP-B-51-39853 and JP-A-51-59943 describe a dispersing method by a polymer.

In the case of a compound substantially insoluble in water, the binder may contain a dispersion of fine particles of the compound, without resorting to the methods listed above.

U.S. Pat. No. 2,870,012 describes a solvent shift method for the preparation of a microdispersion of a color coupler compound containing one or more acid groups (i.e., carboxylic acid or sulfonic acid).

U.K. Patent No. 1,193,349 describes a solvent shift method and a pH shift method in the presence of a protective colloid for dispersing a coupler as an amorphous colloidal dispersion. These methods are applied to a coupler that does not have a sulfonic or carboxylic acid-solubilizing group, and that is soluble in a mixture of an alkaline aqueous solution and an organic solvent compatible with water.

U.S. Pat. Nos. 4,970,139 and 5,089,380 describe a method for preparing a deposited coupler dispersion having an enhanced photographic activity. This method comprises a step in which small particles of a hydrophobic coupler are simultaneously deposited, and the particles take in a water-insoluble coupler solvent, concurrently with the formation of the particles.

U.S. Pat. No. 5,008,179 describes a method for preparing a dispersion, which method comprises preparing a dispersion of an amorphous coupler by pH- and solvent-shifts, and mixing the resulting coupler dispersion with a dispersion of a permanent solvent incorporated with a polymer latex or the like.

U.K. Patent No. 1,570,362 describes micro-grinding methods for preparing a dispersion of solid particles of a photographic additive, such as a coupler, which methods include a sand mill method, a beads mill method, a dyno mill method and related media, a ball mill method, and a roller mill method.

The use of a fine crystalline coupler is effective in reducing the amount of an organic solvent at the time of manufacture. Further, as stated previously, it is known that the coupler can be dispersed as a dispersion of fine crystalline particles. However, a coupler dispersion is not very successfully employed in practical industries of photographic films or print paper elements, because generally the coupler dispersion does not exhibit sufficient reactivity to provide satisfactory image dye densities.

A thermal solvent, which is used in a heat-developable light-sensitive material, is expected to provide the same effect as that of a high-boiling-point solvent, which is used at the time of emulsifying and dispersing to raise color-forming activity. However, a water-soluble thermal solvent is disadvantageous in terms of the increasing of drying load at the time of drying of coated layers, and it is insufficient to raise the color-forming activity of the fine crystalline coupler dispersion. Beside, even when a dispersion of fine crystalline particles of the thermal solvent, which is a solid at normal temperature and whose melting point is 50 to 180° C., as described in JP-A-60-232547 and JP-A-4-289856 mentioned above, is used, the coupler is introduced into a light-sensitive layer not as a fine crystalline coupler dispersion, but as a dispersion in a high-boiling-point solvent.

Meanwhile, such problems as fogging, decreased sensitivity, and decreased density of developed color, during storage of the heat-developable light-sensitive material, are well known to be caused by thermal instability of a color-developing agent incorporated in the light-sensitive material, or by formation of fogging nuclei, formation of a desensitizing substance, formation of a colored substance, and the like, due to an unintended chemical reaction between the color-developing agent, and a silver halide, a reducible silver salt, a coupler, or the like, during the storage of the light-sensitive material.

In addition, the thermal solvent, which is added into the heat-developable light-sensitive material for such purposes as accelerating development and accelerating color-formation, may accelerate an unintended side reaction, during the storage of the light-sensitive material. In particular, when a thermal solvent that is a liquid at or around room temperature, or a thermal solvent that is hygroscopic, is used, the storage stability of the light-sensitive material is very poor when the light-sensitive material is stored at or around room temperature. Particularly, when the heat-developable light-sensitive material is intended for use as a light-sensitive material for shooting, the light-sensitive material needs to have high storage stability both before (unprocessed stock) and after exposure.

SUMMARY OF THE INVENTION

The present invention is a heat-developable light-sensitive material, which at least contains (a) a photosensitive silver halide, (b) a reducible silver salt, (c) a dispersion of fine crystalline particles of a color-developing agent, (d) a dispersion of fine crystalline particles of a coupler capable of reacting with an oxidized product of the color-developing agent to form a dye, (e) a dispersion of fine crystalline particles of a thermal solvent, and (f) a binder, each of which is contained on the same side of a support.

Further the present invention is an image-forming method, which comprises the steps of: exposing image-wise the above heat-developable light-sensitive material; heating the light-sensitive material at a temperature within a range of 60 to 180° C. for 5 to 60 seconds, to form a color image; reading photoelectrically out the image information produced on the light-sensitive material; and forming an image on another recording material based on the image information.

DETAILED DESCRIPTION OF THE INVENTION

According to the present invention, there is provided the following means:

(1) A heat-developable light-sensitive material, at least containing:
- (a) a photosensitive silver halide;
- (b) a reducible silver salt;
- (c) a dispersion of fine crystalline particles of a color-developing agent;
- (d) a dispersion of fine crystalline particles of a coupler capable of reacting with an oxidized product of the color-developing agent, to form a dye;
- (e) a dispersion of fine crystalline particles of a thermal solvent; and
- (f) a binder, each of which is contained on the same side of a support.

(2) The heat-developable light-sensitive material according to item (1), wherein the melting point mp (C) of the color-developing agent, the melting point mp (D) of the coupler, and the melting point mp (E) of the thermal solvent, are all 80° C. or above.

(3) The heat-developable light-sensitive material according to item (1) or (2), wherein the color-developing agent is compatible with the thermal solvent, and the coupler is compatible with the thermal solvent.

(4) The heat-developable light-sensitive material according to any one of items (1) to (3), wherein the color-developing agent is incompatible with the coupler.

(5) The heat-developable light-sensitive material according to any one of items (1) to (4), wherein the melting point mp (C) of the color-developing agent is equal to or higher than a development processing temperature, and the melting point mp (E) of the thermal solvent is equal to or lower than the development processing temperature.

(6) The heat-developable light-sensitive material according to any one of items (1) to (5), wherein the melting point mp (C) of the color-developing agent, and the melting point mp (D) of the coupler, are each equal to or higher than a development processing temperature, and the melting point mp (E) of the thermal solvent is equal to or lower than the development processing temperature.

(7) The heat-developable photographic light-sensitive material according to any one of items (1) to (6), comprising a silver halide emulsion in which the projected area of silver halide tabular grains whose aspect ratio is 8 to 50, accounts for 50% or more of the projected area of all grains.

(8) An image-forming method, comprising the steps of:
- exposing image-wise the heat-developable light-sensitive material according to any one of items (1) to (7);

heating the exposed light-sensitive material at a temperature within a range of 60 to 180° C. for 5 to 60 seconds, to form a color image;

reading photoelectrically out the image information produced on the light-sensitive material; and forming an image on another recording material based on the image information.

The term "fine crystalline (crystals)" as used herein means that the arrangement of molecules of a compound to be dispersed (e.g. a coupler molecule) is present within particles of a dispersion in such a manner that a sufficient number of dispersed particles in the dispersion provide a usual powder diffraction pattern specific to fine crystalline particles. The standards of such scattering and diffraction are explained and exemplified by H. P. Klug and L. E. Alexander in "X-Ray Diffraction Procedures", John Wiley & Sons, New York, 1974. For example, as a natural course of its synthesis and purification, a coupler is generally obtained in the state of powdery crystals. If a coupler is obtained in an amorphous state, the crystallization may be induced by a method well-known in the art, such as thermal annealing, seed-crystallization, and crystallization from another solvent. The term "fine crystalline particles" means that the particles are in the physical state described in the definition of "fine crystalline", and the average size of the particles is less than 5 $\mu$m.

Whether or not the particle is present in the fine crystalline state in the light-sensitive material can be confirmed by a method, such as observation of a slice specimen under a transmission electron microscope, or confirmation of the melting point of the target component by a differential thermal analyzer.

Besides, that "two components are compatible with each other, for example, a color-developing agent is compatible with a thermal solvent" means that, when one of these substances melts, the other also melts at the same time. The compatibility can also be confirmed, for example, by observing whether or not these substances melt at the same time when a powderly mixture of these substances is heated on a hot plate, or by observing whether or not the peak melting temperature of a mixture powder of the two components is shifted toward a lower temperature side relative to the peak melting temperatures of the single components separately measured, using a differential thermal analyzer.

The heat-developable light-sensitive material of the present invention can provides a dye image, by a construction that comprises a support having disposed thereon an image-forming layer, which contains an organosilver salt, as a reducible silver salt, and a binder, and having, on this image-forming layer side, generally at least three kinds of photosensitive silver halide emulsion layers (light-sensitive layers), which each contain a photosensitive silver halide, such that the sensitive wavelengths regions and/or the absorption wavelength regions of the dye to be produced from an oxidized product of the color-developing agent and the coupler in these light-sensitive layers are different from one another.

The color-developing agent, which the heat-developable light-sensitive material of the present invention contains, is a compound having almost no absorption in a visible region. When the heat-developable light-sensitive material of the present invention undergoes heat development, the color-developing agent itself acts as a reducing agent, or contributes to the formation of a silver image by releasing a reducing agent. As a result, an oxidized product of the color-developing agent itself, or an oxidized product of the released reducing agent is formed. When the oxidized product reacts with a coupler compound, a dye is formed, and an image-wise dye image in conformity with the silver image is obtained.

In the present invention, the light-sensitive material contains a dispersion of fine crystalline particles of a color-developing agent, a dispersion of fine crystalline particles of a coupler capable of reacting with an oxidized product of the color-developing agent to form a dye, and a dispersion of fine crystalline particles of a thermal solvent.

The colloidal dispersion made up of dispersions of fine crystalline particles of these substances can be obtained by any of the methods which provide a mechanical shearing force and are well known in the art. Examples of these methods are described in U.S. Pat. Nos. 2,581,414 and 2,855,156 and Canadian Patent No. 1,105,761, which are incorporated herein by reference. These methods include grinding methods for obtaining fine solid particles, such as a ball mill method, a pebble mill method, a roller mill method, a sand mill method, a beads mill method, a dyno mill method, a massape mill method and a media mill method. Further, these methods include a colloid mill method, a finely grinding method by means of an attritor, and a dispersing method and high-speed mixing method by means of ultrasonic energy (described in U.S. Pat. No. 4,474,872 of Onishi et al., which is incorporated herein by reference). Because of ease in operation, ease in cleaning, and better reproductivity, finely grinding methods by a ball mill method, a roller mill method, a media mill method, and an attritor method are preferable.

Alternatively, a dispersion in which the compound is present in an amorphous state can be prepared by a well-known method which includes a colloid mill method, a homogenizing method, a high-speed dispersing method, and a sonic-wave method. After the preparation, the amorphous state of the compound can be transformed into a physical state of fine crystals by such method as thermal annealing or chemical annealing. The thermal annealing method includes a temperature-programming method in which an amorphous compound is circulated to temperatures higher than the glass transition temperature of the amorphous compound. A preferred thermal annealing method includes a step in which the dispersion is circulated over a temperature range of 17 to 90° C. This circulation step may include any order of temperature change which accelerates the formation of a fine crystalline phase from the remaining amorphous physical state. Typically, the length of time period of a high temperature interval is selected, such that the formation of the above-mentioned phase is accelerated and the particle growth due to ripening and collision is minimized. The chemical annealing method includes an incubation method by a chemical substance, which changes the distribution of the compound and the surfactant between a continuous phase and a discontinuous phase of the dispersion. Examples of such chemical substance include a hydrocarbon (e.g., hexadecane), a surfactant, an alcohol (e.g., butanol, pentanol, or undecanol), and a high-boiling-point organic solvent. Such chemical substance can be added to the dispersion during particle formation or after the formation of particles. This chemical annealing method includes a method in which the dispersion is incubated at 17 to 90° C. in the presence of the above-mentioned chemical substance; a method in which the dispersion is stirred in the presence of the above-mentioned chemical substance; and a method in which the above-mentioned chemical substance is added and, after the addition, the chemical substance is slowly removed by a diafiltration method.

The formation of a colloidal dispersion in an aqueous medium generally requires the presence of a dispersing aid, such as a surfactant, a surface-active polymer, or a hydrophilic polymer. Such dispersing aids are described in U.S. Pat. No. 5,008,179 (columns 13 to 14) of Chari et al. and U.S. Pat. No. 5,104,776 (columns 7 to 13) of Bagchi and Sargeant, which are all incorporated herein by reference.

In the present invention, the number average particle sizes of the fine crystalline particles of the dispersion are preferably 0.001 to 5 μm, and more preferably 0.001 to 0.5 μm.

(Color-Developing Agent)

The heat-developable light-sensitive material of the present invention has a color-developing agent, on the same side as that of a photosensitive silver halide and a reducible silver salt, on the support.

Examples of the color-developing agent include p-phenylenediamines and p-aminophenols. More preferable examples include sulfonamidophenols described in JP-A-8-110608, JP-A-8-122994, JP-A-9-15806, JP-A-9-146248, and the like; sulfonylhydrazines described in EP 545,491A, and JP-A-8-166664 and JP-A-8-227131; carbamoylhydrazines described in JP-A-8-286340; sulfonylhydrazones described in JP-A-8-202002, JP-A-10-186564, and JP-A-10-239793; carbamoylhydrazones described in JP-A-8-234390; sulfamic acids described in JP-B-63-36478; sulfohydrazones described in JP-B-4-20177; 4-sulfonamidopyrazolones described in JP-B-5-48901; p-hydroxyphenylsulfamic acids described in JP-B-4-69776; sulfamic acids which have an alkoxy group on a benzene ring and are described in JP-A-62-227141; hydrophobic salts which are formed from a color-developing agent having an amino group and an organic acid and are described in JP-A-3-15052; hydrazones described in JP-B-2-15885; ureidoanilines described in JP-A-59-111148; sulfamoylhydrazones described in U.S. Pat. No. 4,430,420; derivatives of an aromatic primary amine developing agent having a sulfonylaminocarbonyl group or an acylaminocarbonyl group, as described in JP-B-3-74817; compounds which release an aromatic primary amine developing agent by a reverse Michael reaction, as described in JP-A-62-131253; derivatives of an aromatic primary amine developing agent having a fluorine-substituted acyl group, as described in JP-B-5-33781; derivatives of an aromatic primary amine developing agent having an alkoxycarbonyl group, as described in JP-B-5-33782; derivatives of an aromatic primary amine developing agent which are of an oxalic acid amide type, as described in JP-A-63-8645; and derivatives of an aromatic primary amine developing agent which are of a Schiff base type, as described in JP-A-63-123043. Among these color-developing agents, sulfonamidophenols described in JP-A-8-110608, JP-A-8-122994, JP-A-8-146578, JP-A-9-15808, JP-A-9-146248, and the like; carbamoylhydrazines described in JP-A-8-286340, and derivatives of an aromatic primary amine developing agent described in JP-B-3-74817 and JP-A-62-131253 are preferable.

Specific examples of the compounds as the color-developing agents that can be used in the present invention are given below, but it should be understood that the present invention is not restricted to these examples.

First, specific examples of the compounds as the color-developing agents that are of a carbamoylhydrazine type are given below.

D-1

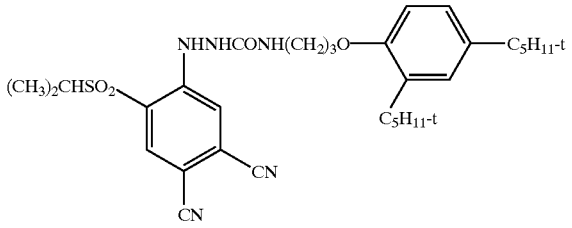

D-2

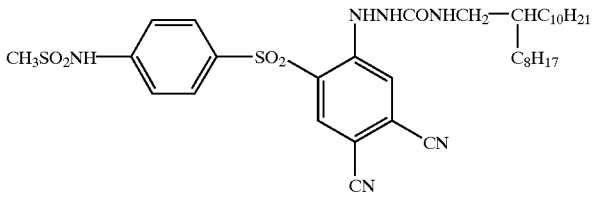

D-3

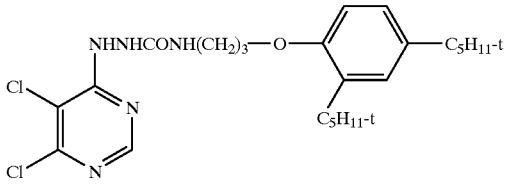

-continued
D-4
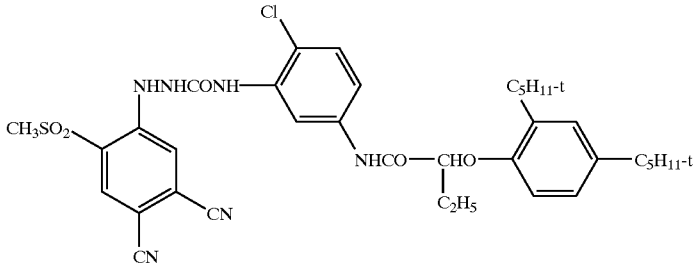
D-5
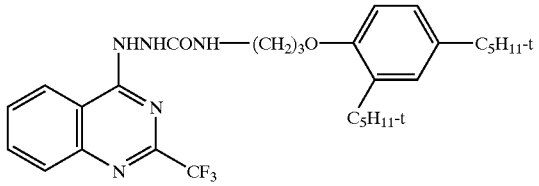
D-7
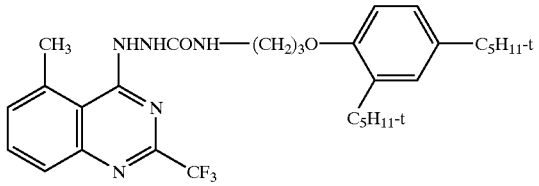
D-8
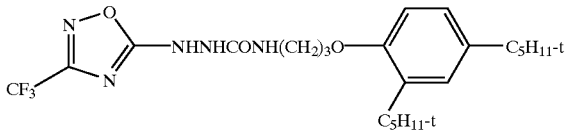
D-9
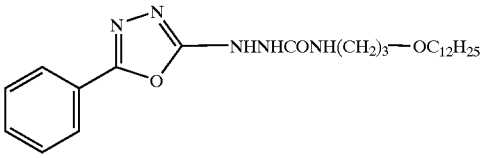
D-10
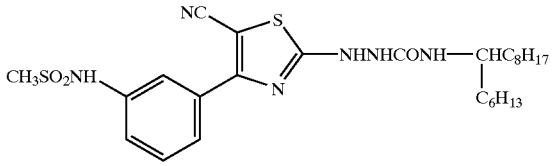
D-11
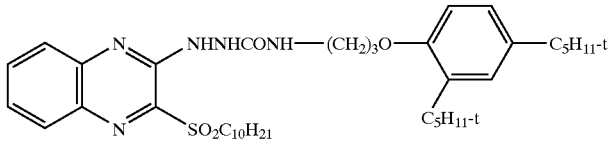
D-12
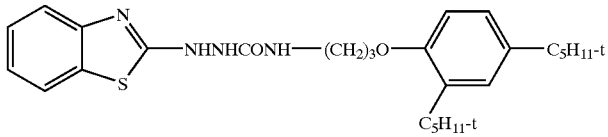
D-13
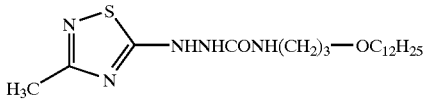

-continued
D-14
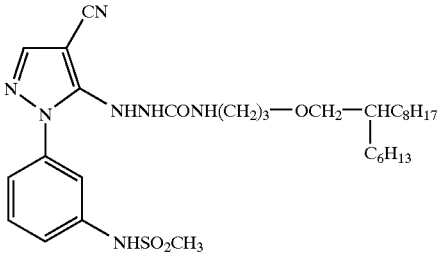
D-15
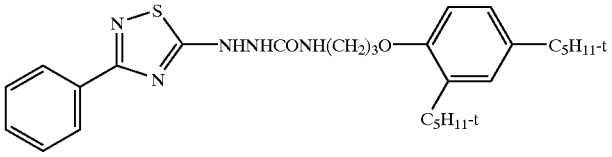
D-16
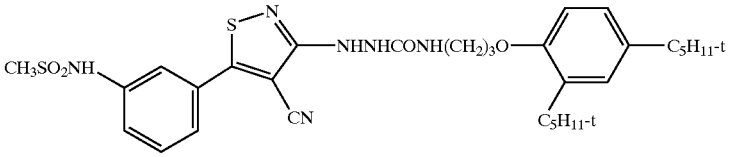
D-17
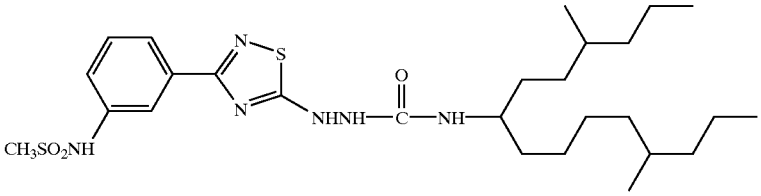
D-18
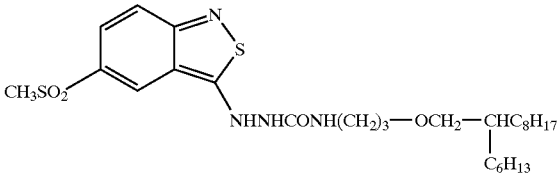
D-19
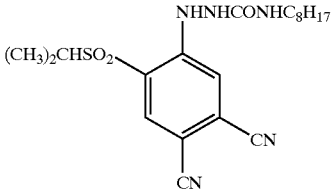
D-20
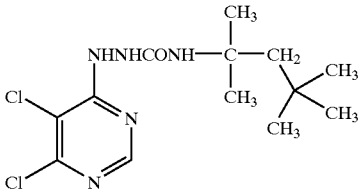
D-21
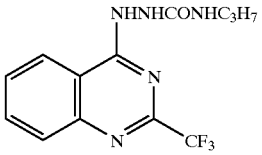
D-22
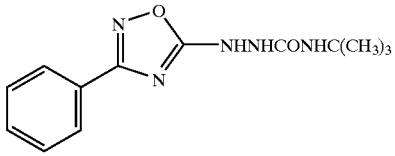
D-23
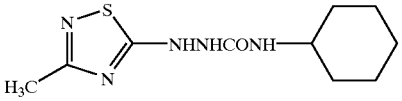
D-24
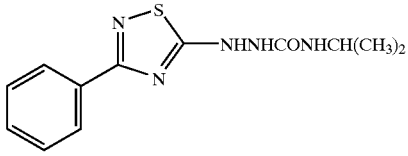

Besides the specific compounds listed above, also preferable as the color-developing agent for use in the present invention are compounds (1) to (80) described in JP-A-8-286340, pages 7–22, compounds H-1 to H-72 described in JP-A-9-152700, pages 9–26, compounds D-1 to D-19 described in JP-A-9-152701, pages 7–11, compounds D-1 to D-39 described in JP-A-9-152702, pages 6–13, compounds D-1 to D-49 described in JP-A-9-152703, pages 7–17, compounds (1) to (45) described in JP-A-9-152704, pages 6–18, compounds (1) to (65) described in JP-A-9-152705, pages 5–17, and compounds D-1 to D-29 described in JP-A-9-211818, pages 7–15.

Specific examples of the sulfonamidophenol-type color-developing agent are given below.

SA-1

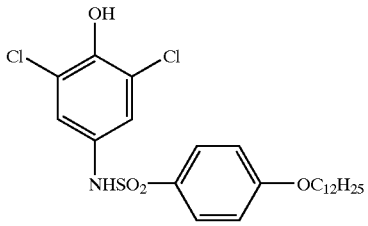

SA-2

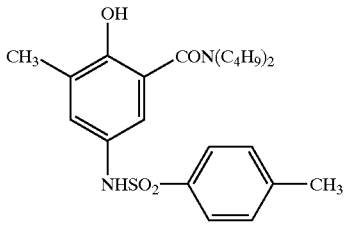

SA-3

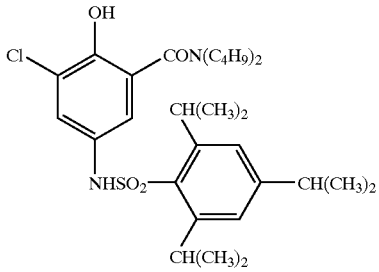

SA-4

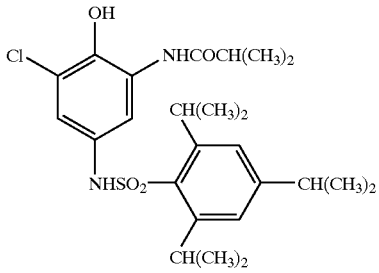

-continued

SA-5

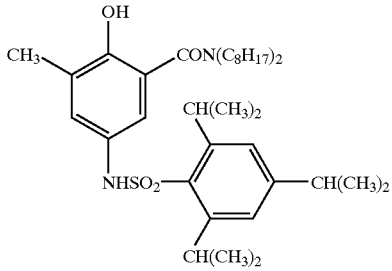

SA-6

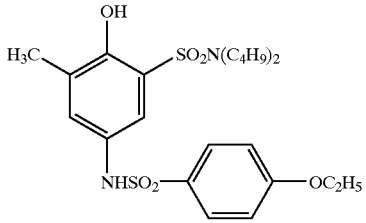

SA-7

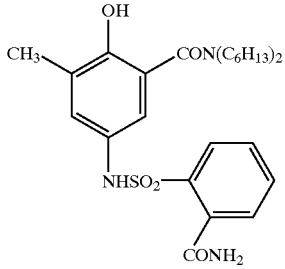

SA-8

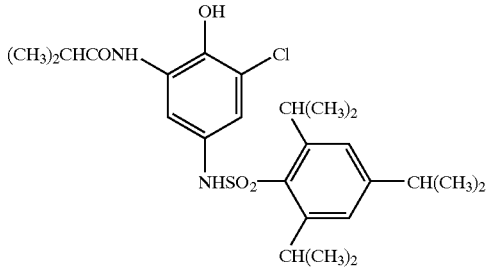

SA-9

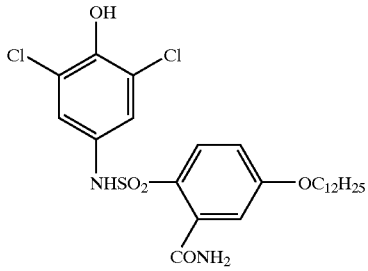

SA-10

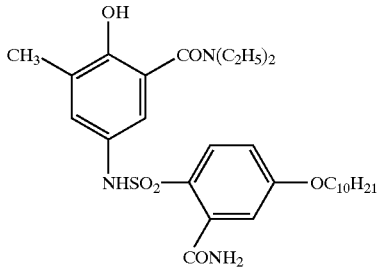

-continued

SA-11

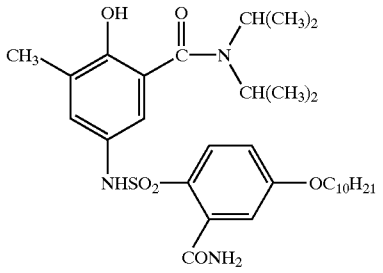

SA-12

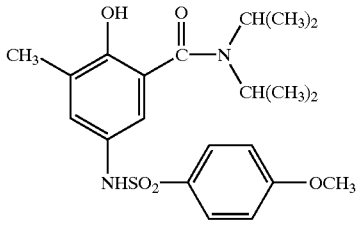

SA-13

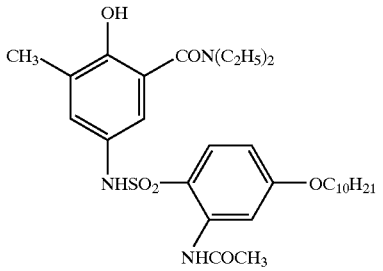

SA-14

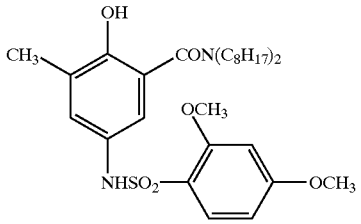

SA-15

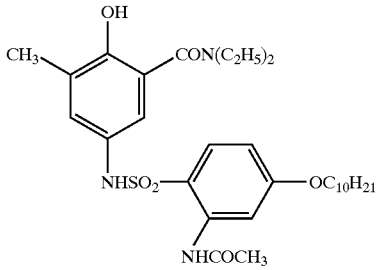

Besides the specific compounds listed above, also preferable as the color-developing agent for use in the present invention are compounds I-1 to I-23 described in JP-A-8-110608, pages 13–6, compounds I-1 to I-21 described in JP-A-8-122994, page 27, compounds D-1 to D-30 described in JP-A-9-15806, pages 4–7, compounds D-1 to D-35 described in JP-A-9-146248, pages 9–15, compounds D-1 to D-38 described in JP-A-10-186564, pages 9–15, compounds D-1 to D-37 described in JP-A-10-239793, pages 9–16, compounds D-1 to D-42 described in JP-A-11-125886, pages 5–9, compounds D-1 to D-25 described in JP-A-11-143037, pages 6–13, and compounds D-1 to D-56 described in JP-A-11-149146, pages 5–12.

Specific examples of the aromatic primary amine derivative-type developing agent are given below. As the aromatic primary amine derivative-type developing agent, p-phenylenediamines blocked with a blocking group are preferable. The blocked p-phenylenediamines in which the formula weight of the p-phenylenediamine moiety is 300 or more are more preferable. Further, it is preferable the oxidation potential of the p-phenylenediamine in which the blocking group is replaced with a hydrogen atom is 5 mV (vs. SCE) or less in water having a pH value of 10.

A known blocking group can be used as the above-mentioned blocking group. Examples of the blocking group include the followings. Blocking groups such as an acyl group and sulfonyl group, as described in JP-B-48-9968, JP-A-52-8828 and JP-A-57-82834, U.S. Pat. No. 3,311,476, JP-B-47-44805 (U.S. Pat. No. 3,615,617), and the like; blocking groups utilizing a reverse Michael reaction, as described in JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175), JP-A-59-105640, JP-A-59-105641, and JP-A-59-105642, and the like; blocking groups utilizing the formation of a quinone methide or a compound similar to quinone methide by an intramolecular electron transfer, as described in JP-B-54-39727, U.S. Pat. Nos. 3,674,478, 3,932,480, and 3,993,661, JP-A-57-135944, JP-A-57-135945 (U.S. Pat. No. 4,420,554), JP-A-57-136640, JP-A-61-196239, JP-A-61-196240 (U.S. Pat. No. 4,702,999), JP-A-61-185743, JP-A-61-124941 (U.S. Pat. No. 4,639,408), and JP-A-2-280140, and the like; blocking groups utilizing an intramolecular nucleophilic substitution reaction, as described in U.S. Pat. Nos. 4,358,525 and 4,330,617, JP-A-55-53330 (U.S. Pat. No. 4,310,612), JP-A-59-121328, JP-A-59-218439, and JP-A-63-318555 (EP0295729A), and the like; blocking groups utilizing a ring-cleavage reaction of a 5- or 6-membered ring, as described in JP-A-57-76541 (U.S. Pat. No. 4,335,200), JP-A-57-135949 (U.S. Pat. No. 4,350,752), JP-A-57-179842, JP-A-59-137945, JP-A-59-140445, JP-A-59-219741, JP-A-59-202459, JP-A-60-41034 (U.S. Pat. No. 4,618,563), JP-A-62-59945 (U.S. Pat. No. 4,888,268), JP-A-62-65039 (U.S. Pat. No. 4,772,537), JP-A-62-80647, JP-A-3-236047, JP-A-3-238445, and the like; blocking groups utilizing an addition reaction of a nucleophilic agent to a conjugated unsaturated bond, as described in JP-A-59-201057 (U.S. Pat. No. 4,518,685), JP-A-61-43739 (U.S. Pat. No. 4,659,651), JP-A-61-95346 (U.S. Pat. No. 4,690,885), JP-A-61-95347 (U.S. Pat. No. 4,892,811), JP-A-64-7035, JP-A-4-42650 (U.S. Pat. No. 5,066,573), JP-A-1-245255, JP-A-2-207249, JP-A-2-235055 (U.S. Pat. No. 5,118,596), JP-A-4-186344, and the like; blocking groups utilizing a β-elimination reaction, as described in JP-A-59-93442, JP-A-61-32839, and JP-A-62-163051, JP-B-5-37299, and the like; blocking groups utilizing a nucleophilic substitution reaction of diarylmethanes, as described in JP-A-61-188540; blocking groups utilizing a Lossen rearrangement reaction, as described in JP-A-62-187850; blocking groups utilizing the reaction between an N-acylated form of thiazolidine-2-thione and an amine, as described in JP-A-62-80646, JP-A-62-144163, JP-A-62-147457, and the like; blocking groups which have two electrophilic groups and react with bi-nucleophilic agents, as described in JP-A-2-296240 (U.S. Pat. No. 5,019,492), JP-A-4-177243, JP-A-4-177244, JP-A-4-177245, JP-A-4-177246, JP-A-4-177247, JP-A-4-177248, JP-A-4-177249, JP-A-4-179948, JP-A-4-184337, and JP-A-4-184338, WO92/21064, JP-A-4-330438, WO93/03419, JP-A-5-45816, and the like; and blocking groups described in JP-A-3-236047 and JP-A-3-238445. Among these blocking groups, particularly preferable are blocking groups which have two electrophilic groups and react with bi-nucleophilic agents, as described in JP-A-2-296240 (U.S. Pat. No. 5,019,492), JP-A-4-177243, JP-A-4-177244, JP-A-4-177245, JP-A-4-177246, JP-A-4-177247, JP-A-4-177248, JP-A-4-177249, JP-A-4-179948, JP-A-4-184337, and JP-A-4-184338, WO92/21064, JP-A-4-330438, WO93/03419, JP-A-5-45816, and the like.
DEVP-1
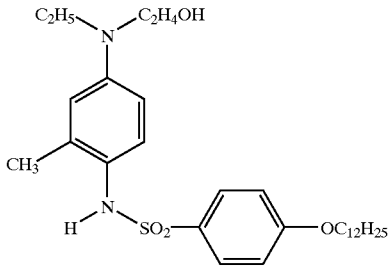
DEVP-2
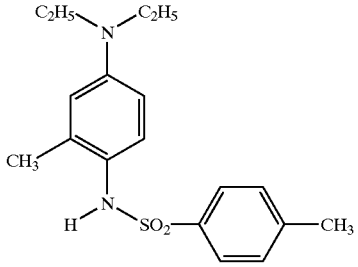
DEVP-3
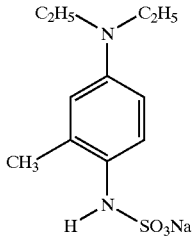
DEVP-4
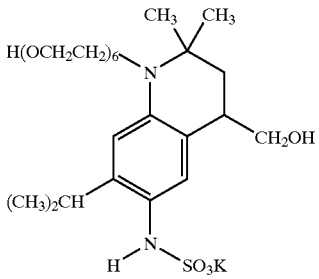
DEVP-5
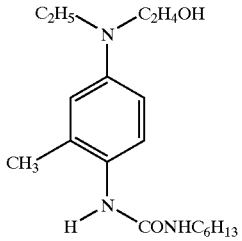
-continued
DEVP-6
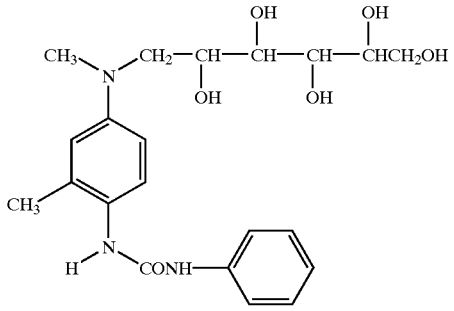
DEVP-7
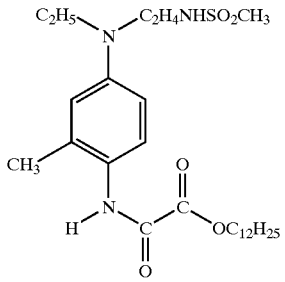
DEVP-8
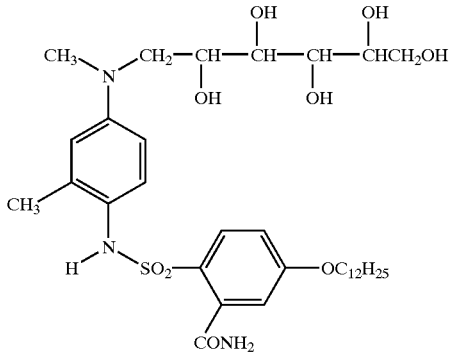
DEVP-9
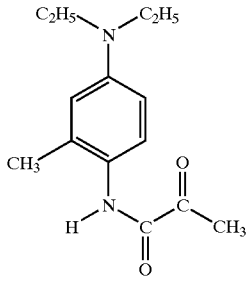
DEVP-10
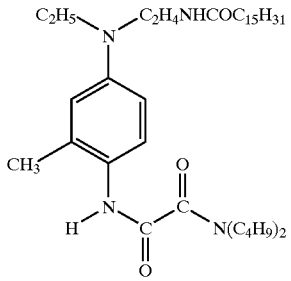

-continued
DEVP-11
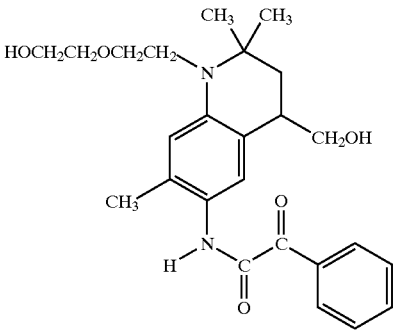
DEVP-12
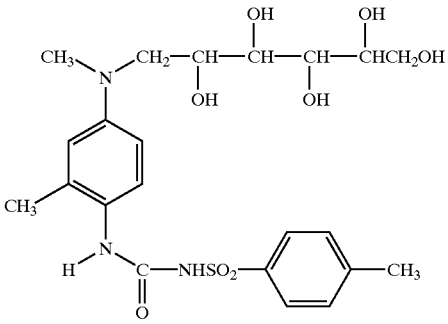
DEVP-13
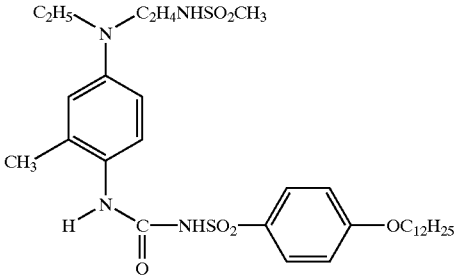
DEVP-14
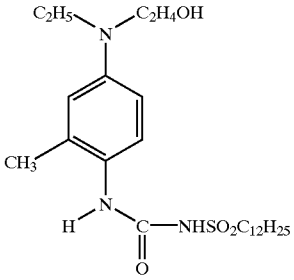
DEVP-15
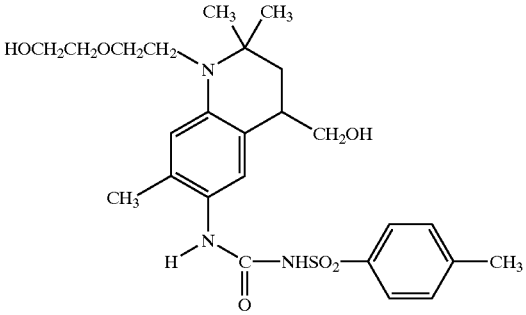
-continued
DEVP-16
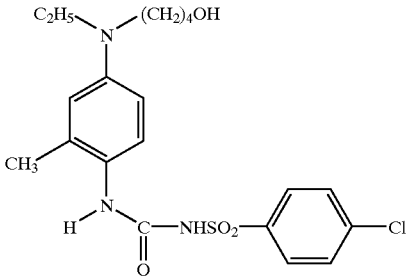
DEVP-17
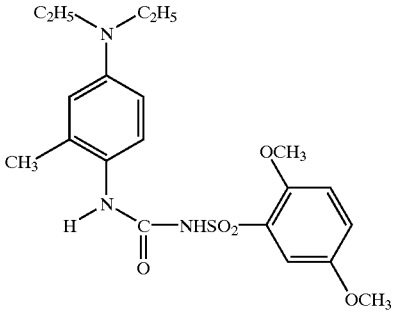
DEVP-18
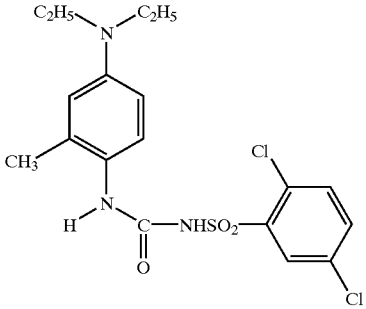
DEVP-19
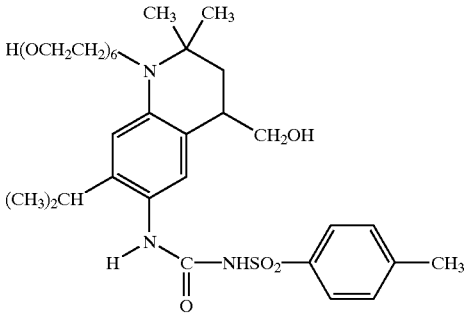
DEVP-20
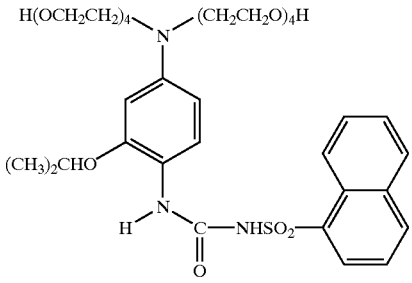

-continued
DEVP-21
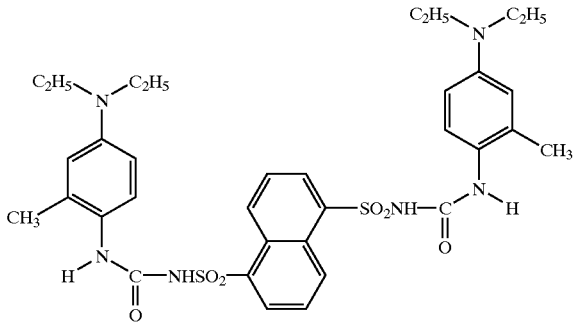
DEVP-22
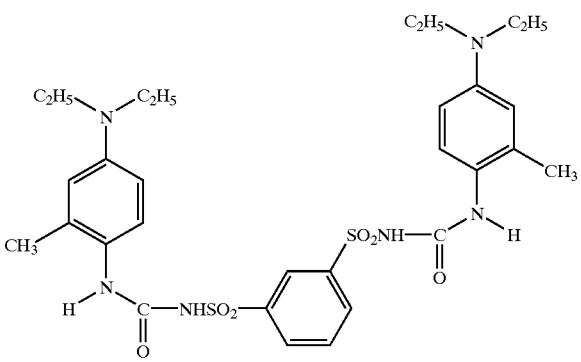
DEVP-23
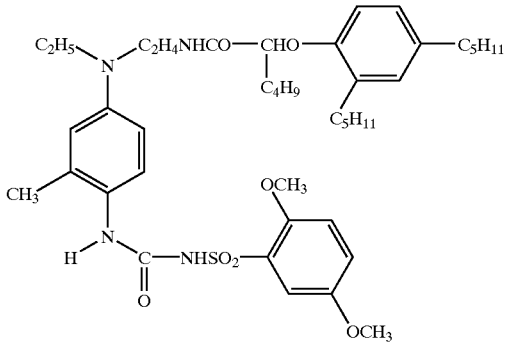
DEVP-24
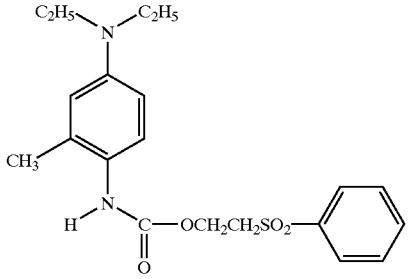
-continued
DEVP-25
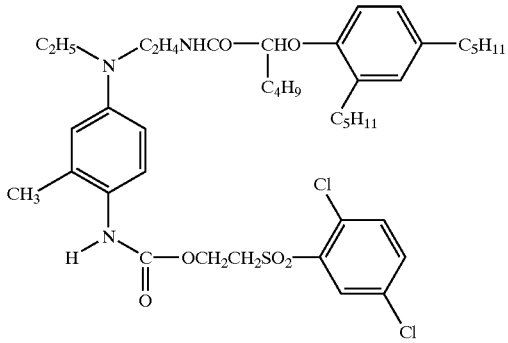
DEVP-26
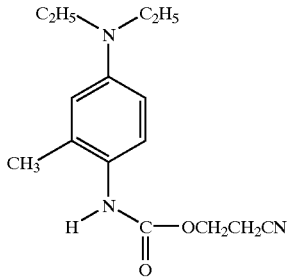
DEVP-27
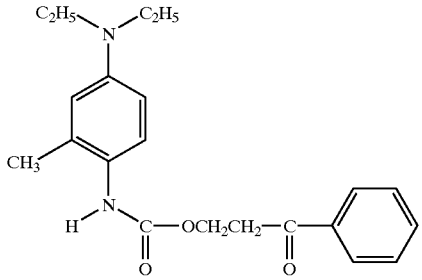
DEVP-28
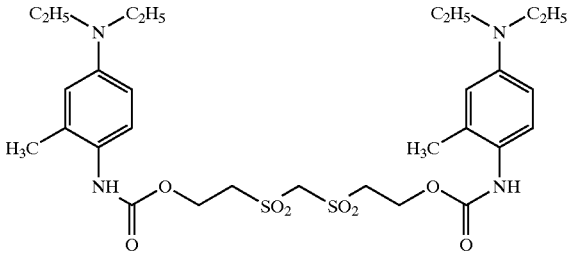
DEVP-29
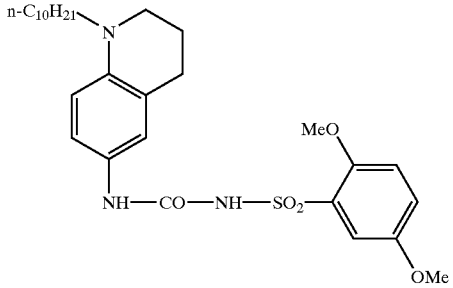

-continued

DEVP-30

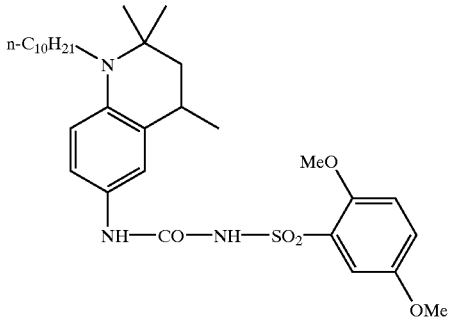

DEVP-31

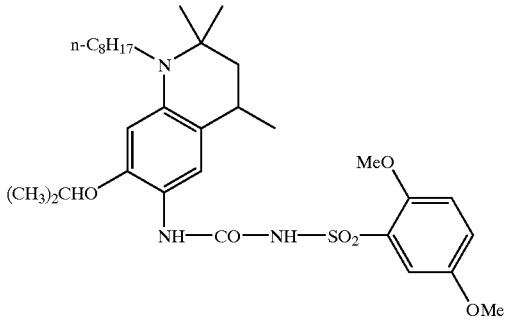

DEVP-32

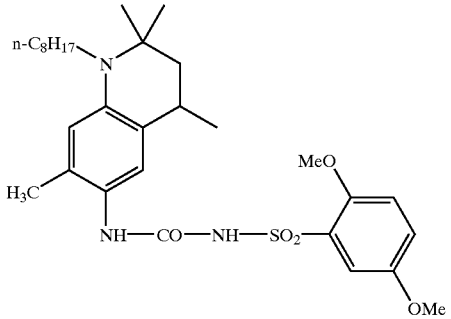

DEVP-33

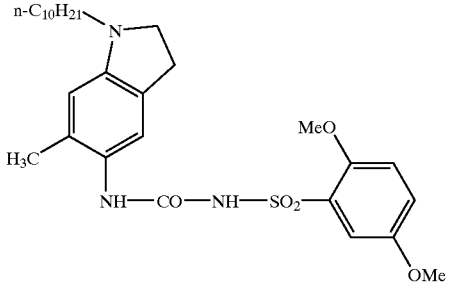

DEVP-34

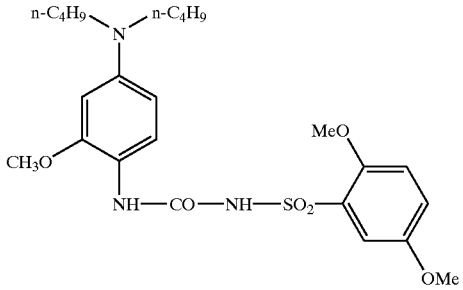

-continued

DEVP-35

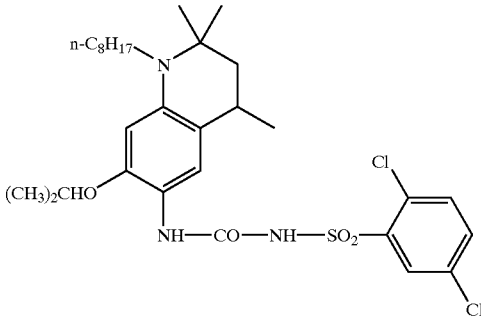

DEVP-36

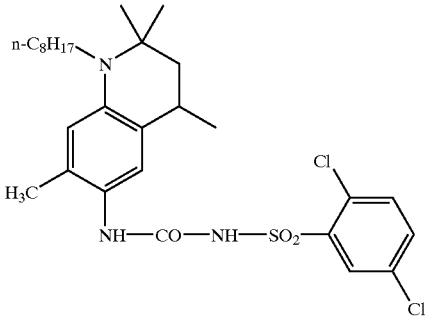

DEVP-37

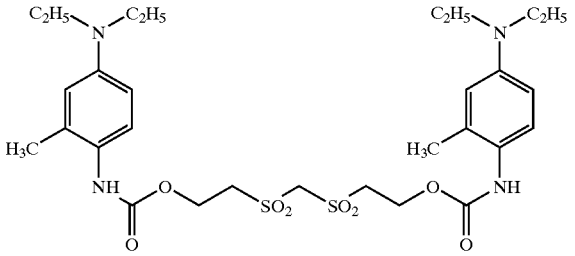

Besides the specific compounds listed above, also preferable as the developing agent for use in the present invention are compounds Nos.1 to 36 described in JP-A-61-34540, pages 3–7, compounds Nos.1 to 32 described in JP-A-62-131253, pages 5–6, compounds Nos.1 to 53 described in JP-A-5-257225, pages 5–11, compounds Nos.1 to 53 described in JP-A-5-249602, pages 5–12, and dispersions of solid particles thereof.

In the present invention, developing agents described in European Patent Nos. 1,113,322, 1,113,323, 1,113,324, 1,113,325 and 1,113,326 may also be used preferably.

The amount to be added of the developing agent in the present invention may vary within a wide range, and the amount is preferably 0.01 to 100 molar times, more preferably 0.1 to 10 molar times, the amount of the coupler compound.

Further, in order to enhance dispersion stability of the dispersion of fine crystals, the water-solubility of the color-developing agent for use in the present invention is preferably 1 g/cubic meter or less, and more preferably $10^{-3}$ g/cubic meter or less.

Furthermore, the melting point of the color-developing agent for use in the present invention is preferably in the range of 80 to 300° C.

The melting point of the color-developing agent is preferably higher than that of the thermal solvent described above, and it is more preferably higher than the development processing temperature.

Preferably, the color-developing agent is compatible with the thermal solvent to be used in combination in the present invention. Preferably, the color-developing agent is incompatible with the coupler to be used in combination in the present invention.

It is preferable that the melting point mp (C) of the color-developing agent is not lower than the development processing temperature, and the melting point mp (E) of the thermal solvent is not higher than the development processing temperature. In addition, it is preferable that the melting point mp (C) of the color-developing agent and the melting point mp (D) of the coupler are each not lower than the development processing temperature, and the melting point mp (E) of the thermal solvent is not higher than the development processing temperature.

The heat-developable light-sensitive material of the present invention has a coupler compound, on the same side as that of a photosensitive silver halide and a reducible silver salt, on the support. The coupler compound for use in the present invention is a compound which is called coupler and is known in photographic industries. A 2-equivalent or 4-equivalent coupler can be used. Examples of the coupler for photography that can be used include the functional couplers explained by N. Furutate, in "Organic Compounds for Conventional Color Photography", Journal of The Society of Synthetic Organic Chemistry, Japan, Vol. 41, 439, 1983) and the couplers whose details are described in Research Disclosure 37038 (February, 1995), pages 80–85 and pages 87–89.

To be more specific, examples of the coupler for forming a yellow dye image include pivaloylacetamide-type couplers, benzoylacetamide-type couplers, malonic diester-type couplers, malonic diamide-type couplers, dibenzoylmethane-type couplers, benzothiazolylacetamide-type couplers, malonic ester monoamide-type couplers, benzoxazolylacetamide-type couplers, benzimidazolylacetamide-type couplers, benzothiazolylacetamide-type couplers, cycloalkylcarbonylacetamide-type couplers, indoline-2-ylacetamide-type couplers, quinazoline-4-one-2-ylacetamide-type couplers described in U.S. Pat. No. 5,021,332, benzo-1,2,4-thiadiazine-1,1-dioxide-3-ylacetamide-type couplers described in U.S. Pat. No. 5,021,330, couplers described in EP 421221A, couplers described in U.S. Pat. No. 5,455,149, couplers described in EP 0622673A, and 3-indoloylacetamide-type couplers described in EP 0953871A, 0953872A, and 0953873A.

Examples of the coupler for forming a magenta dye image include 5-pyrazolone-type couplers, 1H-pyrazolo[1,5-a]benzimidazole-type couplers, 1H-pyrazolo[5,1-c][1,2,4]triazole-type couplers, 1H-pyrazolo[1,5-b][1,2,4]triazole-type couplers, 1H-imidazo[1,2-b]pyrazole-type couplers, cyanoacetophenone-type couplers, active propane-type couplers described in WO93/01523, enamine-type couplers described in WO93/07534, 1H-imidazo[1,2-b][1,2,4]triazole-type couplers, and couplers described in U.S. Pat. No. 4,871,652.

Examples of the coupler for forming a cyan dye image include phenol-type couplers, naphthol-type couplers, 2,5-diphenylimidazole-type couplers described in EP 0249453A, 1H-pyrrolo[1,2-b][1,2,4]triazole-type couplers, 1H-pyrrolo[2,1-c][1,2,4]triazole-type couplers, pyrrole-type couples described in JP-A-4-188137 and JP-A-4-190347, 3-hydroxypyridine-type couples described in JP-A-1-315736, pyrrolopyrazole-type couplers described in U.S. Pat. No. 5,164,289, pyrroloimidazole-type couplers described in JP-A-4-174429, pyrazolopyrimidine-type couplers described in U.S. Pat. No. 4,950,585, pyrrolotriazine-type couplers described in JP-A-4-204730, couplers described in U.S. Pat. No. 4,746,602, couplers described in U.S. Pat. No. 5,104,783, couplers described in U.S. Pat. No. 5,162,196, and couplers described in European Patent No. 0556700.

In addition, preferable examples of the yellow coupler that can be used in the present invention include the methine dye-releasing couplers, as described in U.S. Pat. Nos. 5,447,819 and 5,457,004 and JP-A-2000-206655.

Specific examples of the representative coupler compounds that can be used in the present invention are given below, but it should be understood that the present invention is not restricted to these specific examples.

CP-101

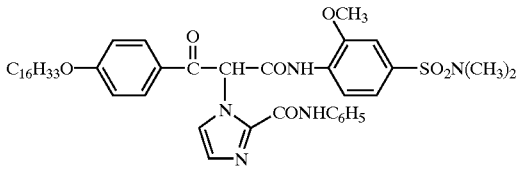

CP-102

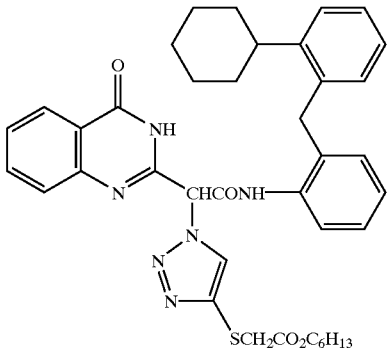

-continued
CP-103
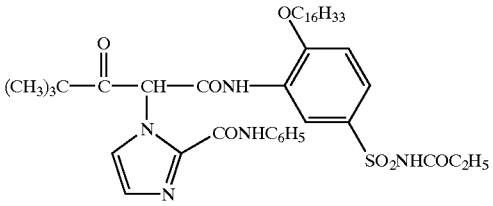
CP-104
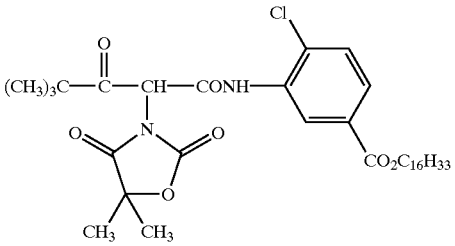
CP-105
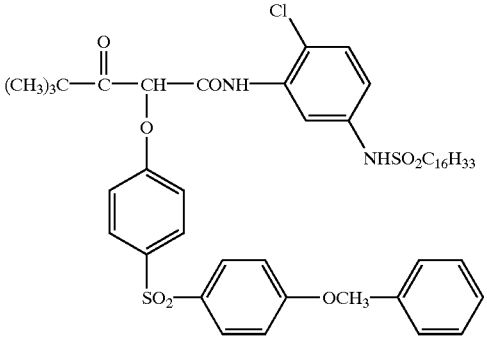
CP-106
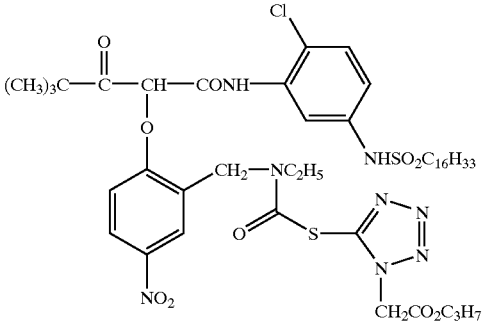
CP-108
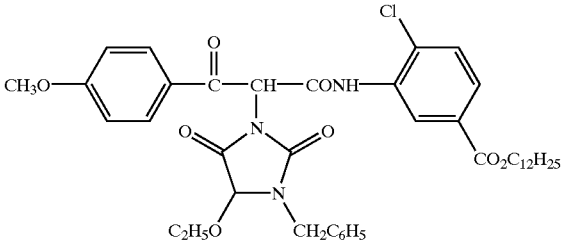
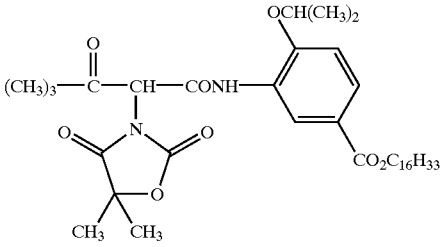
CP-109
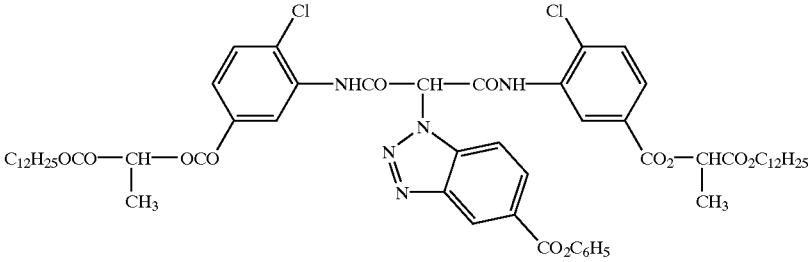
CP-110
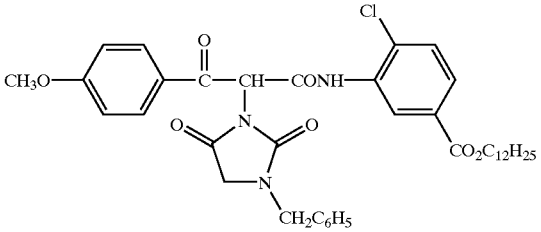
CP-111
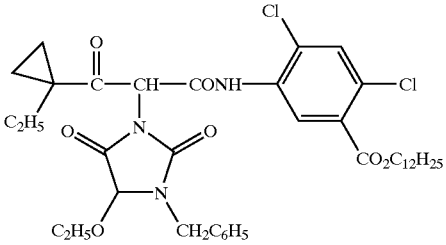

-continued
CP-112
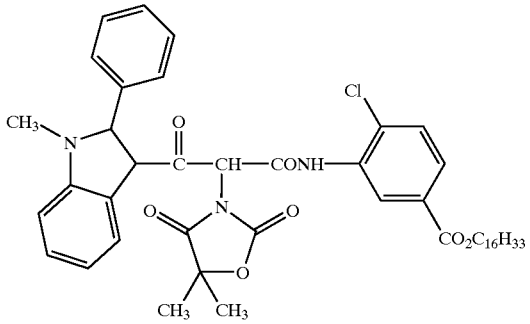
CP-113
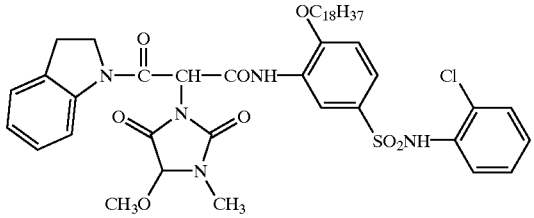
CP-114
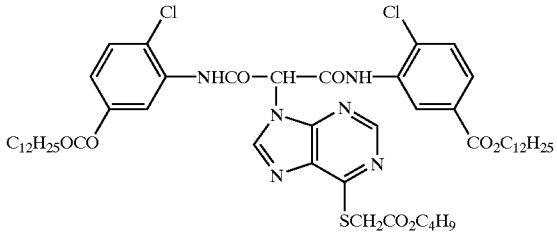
CP-115
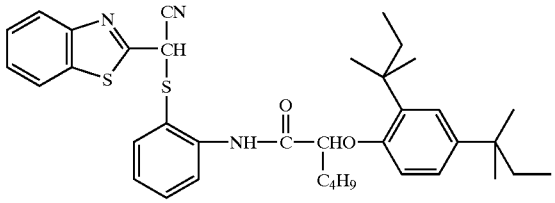
CP-116
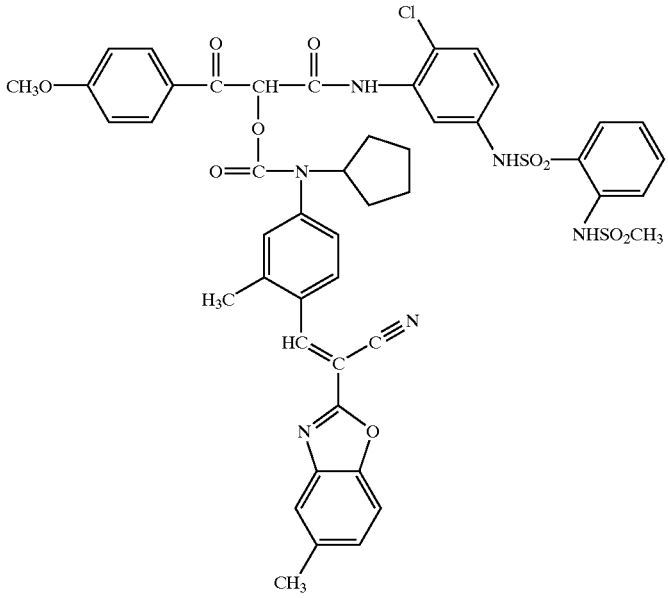

Compound Inv-16 described in JP-A-2000-206655
CP-117
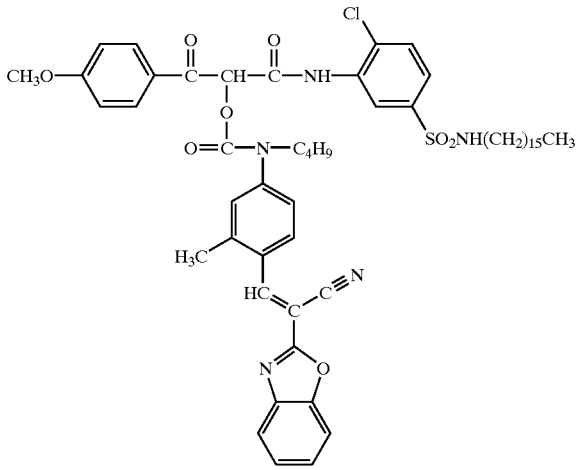
Compound Inv-5 described in U.S. Pat. No. 5,457,004
CP-201
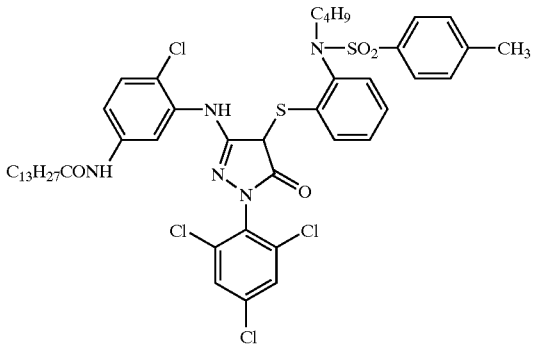
CP-202
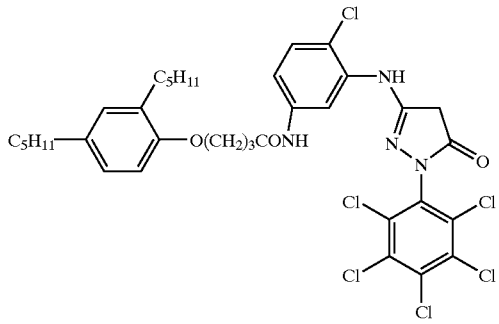
CP-203
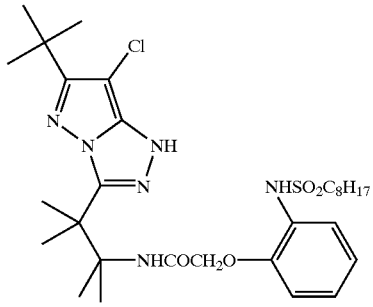
CP-204
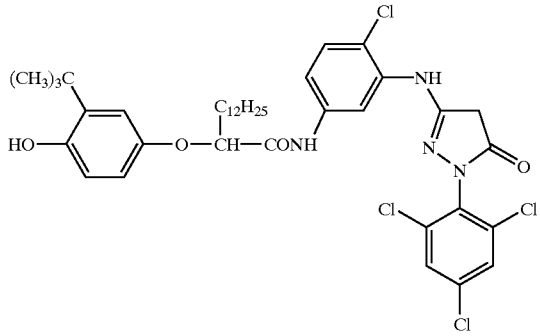

-continued
CP-205
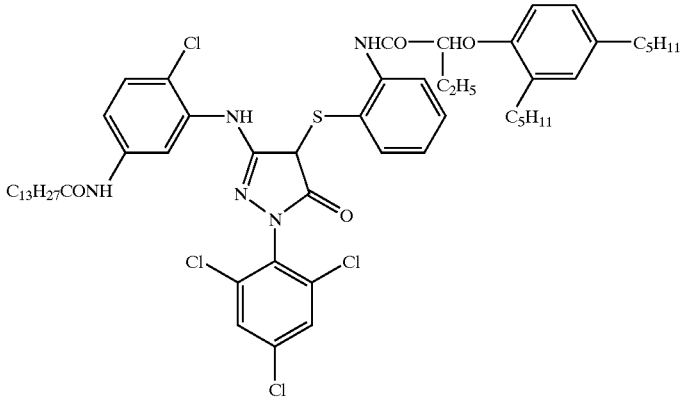
CP-206
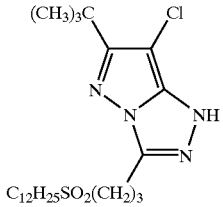
CP-207
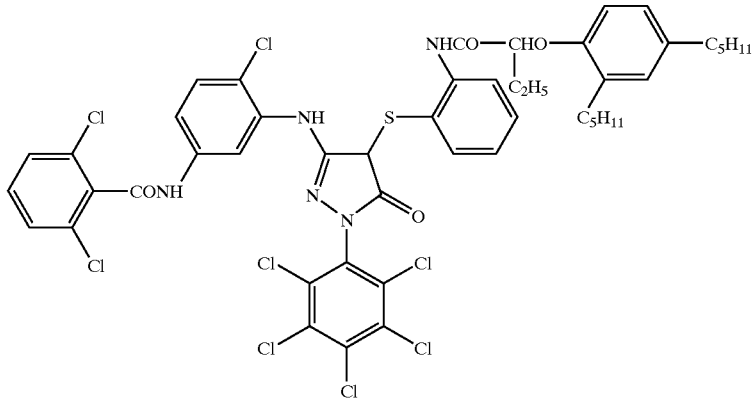
CP-208
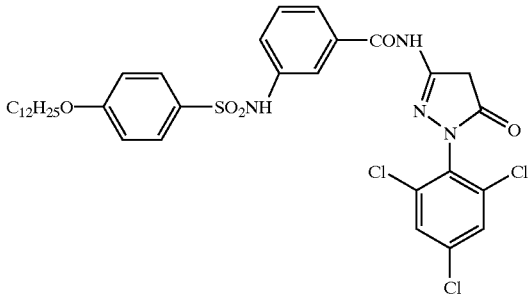
CP-209
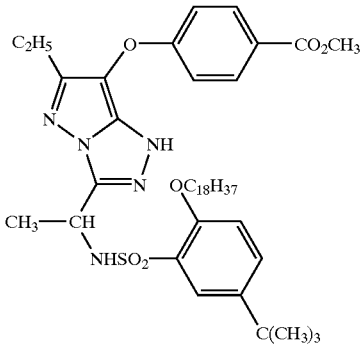

-continued
CP-210
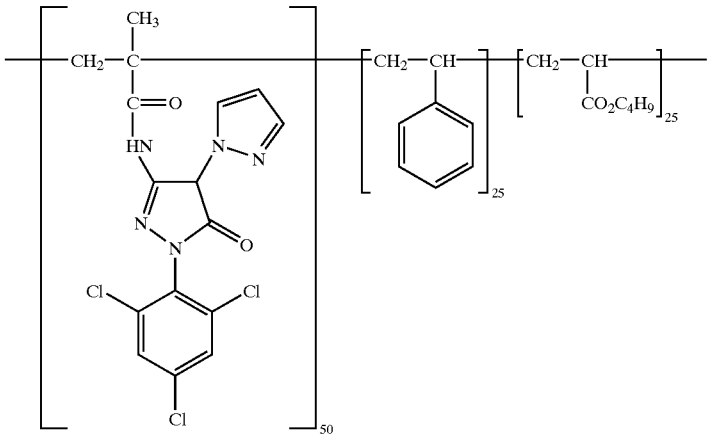
CP-211
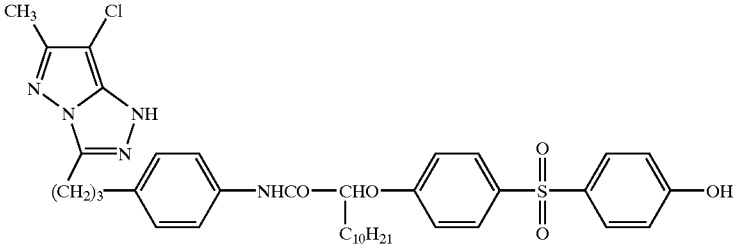
CP-212
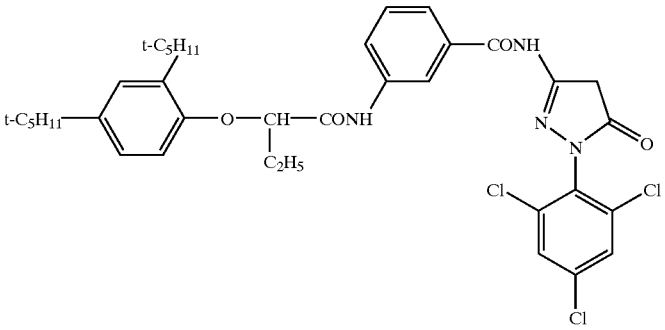
CP-213
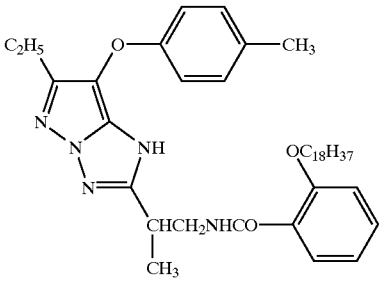
CP-214
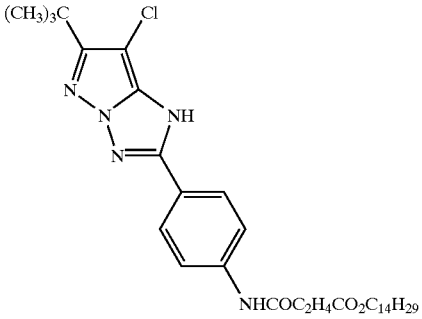
CP-115
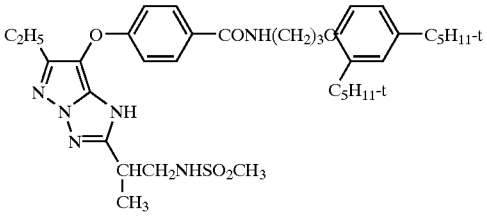
CP-116
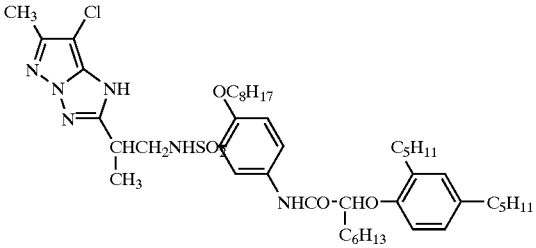

-continued
CP-217
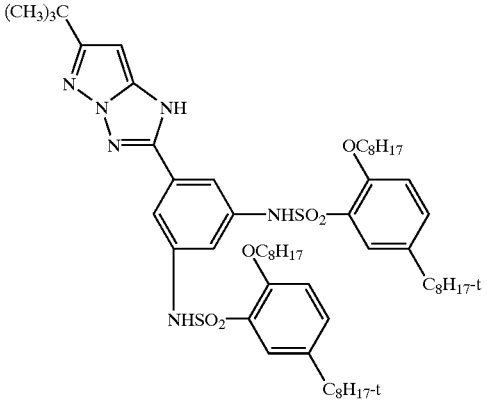
CP-218
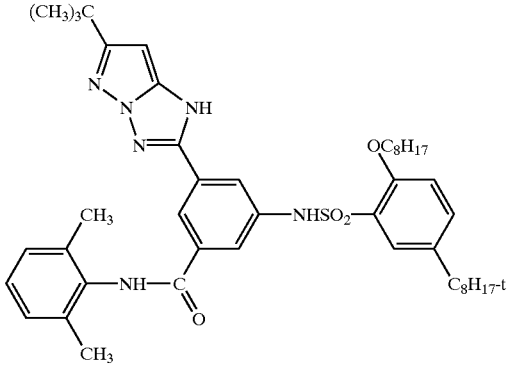
CP-219
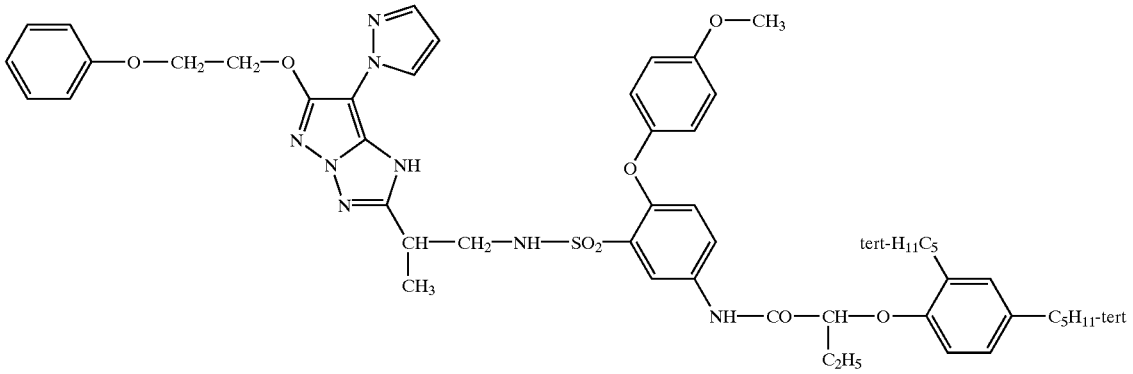
CP-220
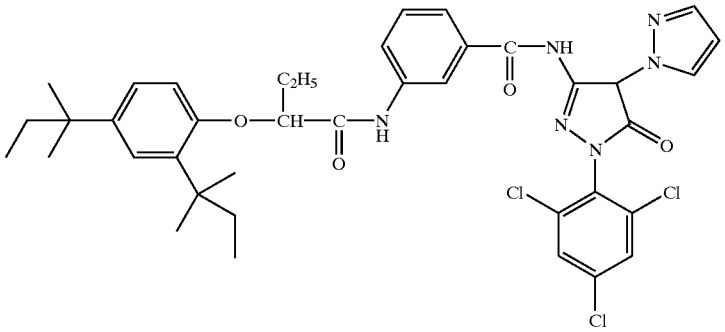
CP-301
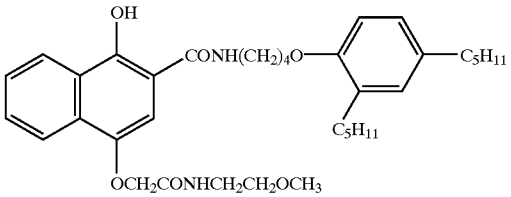
CP-302
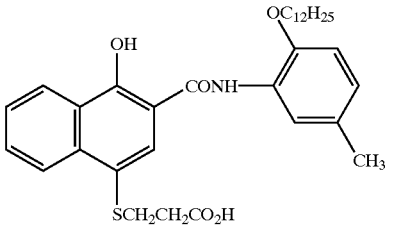
CP-303
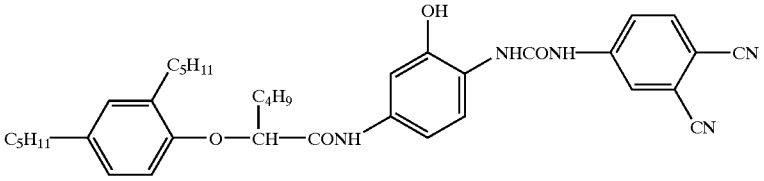

-continued
CP-304
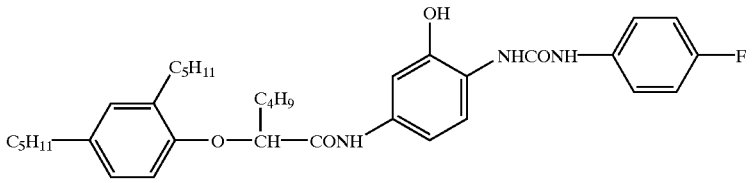
CP-305
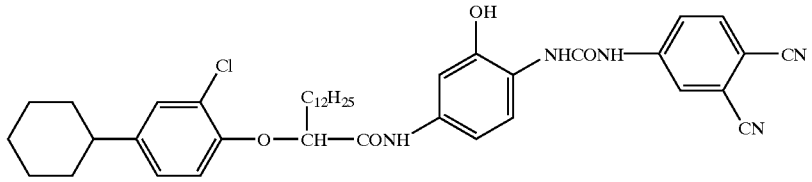
CP-306
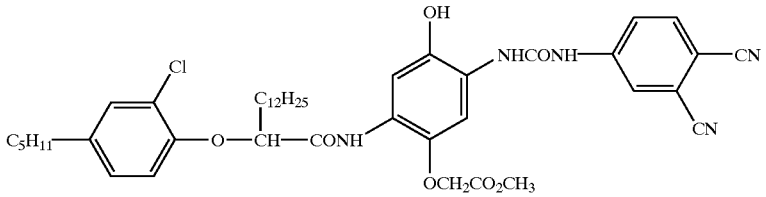
CP-307
CP-308
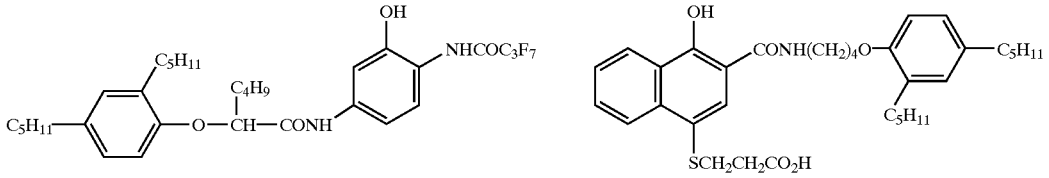
CP-309
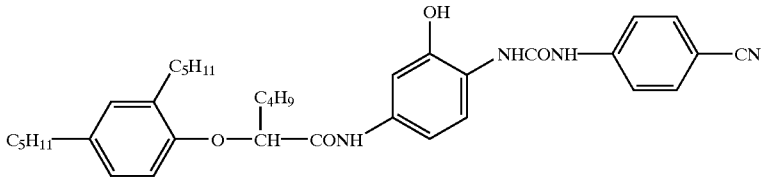
CP-310
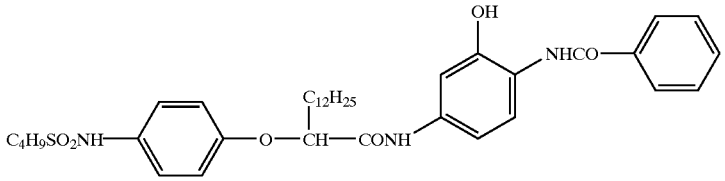
CP-311
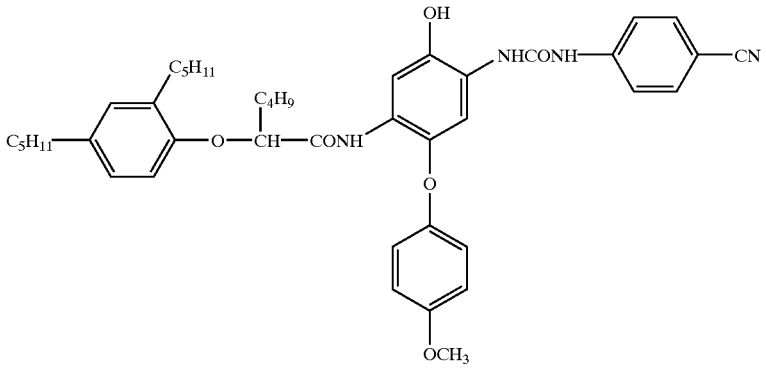

-continued
CP-312
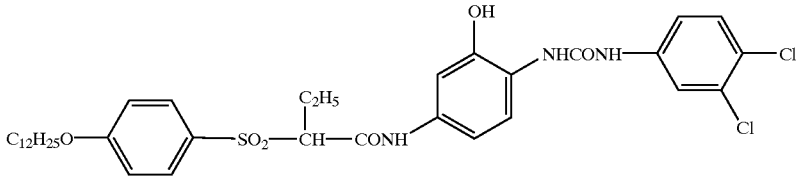
CP-313
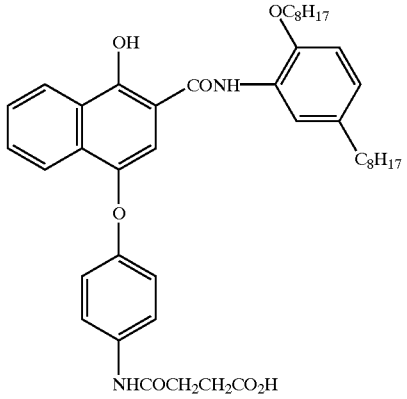
CP-314
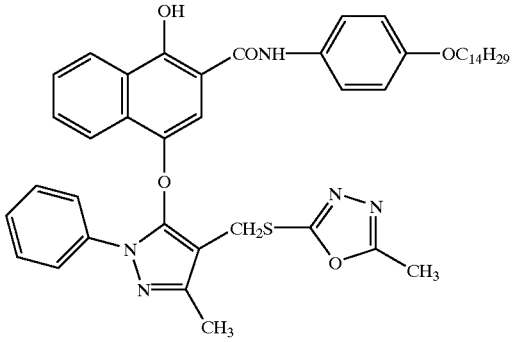
CP-315
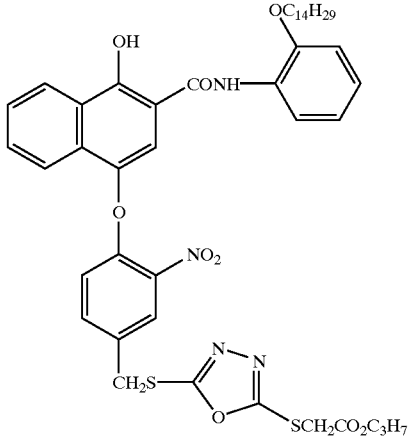
CP-316
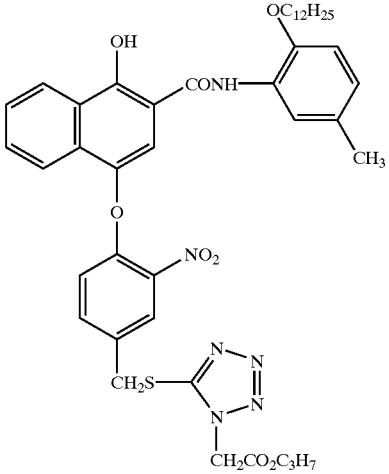
CP-317
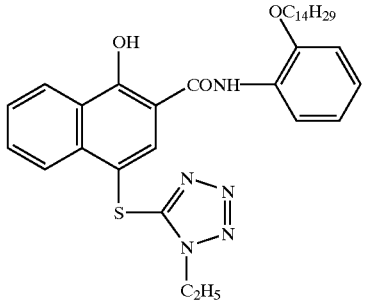
CP-318
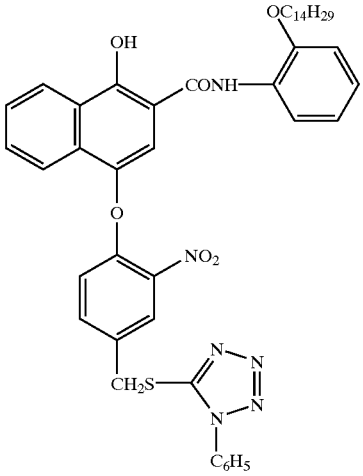

-continued
CP-319
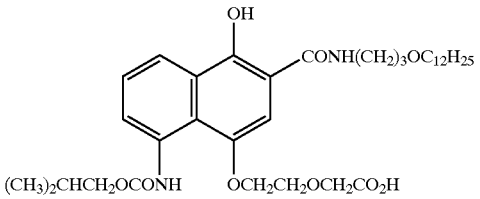
CP-320
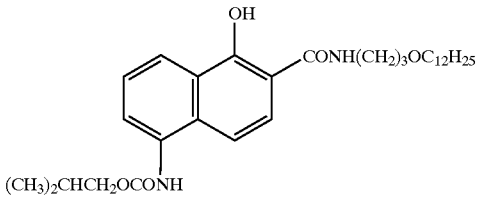
CP-321
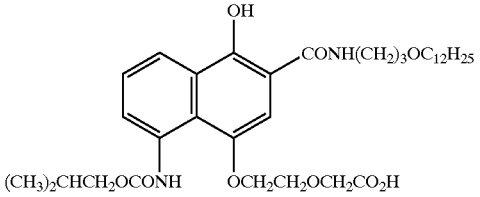
CP-322
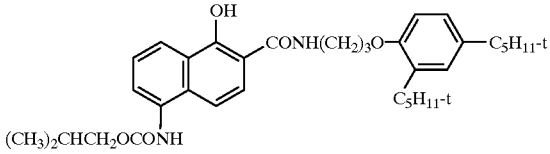
CP-323
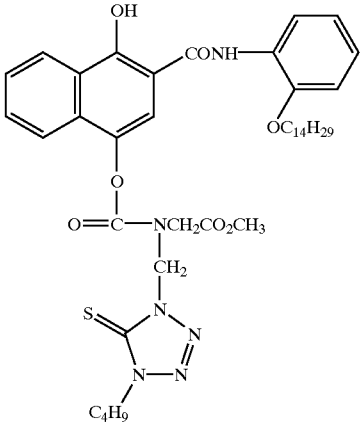
CP-324
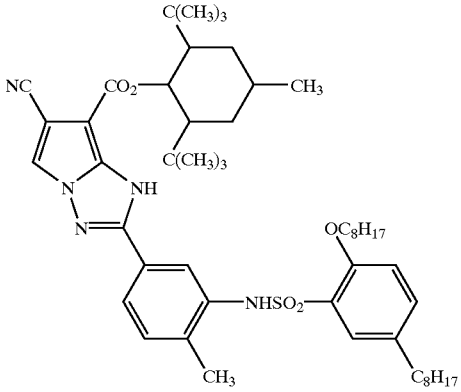
CP-325
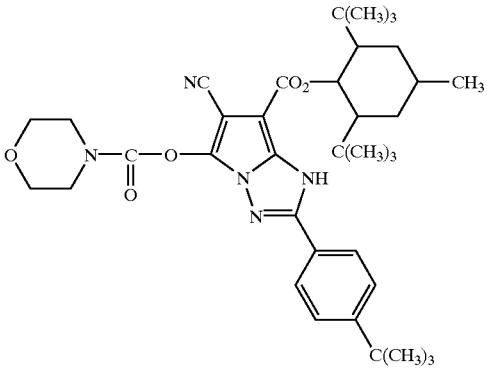
CP-326
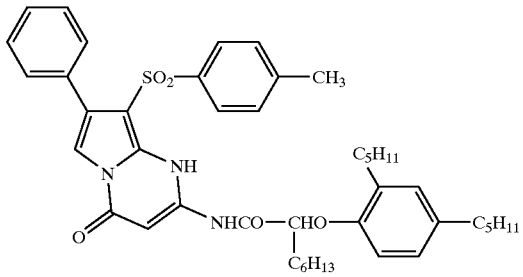
CP-327
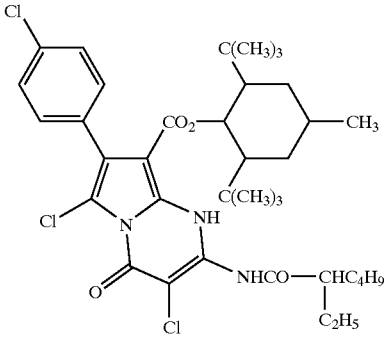
CP-328
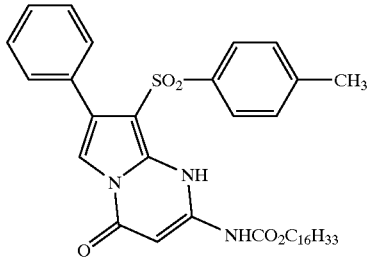

-continued

CP-329

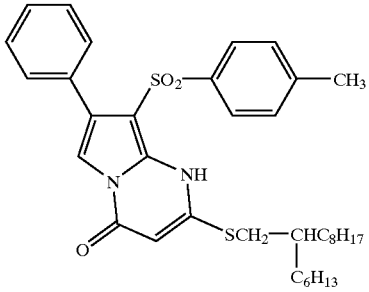

CP-330

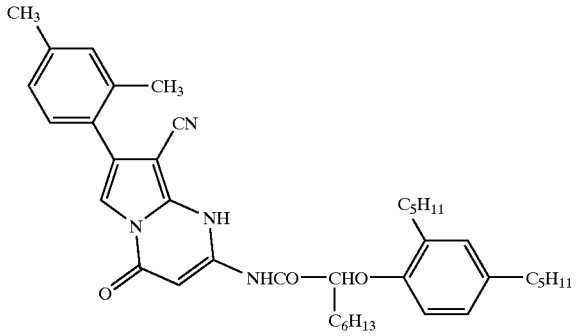

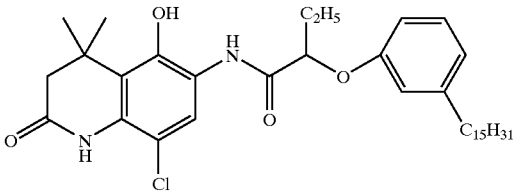

CP-331

The coupler compounds for use in the present invention can be easily synthesized by methods described in the patents and the like relating to couplers, as listed above, and known in photographic industries.

The coupler compound for use in the present invention may be added to any layer only if the layer to which the coupler compound is added is on the same side of the support as that of a layer containing a photosensitive silver halide and a layer containing a reducible silver salt. Preferably the coupler compound is added to the layer containing a photosensitive silver halide or to a layer adjacent thereto.

The amount to be added of the coupler compound for use in the present invention is preferably 0.2 to 500 mmol, more preferably 0.3 to 100 mmol, and further preferably 0.5 to 30 mmol, per mole of silver. The coupler compounds may be used singly or in a combination of two or more.

In the case where the light-sensitive material of the present invention is used as a light-sensitive material for shooting, the amount to be added of the coupler that can be used in the present invention is generally 0.5 to 200 mmol, preferably 2 to 100 mmol, per mol of silver.

Further, the following functional couplers can also be used in the present invention.

Preferable examples of couplers, which form a color dye having a suitable diffusive property, include those described in U.S. Pat. No. 4,366,237, GB 2,125,570, EP 96,873B, and DE 3,234,533.

Examples of the coupler, which is used for compensating unnecessary absorption of a color dye, include a yellow-colored cyan coupler described in EP 456,257A1, a yellow-colored magenta coupler described in EP 456,257A1, a magenta-colored cyan coupler described in U.S. Pat. No. 4,833,069, and a colorless masking coupler represented by Formula (2) or (A) described in claim 1 in U.S. Pat. No. 4,837,136 and WO92/11575 (particularly the exemplified compounds on pages 36 to 45).

Examples of the compound (including a coupler), which reacts with an oxidized product of a developing agent, to release a photographically useful compound's residue, include the followings:

Development inhibitor releasing compounds: compounds represented by any one of Formulae (I) to (IV) described on page 11 in EP 378,236A1, compounds represented by Formula (I) described on page 7 in EP 436,938A2, compounds represented by Formula (1) in EP 568,037A, and compounds represented by Formula (I), (II), or (III) described on pages 5 to 6 in EP440,195A2.

Bleaching accelerator releasing compounds: compounds represented by Formula (I) or (I') described on page 5 in EP 310,125A2 and compounds represented by Formula (I) described in claim 1 of JP-A-6-59411.

Ligand releasing compounds: compounds represented by LIG-X described in claim 1 of U.S. Pat. No. 4,555,478.

Leuco dye releasing compounds: compounds 1 to 6 in U.S. Pat. No. 4,749,641, columns 3 to 8; Fluorescent dye releasing compounds: compounds represented by COUP-DYE described in claim 1 of U.S. Pat. No. 4,774,181.

Compounds, which release a development accelerator or a fogging agent: compounds represented by Formula (1), (2) or (3) in U.S. Pat. No. 4,656,123, column 3, and compounds ExZK-2 described on page 75, lines 36 to 38, in EP 450,637A2.

Compounds which release a group capable of becoming a dye only after being split-off: compounds represented by Formula (I) described in claim 1 of U.S. Pat. No. 4,857,447, compounds represented by Formula (1) in Japanese Patent Application No.4-134523, compounds represented by Formula (I), (II) or (III) on pages 5 to 6 in EP 450,195A2, compounds-ligand releasing compounds represented by Formula (I) described in claim 1 in Japanese Patent Application No.4-325564, and compounds represented by LIG-X described in claim 1 of U.S. Pat. No. 4,555,478.

Any of these functional couplers are used in an amount of preferably 0.05 to 10 times, and more preferably 0.1 to 5 times, the molar amount of the above-mentioned coupler contributing to the color formation.

The melting point of the coupler for use in the present invention is preferably 90° C. or higher.

The melting point of the coupler for use in the present invention is preferably higher than the melting point of the thermal solvent, and more preferably higher than the development processing temperature. It is preferable that the coupler for use in the present invention is compatible with the thermal solvent to be used in combination.

The thermal solvent for use in the present invention is explained below.

The term "thermal solvent" as used herein means an organic material, which is a solid at ambient temperature, but exhibits a mixed melting point at or below the temperature employed for thermal treatment together with another component, and liquefies at the time of heat development, so that the heat development or the thermal transfer of a dye are accelerated. Examples of the compound useful as the thermal solvent include a compound capable of becoming a solvent for the developing agent, a compound having a high dielectric constant and known to accelerate the physical development of a silver salt, and a compound compatible with the binder and capable of swelling the binder.

The thermal solvent that can be used in the present invention may be a substance that has a low water-solubility preferable for dispersing fine crystals, and the thermal solvent can be selected from the compounds described in, for example, U.S. Pat. Nos. 3,347,675, 3,667,959, 3,438,776, and 3,666,477, Research Disclosure No.17,643, JP-A-51-19525, JP-A-53-24829, JP-A-53-60223, JP-A-58-118640, JP-A-58-198038, JP-A-59-229556, JP-A-59-68730, JP-A-59-84236, JP-A-60-191251, JP-A-60-232547, JP-A-60-14241, JP-A-61-52643, JP-A-62-78554, JP-A-62-42153, JP-A-62-44737, JP-A-63-53548, JP-A-63-161446, JP-A-1-224751, JP-A-2-863, JP-A-2-120739, and JP-A-2-123354. More specifically, these compounds described above include urea derivatives (e.g. phenylmethyl urea), amide derivatives (e.g., acetamide, stearylamide, p-toluamide, and p-propanoyloxyethoxybenzamide), sulfonamide derivatives (e.g., p-toluenesulfonamide), polyhydric alcohols (e.g., polyethylene glycol having a high molecular weight), and phenol derivatives (e.g. salicylanilide). In order to enhance the dispersion stability of the dispersion of fine crystalline particles, the water solubility of the preferred thermal solvent that can be used in the present invention is preferably 1 g/cubic meter or less, and more preferably $10^{-3}$ g/cubic meter or less.

It is preferable that the melting point of the thermal solvent for use in the present invention is 90° C. or higher, but equal to or lower than the development processing temperature.

The amount to be used of the thermal solvent for use in the present invention is generally in the range of 1 to 200% by mass, preferably in the range of 5 to 50% by mass, relative to the coating amount of the binder.

Specific examples and melting points of the representative thermal solvents that can be used in the present invention are shown below, but it should be understood that the present invention is not restricted to these specific examples.

TS-1

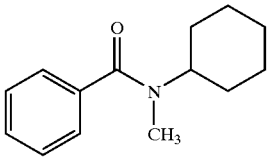

mp. 76° C.

TS-2

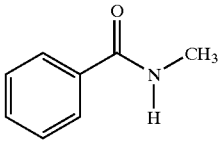

mp. 76° C.

-continued

TS-3

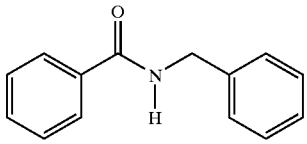

mp. 104° C.

TS-4

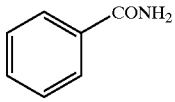

mp. 128° C.

TS-5

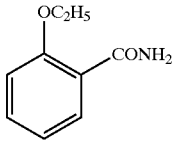

mp. 131° C.

TS-6

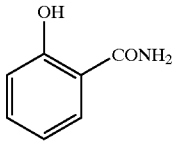

mp. 140° C.

TS-7

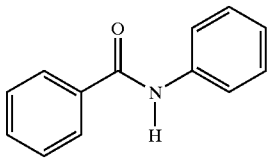

mp. 164° C.

TS-8

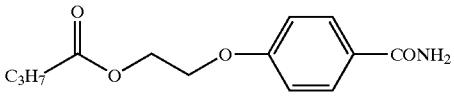

mp. 104° C.

TS-9

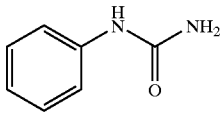

mp. 146° C.

TS-10

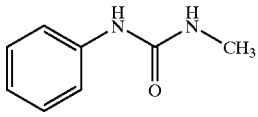

mp. 149° C.

TS-11

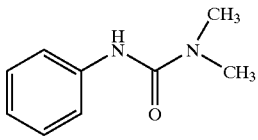

mp. 134° C.

TS-12

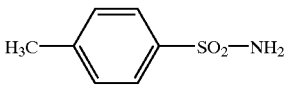

mp. 139° C.

-continued

TS-13

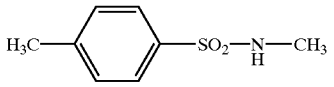

mp. 80° C.

TS-14

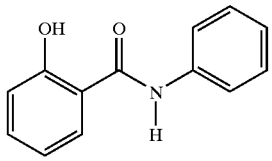

mp. 135° C.

The silver halide that can be used in the light-sensitive material of the present invention may be any of silver iodobromide, silver bromide, silver chlorobromide, silver iodochloride, silver chloride, and silver iodochlorobromide. The grain size of the silver halide is preferably 0.1 to 2 μm, and particularly preferably 0.2 to 1.5 μm, in terms of the diameter of a sphere having a volume equivalent to an individual grain's volume. Besides the use as photosensitive silver halide grains described above, these silver halides may also be used as non-photosensitive silver halide grains without chemical sensitization or the like.

The shape of the silver halide grain may be selected from a regularly structured crystal such as a cube, octahedron, or tetradecahedron, and a tabular shape such as a hexagon or rectangle. Among these shapes, a tabular shape, which has an aspect ratio, i.e., a value obtained by dividing the diameter of the projected grain (e.g. the diameter of a circle having an area equivalent to that of an individual grain) by the grain thickness, of 2 or more, more preferably 8 or more, and further preferably 20 or more, is preferable. It is preferable to use an emulsion in which these tabular grains account for 50% or more, more preferably 80% or more, and further preferably 90% or more, of the total projected area of all the grains.

The thicknesses of these tabular grains are preferably 0.3 μm or less, more preferably 0.2 μm or less, and most preferably 0.1 μm or less.

In addition, grains, which have thicknesses less than 0.07 μm and have even higher aspect ratios, as described in U.S. Pat. Nos. 5,494,789, 5,503,970, 5,503,971, 5,536,632, and the like, can also be used preferably.

Furthermore, tabular grains, which are rich in silver chloride and have (111) plane as a main face, as described in U.S. Pat. Nos. 4,400,463, 4,713,323, 5,217,858, and the like; and tabular grains, which are rich in silver chloride and have (100) plane as a main face, as described in U.S. Pat. Nos. 5,264,337, 5,292,632, 5,310,635, and the like, can also be used preferably.

Examples in which these silver halide grains are actually used are described in JP-A-9-274295, JP-A-9-319047, JP-A-10-115888, JP-A-10-221827, and the like. The silver halide grains that can be used in the present invention are preferably so-called monodispersed grains having a uniform grain size distribution. As an indicator of the monodispersity, a variation coefficient, which is obtained by dividing the standard deviation of the grain size distribution by an average grain diameter, is preferably 25% or less and more preferably 20% or less. It is also preferable that the halogen composition among grains is homogeneous.

The halogen composition inside the silver halide grain for use in the present invention may be homogeneous. Alternatively, a site having a different halogen composition may be intentionally introduced into the grain. In particular, for the purpose of obtaining a high sensitivity, a grain having a laminate structure, which is comprised of a core and a shell each having a different halogen composition, is preferably used. It is also preferable to further grow the grain after a region having a different halogen composition is introduced so that a dislocation line is intentionally introduced. Further, it is also preferable to epitaxially join a guest crystal, which has a different halogen composition, to an apex or side of a host grain formed.

It is also preferable that the inside of the silver halide grain for use in the present invention is doped with a multivalent transition metal ion or a multivalent anion, as an impurity. In particular, in the case of the former, preferred examples that are employed include complexes having, as a central metal, an element of iron group, such as a halogeno complex, a cyano complex, a complex having an organic ligand.

As a method for preparing the silver halide grains for use in the present invention, known method described, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating of Photographic Emulsion," Focal Press, 1964, can be referred to. That is, any of pH regions among the acid process, the neutral process, the ammonia process, and the like can be used to prepare silver halide grains. Further, to supply a water-soluble silver salt solution and a water-soluble halogen salt solution that are reaction solutions, any of the single-jet method, the double-jet method, a combination thereof, and the like can be used. The controlled double-jet method, can also be used preferably, wherein the addition of reaction solutions are controlled, to keep the pAg during the reaction constant to a targeted value. A method in which the pH of the reaction liquid during the reaction is kept constant can also be used. In the step for forming grains, a method in which the solubility of the silver halide is controlled by changing the temperature, pH, or pAg of the system, can be used; and a thioether, a thiourea, a rhodanate, and the like can be used as a silver halide solvent. Examples of these are described, for example, in JP-B-47-11386, and JP-A-53-144319.

Generally, the preparation of the silver halide grains for use in the present invention is carried out by feeding a solution of a water-soluble silver salt, such as silver nitrate, and a solution of a water-soluble halogen salt, such as an alkali halide, into an aqueous solution containing a water-soluble binder dissolved therein, such as gelatin, under controlled conditions. After the formation of the silver halide grains, the excess water-soluble salts are preferably removed. For example, the noodle water-washing method, in which a gelatin solution containing silver halide grains are made into a gel, and the gel is cut into a string-shape, then the water-soluble salts are washed away using a cold water; and the sedimentation method, in which inorganic salts comprising polyvalent anions (e.g. sodium sulfate), an anionic surfactant, an anionic polymer (e.g. sodium polystyrenesulfonate), or a gelatin derivative (e.g. an aliphatic-acylated gelatin, an aromatic-acylated gelatin, and an aromatic-carbamoylated gelatin) is added, to allow the gelatin to aggregate, thereby removing the excess salts, can be used. The sedimentation method is preferably used because removal of the excess salts can be carried out rapidly.

Generally, it is preferred that chemical sensitization and spectral sensitization is subjected to the photosensitive emulsion for use in the present invention.

As the chemical sensitization method, use can be made of the chalcogen sensitization method, wherein a sulfur, selenium, or tellurium compound is used; the noble metal sensitization method, wherein gold, platinum, iridium, or the like is used; and the so-called reduction sensitization method, wherein a compound having a suitable reducing ability is used during the grain formation to introduce reducing silver nuclei, to obtain high sensitivity. The above chemical sensitization methods may be used singly or in combination.

As the spectral sensitization method, use is made of a so-called spectrally sensitizing dye providing grains of silver halide with light absorbance in its wavelength range, by adsorbing onto the grains of silver halide. Examples of such a dye include cyanine dyes, merocyanine dyes, composite cyanin dyes, composite merocyanine dyes, halopolar dyes, hemicyanine dyes, styryl dyes, and hemioxonol dyes. These spectrally sensitizing dyes may be used singly or in combination; and also, it is preferred that these are used in combination with a supersensitizer.

The coating amount of the light-sensitive silver halide (emulsion) used in the present invention is generally in the range of 0.05 mg to 15 g/m$^2$, preferably 0.1 to 8 g/m$^2$, in terms of silver.

In the silver halide emulsion for use in the present invention, various stabilizers can be incorporated for the purpose of preventing fogging, or for the purpose of improving stability at storage. As a preferable stabilizer, nitrogen-containing heterocyclic compounds, such as azaindenes, triazoles, tetrazoles, and purines; mercapto compounds, such as mercaptotetrazoles, mercaptotriazoles, mercaptoimidazoles, and mercaptothiadiazoles, can be mentioned. Particularly, among these, triazoles or mercaptoazoles that have an alkyl group having 5 or more carbon atoms, or have an aromatic group as a substituent(s), prevent fogging at the time of the heat development, and in a certain case, improve developability of an exposed area, so that these compounds exhibit remarkable effects on providing high-discrimination.

Specifically, antifogging agents each substituted by a hydrophobic substituent, as described in U.S. Pat. No. 5,773,560, JP-A-11-109539 and JP-A-11-119397, can be used.

The timing when the antifoggant or the stabilizer is added to the silver halide emulsion, may be at any stage in the preparation of the emulsion. The addition to the emulsion can be carried out at any time, singly or in combination, of after the completion of the chemical sensitization and during the preparation of a coating solution, at the time of the completion of the chemical sensitization, during the chemical sensitization, prior to the chemical sensitization, after the completion of the grain formation and before desalting, during the grain formation, or prior to the grain formation.

In addition, a divalent metal ion described in JP-A-2000-89409 is preferably used together.

The antifogging agent may be added to any layer as long as, on the support, the layer is provided on the same side of the support, to which side the layer containing the light-sensitive silver halide and the layer containing the reducible silver salt are provided. It is preferred that the antifogging agent is added to a layer containing the reducible silver salt or a layer adjacent to the layer. The antifogging agent can be used by dissolving in water or a suitable organic solvent, or by preparing an emulsified dispersion in accordance with the well-known emulsifying and dispersing method. Alternatively, the antifogging agent can be used, by dispersing powder of the antifogging agent in water according to the well-known dispersing method of fine crystalline grains.

The amount of these antifogging agents or stabilizers to be added varies widely in accordance with the halogen composition of the silver halide emulsion and the purpose, and it is generally in the range of $10^{-6}$ to $10^{-1}$ mol. and preferably $10^{-5}$ to $10^{-2}$ mol, per mol of the silver halide.

It is also preferable to add a heterocyclic compound, which is described in EP 1016902A and has a ClogP value sufficient to raise sensitivity, to the light-sensitive material of the present invention. Further, it is also preferable to add a triazole-series compound which is described in JP-A-2001-051383 and has a ClogP value in the range of 4.75 to 9.0; a purine-series compound which is described in JP-A-2001-051384 and has a ClogP value of 2 or more but less than 7.2; a mercapto-1,2,4-thiadiazole-series or mercapto-1,2,4-oxadiazole-series compound, which is described in JP-A-2001-051385 and has a ClogP value of 1 or more but less than 7.6; or a tetrazole-series compound which is described in JP-A-2001-051386 and has a ClogP value of 2 or more but less than 7.8. Each of these compounds may be added as fine oil droplets, which are prepared by dissolving the compound in a high-boiling-point organic solvent, as in the case of other oil-soluble compounds such as a developing agent and a coupler, to be used in the present invention. Alternatively, a solution, which is prepared by dissolving the compound in a water-miscible solvent, may be added to the binder. Further, a silver salt of the compound, which is prepared in advance, may be added to the light-sensitive material. In that case, the silver salt may be added as a dispersion of solid particles, to the light-sensitive material, besides the use of the adding methods listed above.

Specific examples of the above-mentioned compounds include the following compound X which is described in EP 1016902A.

The compound (X) described in European Patent No. 1016902

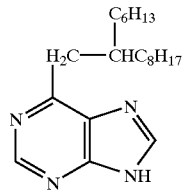

The amount of these compounds to be added may vary within a wide range in order to obtain the intended performances, and the amount is generally in the order of $1\times10^{-5}$ to 1 mole, per mole of silver halide.

When the compound is used as a free body or as an alkali metal salt, a preferable amount to be added of the compound is in the order of $10^{-3}$ to $10^{-1}$ mole per mole of silver halide. When the compound is used as a silver salt, a preferable amount thereof is in the order of $10^{-2}$ to 1 mole per mole of silver halide.

The above-mentioned additives for photography that can be used in the light-sensitive material of the present invention are described in more detail in Research Disclosures (hereinafter abbreviated to as RD) No. 17643(December 1978), RD No. 18716 (November 1979), RD No. 307105 (November 1989), and RD No. 38957 (September 1996) and the particular parts are shown below.

| Kind of Additive | RD 17643 | RD 18716 | RD 307105 |
|---|---|---|---|
| Chemical sensitizers | p. 23 | p. 648 (right column) | p. 866 |
| Sensitivity-enhancing agents | — | p. 648 (right column) | — |
| Spectral sensitizers and Supersensitizers | pp. 23–24 | pp. 648 (right column)–649 (right column) | pp. 866–868 |
| Brightening agents | p. 24 | pp. 648 (right column) | p. 868 |
| Antifogging agents and Stabilizers | pp. 24–26 | p. 649 (right column) | pp. 868–870 |
| Light absorbers, Filter dyes, and UV Absorbers | pp. 25–26 | pp. 649 (right column)–650 (left column) | p. 873 |
| Dye image stabilizers | p. 25 | p. 650 (left column) | p. 872 |
| Hardeners | p. 26 | p. 651 (left column) | pp. 874–875 |
| Binders | p. 26 | p. 651 (left column) | pp. 873–874 |
| Plasticizers and Lubricants | p. 27 | p. 650 (right column) | p. 876 |
| Coating aids and Surfactants | pp. 26–27 | p. 650 (right column) | pp. 875–876 |
| Antistatic agents | p. 27 | p. 650 (right column) | pp. 876–877 |
| Matting agents | — | — | pp. 878–879 |

The reducible silver salt for use in the present invention is explained below.

The reducible silver salt that can be used in the present invention is relatively stable to light, but it provides a silver ion when heated to a temperature of 80° C. or above, in the presence of a photocatalyst (e.g., latent image of a photosensitive silver halide) exposed to light and of a reducing agent. Such silver salt is preferably a complex of an organic or inorganic silver salt in which the gross stability constant of the ligand to silver ion, indicative of the complex stability, is within the range of 4.0 to 10.0.

Preferable organosilver salts include a silver salt of an organic compound having a carboxyl group. Preferable examples thereof include a silver salt of an aliphatic carboxylic acid and a silver salt of an aromatic carboxylic acid. Preferable examples of the silver salt of an aliphatic carboxylic acid include silver behenate, silver stearate, silver oleate, silver laurate, silver caprate, silver myristate, silver palmitate, silver maleate, silver fumarate, silver tartrate, silver furoate, silver linoleate, silver butyrate, silver camphorate, and mixtures thereof. A halogen- or hydroxyl-substitutable silver salt can also be effectively used. Preferable examples of the silver salt of an aromatic carboxylic acid or another carboxyl group-containing compound include silver benzoate, silver salts of a substituted benzoic acid (e.g., silver 3,5-dihydroxybenzoate, silver o-methylbenzoate, silver m-methylbenzoate, silver p-methylbenzoate, silver 2,4-dichlorobenzoate, silver acetamidobenzoate, and silver p-phenylbenzoate), silver gallate, silver tannate, silver phthalate, silver terephthalate, silver salicylate, silver phenylacetate, silver pyromellitate, a silver salt of 3-carboxymethyl-4-methyl-4-thiazoline-2-thione, silver salts such as those described in U.S. Pat. No. 3,785,830; and silver salts of an aliphatic carboxylic acid having a thioether group, as described in U.S. Pat. No. 3,330,663.

Also use can be made preferably of a silver salt of a mercapto- or thione-substituted compound having a heterocyclic nucleus, which has 5 or 6 ring atoms such that at least one thereof is nitrogen and other ring atoms include carbon and 2 or less hetero atoms selected from oxygen, sulfur, and nitrogen. Typical preferable heterocyclic nuclei include triazole, tetrazole, oxazole, thiazole, thiazoline, thiadiazole, imidazoline, imidazole, diazole, pyridine, and triazine. Preferred examples of these heterocyclic compounds include silver salt of 3-mercapto-4-phenyl-1,2,4-triazole, silver salt of 2-mercaptobenzimidazole, silver salt of 2-mercapto-5-aminothiadiazole, silver salt of 2-(2-ethyl-glycolamido) benzothiazole, silver salt of 5-carboxyl-1-methyl-2-phenyl-4-thiopyridine, silver salt of mercaptotriazine, silver salt of 2-mercaptobenzoxazole, silver salt of 1-mercapto-5-alkyl-substituted tetrazole; silver salt of 1-mercapto-5-phenyltetrazole, as described in JP-A-1-100177; silver salts described in U.S. Pat. No. 4,123,274; silver salts of 1,2,4-mercaptothiazole derivatives such as silver salt of 3-amino-5-benzylthio -1,2,4-triazole; silver salts of a thione compound such as silver salt of 3-(2-carboxyethyl)-4-methyl-4-thiazoline-2-thione, as described in U.S. Pat. No. 3,201,678; silver salts of 3-amino-1,2,4-triazoles described in JP-A-53-116144, silver salts of substituted or unsubstituted benzotriazoles, and benzotriazoles, fatty acids, and other compounds described in U.S. Pat. No. 4,500,626, columns 52–53. Further, examples of useful mercapto- or thione-substituted compounds having no heterocyclic nucleus include silver salts of thioglycolic acid such as silver salt of S-alkylthioglycolic acid (said alkyl group contains 12 to 22 carbon atoms), as described in Japanese Patent Application No.48-28221; silver salts of dithiocarboxylic acid such as silver salt of dithioacetic acid, and silver salts of thioamides.

Furthermore, silver salts of imino group-containing compounds can be used. Preferable examples of these compounds include silver salts of benzothiazole and derivatives thereof, as described in Japanese Patent Application Nos.44-30270 and 45-18146; silver salts of benzotriazoles such as silver salt of methylbenzotriazole; silver salts of halogen-substituted benzotriazoles such as silver salt of 5-chlorobenzotriazole; silver salt of 1,2,4-triazole; silver salts of 1H-tetrazole, as described in U.S. Pat. No. 4,220,709; silver salts of imidazole and silver salts of imidazole derivatives.

Silver acetylide described in U.S. Pat. No. 4,775,613 is also useful.

Organosilver salts may be used in combinations of two or more thereof. The above-mentioned organosilver salt may be used in an amount of generally 0.01 to 10 moles, preferably 0.01 to 1 mole, per mole of photosensitive silver halide.

The total coating amounts of the photosensitive silver halide (emulsion) and the organosilver salt are generally 0.1 to 20 g/m$^2$, preferably 1 to 10 g/m$^2$, in terms of the amount of silver. The silver-providing substance may constitute preferably about 5 to 70% by mass of the image-forming layer.

The organosilver salt that is preferably used in the present invention is prepared by carrying out a reaction between a solution or suspension of the above-mentioned organic compound or an alkali metal salt thereof (e.g., Na-salt, K-salt, Li-salt, or the like) and silver nitrate, in a tightly closed means designed to mix liquids. Specifically, the methods, which are described in Japanese Patent Application Nos. 11-203413 and 11-104187, paragraphs 0019-0021, can be used.

A method, in which a solution of the organic compound and a solution of silver nitrate are added simultaneously, into a solution of a dispersant, may also be employed.

In the present invention, when the organosilver salt is prepared, a water-soluble dispersant may be added to the aqueous solution of silver nitrate and the solution of the organic compound or an alkali metal salt thereof, or to the reaction solution. Specific examples of the kinds and amounts of the dispersant to be used are described in Japanese Patent Application No.11-115457, paragraph 0052.

The method for forming the silver salt of organic compound that can be preferably used in the present invention, is the method in which the silver salt of the organic compound is formed while controlling pH, as described in JP-A-1-100177.

The organosilver salt for use in the present invention is preferably a desalted one. The desalting method is not particularly limited and any known method can be employed. As the desalting method, a known filtration method, such as centrifugal filtration, suction filtration, ultrafiltration, flock-forming water-washing by a flocculation method, can be preferably employed. As to the ultrafiltration method, the method described in Japanese Patent Application No.11-115457 can be used.

In the present invention, in order to obtain a dispersion of solid organosilver salt particles free of flocculation and small in particle size, it is preferable to employ a dispersing method in which an aqueous dispersion of an organosilver salt is transformed into a high-speed stream and thereafter the pressure is dropped. As to such dispersing methods, the methods described in Japanese Patent Application No.11-104187, paragraphs 0027–0038, can be employed.

The shape and size of the organosilver salt that can be used in the present invention are not particularly limited, and a dispersion of solid fine-particles having an average particle size of 0.001 to 5.0 $\mu$m is preferable. A more preferable average particle size is 0.005 to 1.0 $\mu$m.

The particle size distribution of the dispersion of solid organosilver salt fine-particles for use in the present invention is preferably monodispersed. More specifically, the percentage of the value (variation coefficient), which is obtained by dividing the standard deviation of the volume-weighted average diameter by the volume-weighted average diameter, is preferably 80% or less, more preferably 50% or less, and further preferably 30% or less.

The dispersion of solid organosilver salt fine-particles for use in the present invention, at least comprises an organosilver salt and water. Although the proportion between the organosilver salt and water is not particularly limited, it is preferable that the proportion of the organosilver salt accounts for 5 to 50% by mass of the total. In particular, the range of 10 to 30% by mass is preferable. Although the use of the above-mentioned dispersant is preferable, it is preferable to use the dispersant in a minimum amount within a range suitable for minimizing the particle size. The amount of the dispersant is preferably in the range of 0.5 to 30% by mass, in particular in the range of 1 to 15% by mass, relative to the organosilver salt.

In the present invention, a metal ion, which is selected from Ca, Mg, and Zn, may be added to the non-photosensitive organosilver salt, for such purposes as prevention of fogging.

The photosensitive silver halide and/or reducible silver salt in the present invention, can be further protected by a known anti-fogging agent, stabilizer, and a precursor thereof, against the formation of additional fogging, so that the decrease in sensitivity during storage can be more efficiently prevented to stabilize the resultant photographic material. Preferable examples of the anti-fogging agent, stabilizer, and stabilizer precursor that can be used singly or in combination, include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urasoles described in U.S. Pat. No. 3,287,135, sulfocatechols described in U.S. Pat. No. 3,235,652; oximes, nitrons, and nitroindazoles described in U.K. Patent No. 623,448; salts of multivalent metals, as described in U.S. Pat. No. 2,839,405; thiuronium salts described in U.S. Pat. No. 3,220,839; salts of palladium, platinum, and gold, as described in U.S. Pat. Nos. 2,566,263 and 2,597,915; halogen-substituted organic compounds described in U.S. Pat. Nos. 4,108,665 and 4,442,202, triazines described in U.S. Pat. Nos. 4,128,557, 4,137,079, 4,138,365, and 4,459,350, phosphorus compounds described in U.S. Pat. No. 4,411,985, and organohalogeno compounds as disclosed in JP-A-50-119624, JP-A-54-58022, JP-A-56-70543, JP-A-56-99335, JP-A-61-129642, JP-A-62-129845, JP-A-6-208191, JP-A-7-5621, and JP-A-8-15809, and U.S. Pat. Nos. 5,340,712, 5,369,000, and 5,464,737.

The heat-developable light-sensitive material of the present invention may contain a reducing agent, besides the color-developing agent. Besides conventional photographic developers such as phenidone, hydroquinone, catechol, and the like, a hindered phenol reducing agent can also be mentioned as a preferred example of the reducing agent. The amount of the reducing agent to be incorporated is preferably in the range of 5 to 50 mol %, more preferably in the range of 10 to 40 mol %, per mole of silver on the side of the support having thereon an image-forming layer. The layer to which the reducing agent is added may be any layer on the image-forming layer side of the support. In the case where the reducing agent is added to a layer that is not an image-forming layer, it is preferable that the amount of the reducing agent to be used is a little larger and is 10 to 50 mol % per mole of silver. The reducing agent may be a so-called precursor which is designed to function effectively only at the time of development processing.

In the heat-developable light-sensitive material utilizing an organosilver salt, a wide variety of reducing agents can be used. Examples of the reducing agent that can be used include those disclosed, for example, in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, and JP-A-6-3793, U.S. Pat. Nos. 3,667,9586, 3,679,426, 3,751,252, 3,751,255, 3,761,270, 3,782,949, 3,839,048, 3,928,686, and 5,464,738, DE 2,321,328, EP 629,732A.

Generally, the processing of photographic light-sensitive materials requires a base, but the light-sensitive material of the present invention does not necessarily require a base. However, for such purposes as acceleration of development, acceleration of the reaction between an oxidized product of the color-developing agent and the coupler, as described below, and acceleration of color development of the dye formed, a base may be used. In the light-sensitive material of the present invention, various methods of supplying a base may be employed. For example, in the case where a base-generating function is provided to the light-sensitive material, a base precursor can be introduced into the light-sensitive material. Examples of such a base precursor include a salt of a base and an organic acid designed to be decarboxylated by heat, and a compound designed to release an amine by an intramolecular nucleophilic substitution reaction, Lossen rearrangement, or Beckmann rearrangement. These examples are described in U.S. Pat. Nos. 4,514,493 and 4,657,848, and the like.

The light-sensitive material of the present invention may contain a nucleophilic agent (nucleophile) or a nucleophile precursor, in order to accelerate the reaction between an oxidized product of the color-developing agent and the coupler. Although various nucleophile precursors are known, it is advantageous to use a precursor that forms (or releases) a base by heating, because the use of such a precursor releases a nucleophile at the time of heat development. A thermal decomposition-type (decarboxylation-type) base precursor, which is composed of a salt of a carboxylic acid and a base, is representative, as the base precursor that forms a base by heating. When the decarboxylation-type base precursor is heated, the carboxyl group of the carboxylic acid undergoes a decarboxylation reaction, and a base is released. Sulfonylacetic acid or propiolic acid, which easily causes a decarboxylation reaction, is used as the carboxylic acid. It is preferable that the sulfonylacetic acid or propiolic acid has a group (i.e., an aryl group or unsaturated heterocyclic group), which has aromaticity capable of accelerating the decarboxylation, as a substituent. The base precursors of a salt of sulfonylacetic acid are described in JP-A-59-168441. The base precursors of a salt of propiolic acid are described in JP-A-59-180537. The base-constituting component of the decarboxylation-type base precursor is preferably an organic base, and more preferably amidine, guanidine, or a derivative thereof. The organic base is preferably a diacidic base, triacidic base, or tetraacidic base, more preferably a diacidic base, and most preferably a diacidic base of an amidine derivative or guanidine derivative.

The precursors of the diacidic base, triacidic base, or tetraacidic base of an amidine derivative are described in JP-B-7-59545. The precursors of the diacidic base, triacidic base, or tetraacidic base of a guanidine derivative are described in JP-B-8-10321. The diacidic base of an amidine derivative or guanidine derivative comprises: (A) two amidine or guanidine moieties; (B) a substituent of the amidine or guanidine moiety; and (C) a divalent linking group linking the two amidine or guanidine moieties. Examples of the substituent (B) include an alkyl group (including a cycloalkyl group), an alkenyl group, an alkynyl group, an aralkyl group, and a heterocyclic residue. Two or more of the substituents may join together to form a nitrogen-containing heterocycle. The linking group (C) is preferably an alkylene group or a phenylene group. Examples of the diacidic base precursor of an amidine or guanidine derivative that is preferably used in the present invention, are BP-1 to BP-41 described in JP-A-11-231457, pages 19–26. Among these precursors, salts of p-(phenylsulfonyl)-phenylsulfonylacetic acid, such as BP-9, BP-32, BP-35, BP-40, and BP-41, are particularly preferable. Examples of the diacidic base precursors of an amidine or guanidine derivative are given below.

(BP-9)

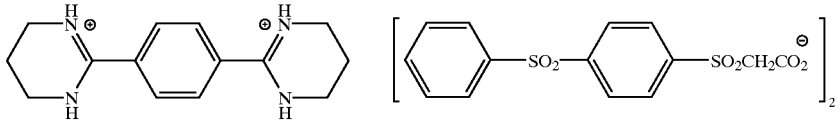

(BP-32)

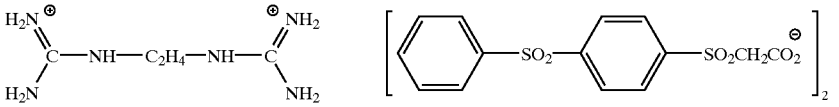

(BP-35)

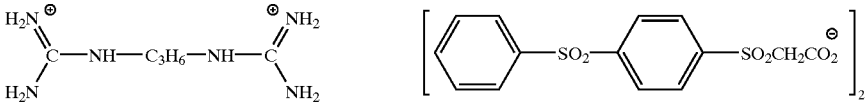

(BP-40)

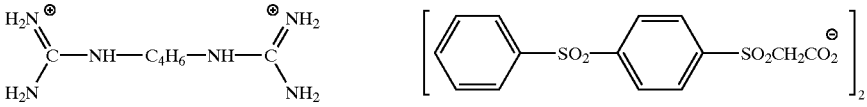

(BP-41)

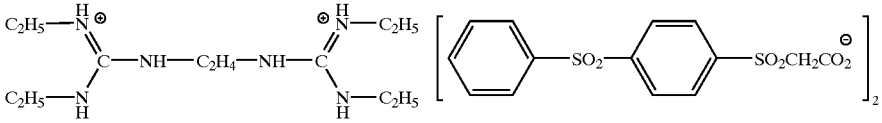

The amount (in moles) of the base precursor to be used is preferably 0.1 to 10 times, more preferably 0.3 to 3 times, the amount (in moles) of the color-developing agent to be used. It is preferable that the base precursor is dispersed in the state of solid fine-particles.

In the heat-developable light-sensitive material of the present invention, a binder is used in light-sensitive layers, and in non-light sensitive layers such as a colored layer, a protective layer, and an intermediate layer. The binder may be arbitrarily selected from well-known natural or synthetic resins, such as gelatin, polyvinyl acetal, polyvinyl chloride, polyvinyl acetate, cellulose acetate, polyolefin, polyester, polystyrene, polyacrylonitrile, polycarbonate, and an SBR latex purified by ultrafiltration (UF). Needless to say, examples of the binder also include a copolymer and a terpolymer. If necessary, combinations of two or more of these polymers can be employed. These polymers are used in an amount sufficient for holding therein the components. That is, these polymers are used in an amount falling in the range effective in functioning as a binder. Persons skilled in the art can determine the effective range properly.

The binder of the light-sensitive material is preferably a hydrophilic one. Examples of the binder include the binders described in the above-mentioned Research Disclosures and in JP-A-64-13546, pages 71–75. Among these binders, gelatin and combinations of gelatin with another water-soluble binder, such as polyvinyl alcohol, modified polyvinyl alcohol, cellulose derivative, or acrylamide polymer, are preferable. The total coating amounts of the binder is generally 1 to 25 g/m$^2$, preferably 3 to 20 g/m$^2$, and more preferably 5 to 15 g/m$^2$. Gelatin is used in proportions of generally 5 to 100% by mass, preferably 70 to 100% by mass, in the combination.

Generally, a light-sensitive material comprises 3 or more light-sensitive layers each having a different light-sensitivity, wherein each light-sensitive layer contains at least one silver halide emulsion layer. As a typical example, each set of the silver halide emulsion layer is composed of a plurality of silver halide emulsion layers which have substantially the same color sensitivity but have different levels of sensitivity. In this case, it is preferable to use silver halide grains such that a silver halide grain having a larger projected grain diameter has a larger value of so-called aspect ratio, i.e., a value obtained by dividing the projected grain diameter by the grain thickness. The light-sensitive layer is a unit light-sensitive layer having sensitivity to any one of blue light, green light, and red light. In the case of a multilayer silver halide color photographic light-sensitive material, a generally adopted order of the unit light-sensitive layers from the support side is a red-sensitive layer, a green-sensitive layer, and a blue-sensitive layer. However, depending on purposes, this order of layers may be reversed, or an order, in which light-sensitive layers sensitive to the same color sandwich a light-sensitive layer sensitive to a different color, is also possible. The total film thickness of the light-sensitive layer is generally 2 to 40 $\mu$m and preferably 5 to 25 $\mu$m.

Each of the silver halide emulsion layers constituting unit photosensitive layers respectively can preferably take a two-layer constitution composed of a high-sensitive emulsion layer and a low-sensitive emulsion layer, as described in DE 1 121 470 or GB Patent No.923 045. Generally, they are preferably arranged such that the sensitivities are decreased toward the support. As described, for example, in JP-A-57-112751, JP-A-62-200350, JP-A-62-206541, and JP-A-62-206543, a low-sensitive emulsion layer may be placed away from the support, and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL) high-sensitive red-sensitive layer (RH)/low-sensitive red-sensitive layer (RL), or an order of BH/BL/GL/GH/RH/RL, or an order of BH/BL/GH/GL/RL/RH, stated from the side most away from the support.

As described in JP-B-55-34932, an order of a blue-sensitive layer/GH/RH/GL/RL stated from the side most away from the support is also possible. Further as described in JP-A-56-25738 and JP-A-62-63936, an order of a blue-sensitive layer/GL/RL/GH/RH stated from the side most away from the support is also possible.

Further as described in JP-B-49-15495, an arrangement is possible wherein the upper layer is a silver halide emulsion layer highest in sensitivity, the intermediate layer is a silver halide emulsion layer lower in sensitivity than that of the upper layer, the lower layer is a silver halide emulsion layer further lower in sensitivity than that of the intermediate layer, so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity, as described in JP-A-59-202464.

Further, for example, an order of a high-sensitive emulsion layer/low-sensitive emulsion layer/medium-sensitive emulsion layer, or an order of a low-sensitive emulsion layer/medium-sensitive emulsion layer/high-sensitive emulsion layer can be taken. In the case of four layers or more layers, the arrangement can be varied as above.

In order to improve color reproduction, as described in U.S. Pat. Nos. 4,663,271, 4,705,744, and 4,704,436, and JP-A-62-160448 and JP-A-63-89850, it is preferable to form a donor layer (CL), which has a spectral sensitivity distribution different from those of a principal (main) light-sensitive layer, such as BL, GL and RL, and which has an inter-layer effect, in a position adjacent or in close proximity to the principal light-sensitive layer.

In the present invention, although a silver halide, a dye-providing coupler, and a color-developing agent (or its precursor) may be contained in the same layer, these substances may be contained in different layers if these substances are present in a reactive state. For example, if the layer containing a color-developing agent and the layer containing a silver halide are different, the raw stock storability of light-sensitive materials can be improved.

Although the relationship between the spectral sensitivity and the hue resulting from the coupler is arbitrary in each layer, direct projection exposure onto a conventional color paper and the like is possible if a cyan coupler is used in the red-sensitive layer, a magenta coupler is used in the green-sensitive layer, and a yellow coupler is used in the blue-sensitive layer.

Various non-light-sensitive layers, such as a protective layer, an undercoat (primer) layer, an intermediate layer, a yellow-filter layer, or an antihalation layer, may be provided between the silver halide emulsion layers, or as a top (overmost) layer or a bottom (undermost) layer. Further, various auxiliary (supplementary) layers, such as a backing layer, may be provided on the reverse side of the support. These layers may contain, for example, the above-described couplers, developing agents, DIR compounds, color-mixing inhibitor, and dyes. Specifically, the arrangement of layers as described in the above-patent, the primer layer as described in U.S. Pat. No. 5,051,335, the intermediate layer containing a solid pigment, as described in JP-A-1-167,838 and JP-A-61-20,943, the intermediate layer containing a reducing agent or DIR compound, as described in JP-A-1-120,553, JP-A-5-34,884 and JP-A-2-64,634, the intermediate layer containing an electron transfer agent, as described in U.S. Pat. Nos. 5,017,454 and 5,139,919 and JP-A-2-235,044, the protective layer containing a reducing agent, as described in JP-A-4-249,245, and combinations of these layers, may be provided.

In the present invention, a yellow filter layer, a magenta filer layer, and an antihalation layer can be used, as a colored layer. Accordingly, if the order of light-sensitive layers from the nearest side of the support is a red-sensitive layer, a green sensitive layer and a blue-sensitive layer, it is possible to provide a yellow-colored filter layer between the blue-sensitive layer and the green-sensitive layer, to provide a magenta-colored filter layer between the green-sensitive layer and the red-sensitive layer, and to provide a cyan-colored filter layer (antihalation layer) between the red-sensitive layer and the support. These colored layers may be in contact with an emulsion layer either directly or via an interlayer such as gelatin. Alternatively, these colored layers may be provided on the opposite side of the support relative to the emulsion layer. The amount of the dyes to be used is such that the transmission densities of the layers are generally 0.03 to 3.0, preferably 0.1 to 1.0, for blue light, green light and red light, respectively. More specifically, the amount is preferably 0.005 to 2.0 mmol/$m^2$ and more preferably 0.05 to 1.0 mmol/$m^2$, although the amount depends on $\epsilon$ and molecular weights of the dye to be used.

In the present invention, it is preferable to use colored layers which use dyes that can be decolorized by processing. That "the dye, which is present in a yellow filter layer or in the antihalation layer, is decolorized or eliminated at the time of development" means that the amount of the dye remaining after the development processing is generally one third or less, preferably one tenth or less, of the amount of the dye present immediately before the coating.

The light-sensitive material of the present invention may contain a mixture of two or more dyes in one colored layer. For example, the antihalation layer described above may contain a mixture of three dyes, i.e., a yellow dye, a magenta dye, and a cyan dye.

Specifically, dyes described in European Patent Application EP No. 549,489A, and dyes ExF 2 to 6 described in JP-A-7-152129, can be mentioned. A dye in the state in which fine-crystalline particles of the dye are dispersed, as described in JP-A-8-101487 can also be used.

The dye may also be mordanted with a mordant and a binder. In this case, as the mordant and the dye, those known in the field of photography can be used, and examples include mordants described, for example, in U.S. Pat. No. 4,500,626, columns 58 to 59, and JP-A-61-88256, pages 32 to 41, JP-A-62-244043, and JP-A-62-244036.

Leuco dyes or the like that lose their color can be used, and specifically, a silver halide light-sensitive material containing a leuco dye that has been color-formed previously with a developer of an organic acid metal salt, is disclosed in JP-A-1-150132. The leuco dye and a color developer complex are decolorized by heat or reacting with an alkai agent.

Known leuco dyes can be used, examples of which are described in Moriga and Yoshida, "Dyes and Chemicals", Vol.9, pp.84, Association of Chemical Products, "New Handbook of Dyes", pp.242, Maruzen Co., Ltd. (1970), R. Garner, "Reports on the Progress of Applied Chemistry", Vol.56, p.199 (1971), "Dyes and Chemicals", Vol.19, pp.230, Association of Chemical Products (1974), "Color Materials", Vol.62, pp.288 (1989), "Dye Industry", Vol.32, pp.208, and the like.

Color developers that are preferably used are acid clay-based color developers, phenol/formaldehyde resins, and metal salts of organic acids. Among the metal salts of organic acids, metal salts of salicylic acid, metal salts of a phenol/salicylic acid/formaldehyde resin, rhodanates, and metal salts of xanthogenic acid are useful. Zinc is particularly preferable as a metal. Among these color developers, as to oil-soluble zinc salicylates, those described in U.S. Pat. Nos.3,864,146 and 4,046,941, and JP-B-52-1327 can be used.

Besides, various additives indicated below can also be used additionally in the present invention.

It is also possible to use a dye which can be decolorized in the presence of a decolorizer at the time of processing. Examples of the dye that can be used include cyclic ketomethylene compounds described in JP-A-11-207027 and 2000-89414, cyanine dyes described in EP 911693A1, polymethine dyes described in U.S. Pat. No. 5,324,627, and merocyanine dyes described in JP-A-2000-112058.

It is preferable that these decolorizable dyes are dispersed in the state of a dispersion of fine crystalline particles described above, and the dispersion is added to the light-sensitive material. Alternatively, these decolorizable dyes may be used in the state of a dispersion prepared by dispersing in a hydrophilic binder the oil droplets which are prepared by dissolving the dye in an oil and/or an oil-soluble polymer. As a method for preparing the dispersion, preferable is an emulsification dispersion method which is described in, for example, U.S. Pat. No. 2,322,027. In this case, an oil having a high boiling point, which is described in U.S. Pat. Nos. 4,555,470, 4,536,466, 4,587,206, 4,555,476 and 4,599,296, JP-B-3-62,256, and the like can be used, if necessary, together with an organic solvent having a low boiling point in the range of 50 to 160° C. Two or more of the oils having a high boiling point can be used together. Besides, an oil-soluble polymer may be used in place of or together with the oil, as described in the specification of PCT International Laying-open No. WO88/00723. The amount to be used of the oil having a high boiling point and/or the polymer is generally 0.01 to 10 g, preferably 0.1 to 5 g, per gram of the dye to be used.

The method for dissolving the dye in the polymer may be carried out by a latex-dispersing method, and specific examples of the step as well as of the latex for impregnation are described in, for example, U.S. Pat. No. 4,199,363, German Patent Application (OLS) Nos. 2,541,274 and 2,541,230, JP-B-53-41091 and EP 029104A.

When the dyes are dispersed in a hydrophilic binder, a variety of surface-active agents may be used. Examples of the surface-active agents that can be used include those described in JP-A-59-157636, pages (37) to (38), and in "Known Technologies (Kochi-Gijutsu)", No. 5, pages 136 to 138 (issued on Mar. 22, 1991, ASTECH Inc.). Further, phosphate-series surface-active agents described in Japanese Patent Application Nos. 5-204,325 and 6-19247, and West Germany Patent Publication No. 932,299 A, can be used.

As a hydrophilic binder into which a dye is dipersed, a water soluble polymer is preferable, and examples thereof include proteins, such as gelatin and gelatin derivatives; cellulose derivatives; such natural compounds as polysaccharides, including starches, acacia, dextrans, and pullulan; and such synthetic polymer compounds as polyvinyl alcohols, polyvinyl pyrrolidones, and acrylamide polymers. These water soluble polymers may be used in combination with one or more type of them. Particularly, the combination of the water-soluble polymer and gelatin is preferable. Further, the gelatin can be selected from lime-processed gelatin, acid-processed gelatin; so-called de-ashed gelatin from which the calcium content, and the like, have been reduced, in accordance with various purposes, and combinations thereof are also preferable.

The above-mentioned dyes are decolorized in the presence of a decolorizer when processed.

Examples of the decolorizer include alcohols or phenols, amines or anilines, sulfinic acids or salts thereof, sulfurous acid or salts thereof, thiosulfuric acid or salts thereof, carboxylic acids or salts thereof, hydrazines, guanidines, aminoguanidines, amidines, thiols, cyclic or chain-like active methylene compounds, cyclic or chain-like active methine compounds, and anion species derived from these compounds.

Among these compounds, hydroxylamines, sulfinic acids, sulfurous acid, guanidines, aminoguanidines, heterocyclic thiols, cyclic or chain-like active methylene compounds, and cyclic or chain-like active methine compounds are preferably used. Guanidines and aminoguanidines are particularly preferable. The base precursors described above can also be preferably used.

The decolorizer is thought to contact with a dye and add nucleophilically to the dye molecule so that the dye is decolorized at the time of processing. As a preferable procedure, a dye-containing silver halide light-sensitive material after image-wise exposure or at the time of image-wise exposure thereof is put together with a processing material, which contains a decolorizer or a decolorizer precursor, face to face each other in the presence of water, and then these materials are heated. After that, when these materials are separated from each other, a colored image is obtained on the silver halide light-sensitive material and the dye is decolorized. In this case, the concentration of the dye after the decolorization is generally one third or less and preferably one fifth or less of the original concentration. The molar amount of the decolorizer to be used is in the range of generally 0.1 to 200 times and preferably 0.5 to 100 times that of the dye.

Also usable is a method using a decolorizable dye in a reversible manner that the dye has a color at a temperature below a decolorization starting temperature (T) but at least part of the dye is decolorized at the temperature T or above and the change can be reversed, wherein readout is made at the decolorization temperature (T° C.) or above so that the deterioration of S/N due to the concentration of the dye at the time of readout can be prevented. The dye having such a reversible property can be prepared by a combination of a leuco dye described in JP-B-51-44706, a phenolic color developer, and a higher alcohol.

For various purposes, the light-sensitive material may use a hardener, a surfactant, a photographic stabilizer, an antistatic agent, a slipping (sliding) agent, a matting agent, a latex, a formalin scavenger, a dye, a UV absorber, and the like. Specific examples thereof are described in Research Disclosures, Japanese Patent Application No.8-30103, and the like. Examples of particularly preferred antistatic agent are fine particles of metal oxides such as ZnO, $TiO_2$, $SnO_2$, $Al_2O_3$, $In_2O_3$, $SiO_2$, MgO, BaO, $MoO_3$ and $V_2O_5$.

As the base (support) of the light-sensitive material in the present invention, those that are transparent and can withstand the processing temperature, are used. Generally, photographic bases, such as papers or synthetic polymers (films) described in "Shashin Kogaku no Kiso —Ginen Shashinhen—," edited by Nihon Shashin-gakkai and published by Korona-sha, 1979, pages (223) to (240), can be mentioned. Specifically, mention can be made of polyethylene terephthalates, polyethylene naphthalates, polycarbonates, polyvinyl chlorides, polystyrenes, polypropylenes, polyimides, celluloses (e.g., triacetylcellulose), and the like.

Among the supports, a polyester composed mainly of polyethylene naphthalate is particularly preferable. The term "polyester composed mainly of polyethylene naphthalate" as used herein means a polyester whose naphthalenedicarboxylic acid-component content in total dicarboxylic acid residues is preferably 50 mol % or more, more preferably 60 mol % or more, and even more preferably 70 mol % or more. This may be a copolymer or a polymer blend.

In the case of a copolymer, a copolymer, which has a unit of terephthalic acid, bisphenol A, cyclohexanedimethanol or the like, copolymerized therein, besides naphthalenedicarboxylic acid units and ethylene glycol units, is also preferable. Among these copolymers, a copolymer, in which terephthalic acid units are copolymerized, is most preferable from the standpoint of mechanical strength and costs.

Preferred examples of the counterpart for forming the polymer blend are polyesters, such as polyethylene terephthalate (PET), polyarylate (PAr), polycarbonate (PC), and polycyclohexanedimethanolterephthalate (PCT), from the standpoint of compatibility. Among these polymer blends, a polymer blend with PET is preferable, from the standpoint of mechanical strength and costs.

Particularly when heat resistance and anti-curling properties are severely demanded, bases that are described, as bases for light-sensitive materials, for example, in JP-A-6-41281, JP-A-6-43581, JP-A-6-51426, JP-A-6-51437, JP-A-6-51442, and Japanese Patent Applications No. 4-251845, No. 4-231825, No. 4-253545, No. 4-258828, No. 4-240122, No. 4-221538, No. 5-21625, No. 5-15926, No. 4-331928, No. 5-199704, No. 6-13455 and No. 6-14666, can be preferably used.

Further, a base of a styrene-series polymer having mainly a syndiotactic structure can be preferably used. The thickness of the base is preferably 5 to 200 $\mu$m, more preferably 40 to 120 $\mu$m.

These supports are preferably subjected to a surface treatment, in order to achieve strong adhesion between the support and a photographic constituting layer. For the above-mentioned surface treatment, various surface-activation treatments can be used, such as a chemical treatment, a mechanical treatment, a corona discharge treatment, a flame treatment, an ultraviolet ray treatment, a high-frequency treatment, a glow discharge treatment, an active plasma treatment, a laser treatment, a mixed acid treatment, and an ozone oxidation treatment. Among the surface treatments, an ultraviolet irradiation treatment, a flame treatment, a corona treatment, and a grow treatment are preferable.

With respect to the undercoating, a single layer or two or more layers may be used. As the binder for the undercoat layer, for example, copolymers produced by using, as a starting material, a monomer selected from among vinyl chloride, vinylidene chloride, butadiene, methacrylic acid, acrylic acid, itaconic acid, maleic anhydride, and the like, as well as polyethylene imines, epoxy resins, grafted gelatins, nitrocelluloses, gelatins, polyvinyl alcohol, and modified polymers thereof, can be mentioned. As compounds that can swell the base, resorcin and p-chlorophenol can be mentioned. As gelatin hardening agents in the undercoat layer, chrome salts (e.g. chrome alum), aldehydes (e.g. formaldehyde and glutaraldehyde), isocyanates, active halogen compounds (e.g. 2,4-dichloro-6-hydroxy-s-triazine), epichlorohydrin resins, active vinyl sulfone compounds, and the like can be mentioned. $SiO_2$, $TiO_2$, inorganic fine particles, or polymethyl methacrylate copolymer fine particles (0.01 to 10 $\mu$m) may be included as a matting agent.

As for the color tone (hue) of the dye to be used for dyeing films, dyeing in gray is preferable in view of general characteristics of light-sensitive materials. A dye, which has excellent resistance to heat within the film-forming temperature range, and excellent compatibility with polyester, is preferable. In this regard, the purpose can be achieved by blending dyes, such as Diaresin (trade name) manufactured by Mitsubishi Chemicals Industries Ltd. or Kayaset (trade name) manufactured by Nippon Kayaku Co., Ltd., which are commercially available as dyes for polyesters. From the standpoint of heat resistance in particular, an anthraquinone-series dye can be mentioned. For example, the dye described in JP-A-8-122970 is preferable for use.

Further, as the base, bases having a magnetic recording layer, as described, for example, in JP-A-4-124645, JP-A-5-40321, JP-A-6-35092, and JP-A-6-317875, is preferably used, to record photographing information or the like.

The magnetic recording layer refers to a layer provided by coating a base with an aqueous or organic solvent coating solution containing magnetic particles dispersed in a binder.

To prepare the magnetic particles, use can be made of a ferromagnetic iron oxide, such as $\gamma Fe_2O_3$, Co-coated $\gamma Fe_2O_3$, Co-coated magnetite, Co-containing magnetite, ferromagnetic chromium dioxide, a ferromagnetic metal, a ferromagnetic alloy, hexagonal Ba ferrite, Sr ferrite, Pb ferrite, and Ca ferrite. A Co-coated ferromagnetic iron oxide, such as Co-coated $\gamma Fe_2O_3$, is preferable. The shape may be any of a needle shape, a rice grain shape, a spherical shape, a cubic shape, a tabular shape, and the like. The specific surface area is preferably 20 $m^2/g$ or more, and particularly preferably 30 $m^2/g$ or more, in terms of $S_{BET}$. The saturation magnetization ($\sigma s$) of the ferromagnetic material is preferably $3.0\times10^4$ to $3.0\times10^5$ A/m, and particularly preferably $4.0\times10^4$ to $2.5\times10^5$ A/m. The ferromagnetic particles may be surface-treated with silica and/or alumina or an organic material. The surface of the magnetic particles may be treated with a silane coupling agent or a titanium coupling agent, as described in JP-A-6-161032. Further, magnetic particles whose surface is coated with an inorganic or organic material, as described in JP-A-4-259911 and JP-A-5-81652, can be used.

The polyester base is heat-treated at a heat treatment temperature of generally 40° C. or over, but less than the Tg, and preferably at a heat treatment temperature of the Tg −20° C. or more, but less than the Tg, so that it will hardly have core set curl. The heat treatment may be carried out at a constant temperature in the above temperature range, or it may be carried out with cooling. The heat treatment time is generally 0.1 hours or more, but 1,500 hours or less, and preferably 0.5 hours or more, but 200 hours or less. The heat treatment of the base may be carried out with the base rolled, or it may be carried out with it being conveyed in the form of web. The surface of the base may be made rough (unevenness, for example, by applying electroconductive inorganic fine-particles, such as $SnO_2$ and $Sb_2O_5$), so that the surface state may be improved. Further, it is desirable to provide, for example, a rollette (knurling) at the both ends for the width of the base (both right and left ends towards the direction of rolling) to increase the thickness only at the ends, so that a trouble of deformation of the base will be prevented. The trouble of deformation of the support means that, when a support is wound on a core, on its second and further windings, the support follows unevenness of its cut edge of the first winding, deforming its flat film-shape. These heat treatments may be carried out at any stage after the production of the base film, after the surface treatment, after the coating of a backing layer (e.g. with an antistatic agent and a slipping agent), and after coating of an undercoat, with preference given to after coating of an antistatic agent.

Into the polyester may be blended (kneaded) an ultraviolet absorber. Further, prevention of light piping can be attained by blending dyes or pigments commercially available for polyesters, such as Diaresin (trade name, manufactured by Mitsubisi Chemical Industries Ltd.), and Kayaset (trade name, manufactured by Nippon Kayaku Co., Ltd.).

Film magazines (patrones), into which the light-sensitive material can be housed, are described.

The major material of the magazine to be used in the present invention may be metal or synthetic plastic.

Further, the magazine may be one in which a spool is rotated to deliver a film. Also the structure may be such that the forward end of film is housed in the magazine body, and by rotating a spool shaft in the delivering direction, the forward end of the film is delivered out from a port of the magazine. These magazines are disclosed in U.S. Pat. No. 4,834,306, and U.S. Pat. No. 5,226,613.

The light-sensitive material as shown above can also be preferably used for a film unit with a lens, as described in, for example, JP-B-2-32615 and JU-B-3-39784 (the term "JU-B" used herein means an "examined Japanese utility model publication).

The film unit with a lens is one obtained by pre-loading, in a light-proofing manner, an unexposed color or monochrome photographic light-sensitive material, in a production process of a unit main body having, for example, an injection-molded plastic body, equipped with a photographing lens and shutter. The unit after photographing by a user, is transported, as such the unit, to a developing laboratory for development. In the laboratory, the photographed film is taken out of this unit, and development processing and photographic printing are carried out.

Any method may be employed for development-processing the heat-developable light-sensitive material of the present invention, and generally the development-processing is performed by heating the light-sensitive material after image-wise exposure. Preferred modes of the apparatus for heat development to be used include to make the light-sensitive material contact with such an object as a heated block or plate, a hot plate, a hot presser, a heating roller, a heating drum, a halogen lamp heater, and an infrared or a far infrared lamp heater, and to passage the light-sensitive material through an atmosphere of a high temperature.

As a heat source, a heater such as a heated liquid, a dielectric substance, a microwave, or the like can be used, besides a conventional electric heater or lamp heater.

A preferred mode of the thermally-developing apparatus to be used is an apparatus of a type based on the contact of the heat-developable light-sensitive material with a heat source such as a heating roller or heating drum. As this type of thermally-developing apparatus, the developing apparatus for heat development described in JP-B-5-56499, Japanese Patent No. 684453, JP-A-9-292695, JP-A-9-297385, and WO95/30934 are used. As a non-contact-type, the apparatus described in JP-A-7-13294 and WO97/28489, WO97/28488, and WO97/28487 are used.

A preferable temperature for development is in the range of 100 to 350° C. and a more preferable temperature for development is in the range of 130 to 200° C. A preferable time for development is in the range of 1 to 60 seconds and a more preferable time for development is in the range of 3 to 30 seconds.

The light-sensitive material and/or the processing element for use in the present invention may be in the form that has an electroconductive heat-generating material layer as a heating means for heat development. In this case, as the heat-generating element, one described, for example, in JP-A-61-145544 can be employed.

The heating mode is as follows. The light-sensitive material in a state of a film after photographing is normally separated from a magazine or cartridge and the heat development processing is carried out using the film in a naked state. For example, a method disclosed in JP-A-2000-171961, in which heat development is carried out while the film is being pulled out of a thrust cartridge and, at the time point when the development of the final part is over, the film after processing is again enclosed in the thrust cartridge, is also preferable. Alternatively, a light-sensitive material, which is enclosed in a magazine or cartridge by being rolled, may undergo heat development by heating the entire container from outside.

In the present invention, after the colored image is formed by heat development, the remaining silver halide and/or developed silver may or may not be removed. The method for outputting on another material based on image information may be a method based on ordinary projection exposure, or a method in which the image information is photoelectrically read out by measuring the density of transmitted light and output is made in accordance with the signals obtained. The material on which the output is made does not need to be a light-sensitive material. For example, the material may be a sublimation-type heat-sensitive recording material, a material for ink-jet, an electrophotographic material, or a full-color direct heat-sensitive recording material.

In the present invention, an example of preferred modes is as follows. Image information is photoelectrically read by means of diffused light and transmission density measurement using a CCD image sensor after the formation of a colored image by heat development, without performing an additional treatment for removal of the remaining silver halide and developed silver. The image information is then converted into digital signals which, after image treatment, are outputted by means of a heat development color printer, for example, Pictrography 3000 (trade name) manufactured by Fuji Photo Film Co., Ltd. In this case, it is also possible to obtain an excellent print in a rapid way, without using any processing solution that is used in conventional color photography. Further, in this case, since the digital signals can be processed and edited arbitrarily, the correction, modification, and processing of the photographed image can be freely made before output of the image.

In the present invention, a separate bleach-fixing step, for further removal of silver halide and developed silver remaining in the light-sensitive material after development, is not essential. However, for the purposes of lessening the load required for reading the image information and enhancing the image storability, a fixing step and/or bleaching step may be provided. In that case, although a conventional processing using a liquid is possible, a processing step described in JP-A-9-258402, in which the light-sensitive material is put together with another sheet coated with a processing agent and heated together, is preferable. In this case, the heating temperature is preferably a temperature (e.g. 50° C.) the same level as in the development processing. It is particularly preferable to set the heating temperature to the same temperature as that of the development processing.

In the present invention, after an image is obtained on the light-sensitive material, a color image is obtained on another recording material based on the image information. As an example of this method, image information is photoelectrically read by means of density measurement of transmitted light, and the image information is then converted into digital signals which, after image treatment, are outputted onto the another recording material. The material on which the output is made may be a sublimation-type heat-sensitive recording material, a full-color direct heat-sensitive recording material, a material for ink-jet, or an electrophotographic material, besides a light-sensitive material using a silver halide.

In the present invention, it is necessary to read out the image formed on the light-sensitive material after heat development, and to convert the information into digital signals. As the apparatus for reading out the image, an image input device that is generally known can be used. Details of the image input device are described, for example, by Takao Andoh, et al., in "Principles of Digital Image Input", pages 58–98, Corona Publishing Co., Ltd. (1998).

The image input device is required to take in a vast amount of image information in an efficient way. The image input device is roughly divided into a linear sensor and an area sensor, in terms of the arrangement of fine point sensors. The former comprises a large number of point sensors arranged on a line. When it is used for taking in a planar image, either the light-sensitive material side or the sensor side needs to be scanned. Therefore, although the readout requires a little longer time, the manufacturing cost of the former sensor is inexpensive, which is one of merits. As for the area sensor, since readout can be made basically without scanning of the light-sensitive material or the sensor, a large-sized sensor needs to be used although the readout speed is high. Therefore, the cost becomes higher. These sensors can be used selectively according to the purposes and both of them can be used preferably in the present invention.

The kinds of the sensors include an electronic tube-type, such as a photographic tube or an image tube, and a solid-state photographing system, such as CCD-type or MOS-type. In view of costs and ease in handling, a solid-state photographing system, in particular a CCD-type, is preferable.

As for the apparatus installed with such image input device, although commercially obtainable digital still cameras, drum scanners, flat bed scanners, film scanners, and the like can be used, the use of a film scanner is preferable in order to read out a high-quality image in an easy and simple manner.

Typical commercialized film scanners include those using a linear CCD, such as Nikon•Film Scanner LS-1000 (trade name), Agfa•Duoscan HiD (trade name), Imacon•Flextightphoto (trade name), and the like. In addition, Kodak RFS3570 (trade name), and the like, which use an area CCD, can be preferably used.

Further, the image input device by using an area CCD, which is installed in Digital Print System•Frontier (trade name) manufactured by Fuji Photo Film Co., Ltd., can also be preferably used. Furthermore, the image input device of Digital Print System•Frontier F350 (trade name), which realizes high-quality image readout in a high speed, even by using a liner CCD sensor, as described by Yoshio Ozawa, et al. in Fuji Film Research Report No.45, pages 35–41, is particularly suitable to the readout of the light-sensitive material of the present invention.

Examples of image-processing methods that can be preferably employed in the image-forming method of the present invention include the following methods.

JP-A-6-139323 describes an image-processing system and an image-processing method, capable of faithfully reproducing the color of a subject from a negative film, comprising the steps of: forming the image of a subject on a color negative, converting the image into corresponding image data by means of a scanner or the like, and outputting the same color as that of the subject based on the restored color information. This method may be employed in the present invention.

Further, as to the image-processing method for controlling the granularity or noise of the digitized image and emphasizing the sharpness, a method described in JP-A-10-243238, in which weighting, granulation, and the like of edge and noise are carried out based on sharpness-emphasizing image data, smoothening image date, and edge detection data, and a method described in JP-A-10-243239, in which weighting, granulation, and the like are carried out by obtaining edge components based on sharpness-emphasizing image data and smoothening image data, may be used.

Further, in order to compensate the fluctuation on color reproductivity of the final print, which fluctuation is caused by the difference of storing conditions, developing conditions, and the like, of photographic materials for shooting, in a digital color print system, a method described in JP-A-10-255037, which comprises the steps of: subjecting the unexposed portions of the photographic material to a patch-wise exposure of 4 or more steps or colors, measuring the patch densities after development, getting a lookup table and color transformation matrix necessary for compensating, and carrying out color correction of a photographic image by using lookup table transformation or matrix calculation, can be used.

As to a method for transforming the color reproduction regions of image data, for example, a method described in JP-A-10-229502, in which, when values for components are obtained, based on the image data that are expressed in color signals constituting colors visually recognizable as neutral colors, the color signals are decomposed into a chromatic component and an achromatic component so that these components are separately processed, can be used.

Further, as to an image-processing method for eliminating image defects, such as aberration due to camera lens and drop in peripheral light amount, in an image photographed using a camera, an image-processing method and an apparatus therefor described in JP-A-11-69277, which comprises the steps of: recording in a film, in advance, a lattice-like compensating pattern for making data to correct image deterioration, reading out the image and compensating pattern by means of a film scanner or the like after photographing, making data for correcting the deterioration factors due to lens of camera, and correcting the digital image data by using the data intended to correct the image deterioration, may be used.

Furthermore, if sharpness is emphasized excessively, the skin color and blue sky give an unpleasant impression because granularity (noise) is emphasized excessively. Therefore, it is desired to control the degree of sharpness emphasis on the skin color and blue sky. As an example of this method, as described, for example, in JP-A-11-103393, a sharpness emphasizing processing using unsharp masking (USM), in which the USM coefficient is made into a function of (B-A) (R-A), may be used.

Skin color, grass green color, and blue sky color are called important colors in terms of color reproduction, and selective color reproduction processing are required. As to reproduction of lightness, the reproduction, in which the skin color is made bright and the blue sky is made dark, is said to be visually pleasant. As to a method for reproducing the important colors with visually pleasant brightness, for example, a method described in JP-A-11-177853, in which the color signal of each pixel is transformed by using a coefficient that takes a small value if the corresponding hue is yellowish red such as (R-G) or (R-B), and that takes a large value if the corresponding hue is cyan blue, may be adopted.

As to a method for compacting color signals, a method described, for example in JP-A-11-113023, which comprises the steps of: separating the color signal of each pixel into a lightness component and a chromaticity component, and encoding the color hue information by selecting, to the chromaticity component, a template whose numeral pattern is the most suitable from plural hue templates prepared in advance, may be used.

In addition, at the time of processing for raising chroma or sharpness, in order to carry out natural emphasis with inhibiting imperfections, such as color blindness, washing out highlight tone, and leaving high-density portions flat, and data generation outside the defined region, an image-processing method and an apparatus therefor, as described in JP-A-11-177832, which comprises the steps of: making each color density data of a color image data into exposure density data by using a characteristic curve, and making the resulting data into density data by the characteristic curve after carrying out image processing including color emphasis, can be used.

The heat-developable light-sensitive material of the present invention is little in undesirable load on environments at the time of manufacturing it, it provides high density of developed color, and it enables processing in a short period of time. Further, the heat-developable light-sensitive material of the present invention is excellent in storage stability.

According to the present invention, a color image can be obtained, which is high in the maximum density of developed color, and which is high in sensitivity and low in fogging, even after the raw light-sensitive material is stored for a long period of time.

The present invention is described in more detail with reference to the following examples, but the present invention is not limited thereto.

EXAMPLE

Example 1

<Preparation of a Silver Halide Emulsion having High Sensitivity>

0.37 g of oxidation-treated gelatin, having an average molecular weight of 15,000, and 930 ml of distilled water containing 0.7 g of potassium bromide were placed in a reaction vessel, and the temperature was elevated to 38° C. 30 ml of an aqueous solution containing 0.34 g of silver nitrate and 30 ml of an aqueous solution containing 0.24 g of potassium bromide were added to the resulting solution, over 20 sec, with vigorous stirring. After the completion of the addition, the temperature was kept at 40° C. for 1 min, and then, the temperature of the reaction liquid was raised to 75° C. After 27.0 g of gelatin whose amino group was modified with trimellitic acid, was added together with 200 ml of distilled water, then 100 ml of an aqueous solution containing 23.36 g of silver nitrate and 80 ml of an aqueous solution containing 16.37 g of potassium bromide were added, over 36 min, with the flow rate of the addition being accelerated. Then, 250 ml of an aqueous solution containing 83.2 g of silver nitrate, and an aqueous solution containing potassium iodide and potassium bromide in a molar ratio of 3:97 (the concentration of potassium bromide: 26%), were added, over 60 min, with the flow rate of the addition being accelerated, so that the silver electric potential of the reaction liquid would become −50 mv to a saturated calomel electrode. Further, 75 ml of an aqueous solution containing 18.7 g of silver nitrate, and a 21.9% aqueous solution of potassium bromide, were added, over 10 min, so that the silver electric potential of the reaction liquid would become 0 mV to the saturated calomel electrode. After the completion of the addition, the temperature was kept at 75° C. for 1 min; then the temperature of the reaction liquid was dropped to 40° C. Then, 100 ml of an aqueous solution containing 10.5 g of sodium p-iodoacetamidobenzenesulfonate (monohydrate) was added thereto, and the pH of the reaction liquid was adjusted to 9.0. Further, 50 ml of an aqueous solution containing 4.3 g of sodium sulfite was added thereto. After the completion of the addition, the temperature was kept 40° C. for 3 min, and the temperature of the reaction liquid was raised to 55° C. After adjusting the pH of the reaction liquid to 5.8, 0.8 mg of sodium benzenethiosulfinate, 0.04 mg of potassium hexachloro iridate (IV) and 5.5 g of potassium bromide were added, kept at 55° C. for 1 min, and further, 180 ml of an aqueous solution containing 44.3 g of silver nitrate, and 160 ml of an aqueous solution containing 34.0 g of potassium bromide and 8.9 mg of potassium hexacyano ferrate (II) were added over 30 min. The temperature was then dropped, and then desalting was carried out by a usual manner. After the completion of the desalting, lime-processed gelatin was added such that the total gelatin content would be 7 wt %, and pH was adjusted to 6.2.

The resulting emulsion was an emulsion containing hexagonal tabular grains, wherein the average grain size represented by a sphere-equivalent diameter (the diameter of a sphere having a volume equivalent to that of an individual grain) was 1.15 μm, the average grain thickness was 0.12 μm, and the average aspect ratio was 24.0. This emulsion was designated as Emulsion A-1.

By changing the amounts of silver nitrate and potassium bromide that were added at the first of the formation of grains, the number of nuclei to be formed was changed from those adopted in the case of Emulsion A-1, to prepare Emulsion A-2, comprising hexagonal tabular grains having an average grain size of 0.75 μm in terms of a sphere-equivalent diameter, an average grain thickness of 0.11 μm, and an average aspect ratio of 14.0; and Emulsion A-3, comprising hexagonal tabular grains having an average grain size of 0.52 μm in terms of a sphere-equivalent diameter, an average grain thickness of 0.09 μm, and an average aspect ratio of 11.3. In these cases, the amounts to be added of potassium hexachloroiridate (IV) and potassium hexacyanoferrate (II) were changed in inverse proportion to the volume of grains, and the amount of sodium p-iodoacetoamidobenzenesulfonate monohydrate to be added was changed in proportion to the circumferential length of an individual grain.

5.6 ml of an aqueous 1% potassium iodide solution was added to the Emulsion A-1 at a temperature of 40° C., to which were then added $8.2\times10^{-4}$ mols of the spectrally-sensitizing dye shown below, Compound I, potassium thiocyanate, chloroauric acid, sodium thiosulfate, and mono (pentafluorophenyl)diphenylphosphineselenide, to carry out spectral sensitization and chemical sensitization. After the chemical sensitization was completed, the amount shown below of the stabilizer S was added. At this time, the amount of the chemical sensitizer was adjusted so as to make the level of chemical sensitization for the emulsion optimal.

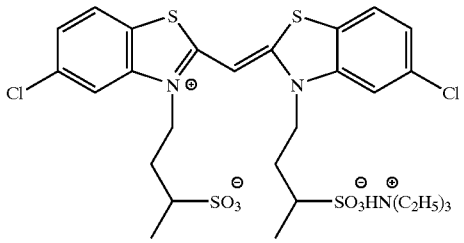

Sensitizing dye for blue-sensitive emulsion I

-continued

Compound 1

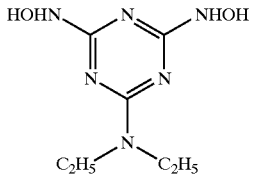

Stabilizer S (A mixture of the followings)

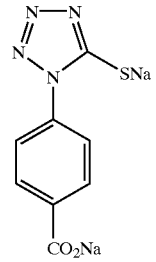

$2\times10^{-4}$ mol/molAg to Emulsion A-1

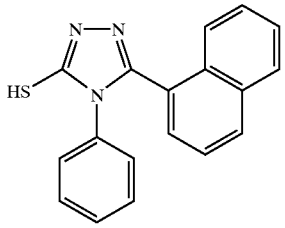

$8\times10^{-5}$ mol/molAg to Emulsion A-1

The resulting blue-sensitive emulsion was designated to as Emulsion A-1b. Similarly, by subjecting spectral sensitization and chemical sensitization to each emulsion, Emulsions A-2b and A-3b were prepared, respectively. The amount of the spectrally-sensitizing dye to be added was changed in accordance with the surface area of an individual grain of the silver halide in each emulsion. Further, the amount of each chemical used for the chemical sensitization was controlled so that the degree of the chemical sensitization to each emulsion was optimal in each emulsion.

Similarly, by changing the spectrally-sensitizing dye to the following dyes, respectively, Green-sensitive emulsions A-1g, A-2g, and A-3g, and Red-sensitive emulsions A-1r, A-2r and A-3r, were prepared.

Sensitizing dye for green-sensitive emulsion I $5.5\times10^{-4}$ mol/molAg to Emulsion A-1

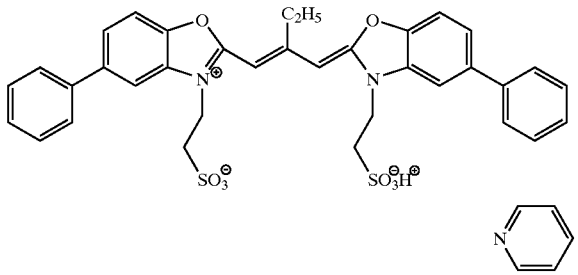

Sensitizing dye for green-sensitive emulsion II $1.3\times10^{-4}$ mol/molAg to Emulsion A-1

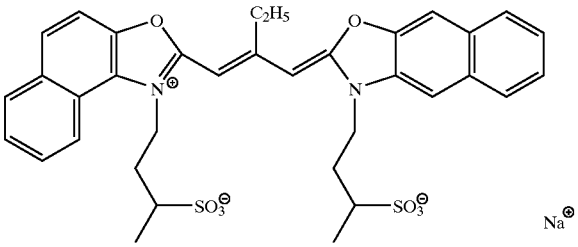

Sensitizing dye for green-sensitive emulsion III $4.8\times10^{-5}$ mol/molAg to Emulsion A-1

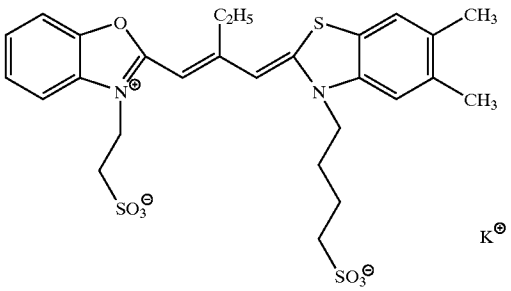

Sensitizing dye for red-sensitive emulsion I $2.5\times10^{-4}$ mol/molAg to Emulsion A-1

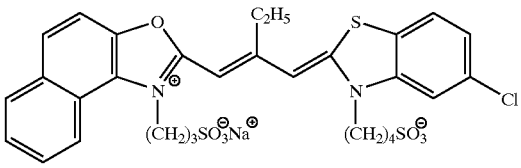

Sensitizing dye for red-sensitive emulsion II $6.3\times10^{-5}$ mol/molAg to Emulsion A-1

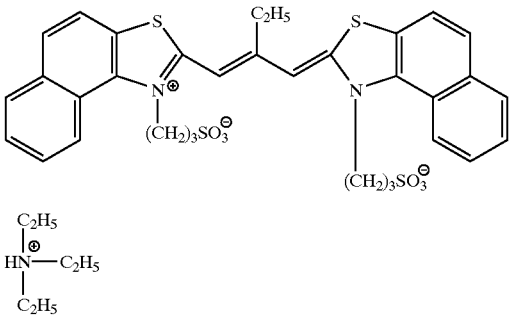

Sensitizing dye for red-sensitive emulsion III $3.1\times10^{-4}$ mol/molAg to Emulsion A-1

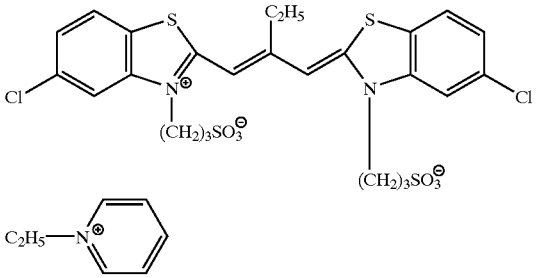

<Method for Preparing Silver 5-butylbenzotriazole>

1.0 g of 5-butylbenzotriazole, 0.24 g of sodium hydroxide, and 25 g of phthalated gelatin were dissolved in 700 mL of water. The solution was kept at 60° C. and stirred. Then, to the resulting solution were added a solution prepared by dissolving 5 g of 5-butylbenzotriazole and 1.2 g of sodium hydroxide in 150 mL of water and a solution prepared by dissolving 5 g of silver nitrate in 150 mL of water, simultaneously, over a period of 4 minutes. The resulting solution was stirred for 5 minutes. After that, to the solution were added a solution prepared by dissolving 5 g of 5-butylbenzotriazole and 1.2 g of sodium hydroxide in 150 mL of water and a solution prepared by dissolving 5 g of silver nitrate in 150 mL of water, simultaneously, over a period of 6 minutes. The pH of the resulting emulsion was adjusted so as to cause precipitation and excess salt was removed. After that, the pH was adjusted to 6.0, and a silver 5-butylbenzotriazole emulsion in an yield of 470 g was obtained.

(Preparation of Dispersion (a) of Solid Fine-particles of a Base Precursor)

64 g of a base precursor compound BP-35, and 10 g of a surfactant Demol N (trade name) manufactured by Kao Corp. were mixed with 220 ml of distilled water, and the mixed solution was subjected to beads dispersion using a sand mill (¼ Gallon sand grinder mill, manufactured by Imex Co.), to obtain Dispersion (a) of solid fine-particles of the base precursor compound, having an average particle diameter of 0.2 $\mu$m.

Base Precursor Compound BP-35

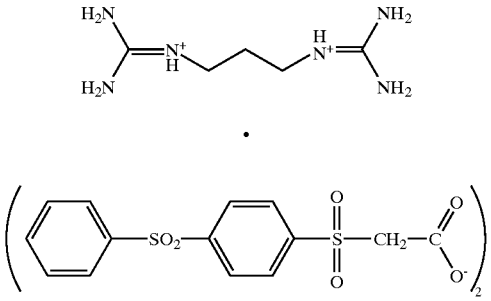

Cyanine Dye Compound

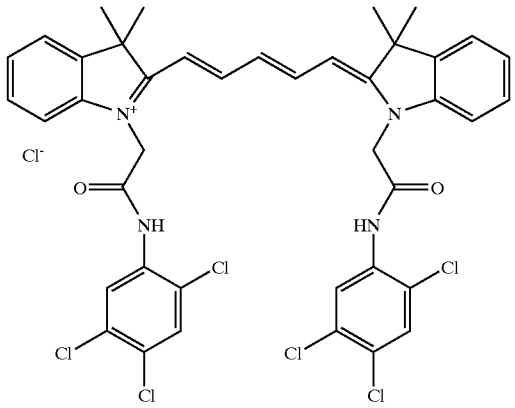

(Preparation of Dispersion of Solid Fine-particles of a Dye)

9.6 g of a cyanine dye compound 13 and 5.8 g of sodium p-dodecylbenzenesulfonate were mixed with 305 ml of distilled water, and the mixed solution was subjected to beads dispersion using a sand mill (¼ Gallon sand grinder mill, manufactured by Imex Co.), to obtain a dispersion of solid fine-particles of the dye having an average particle diameter of 0.2 μm.

(Preparation of an Anti-halation Layer Coating Solution)

17 g of a gelatin, 9.6 g of polyacrylamide, 70 g of the above Dispersion (a) of solid fine-particles of the base precursor, 56 g of the above dispersion of solid fine-particles of the dye, 1.5 g of fine-particulate polymethyl methacrylate (average particle size: 6.5 μm), 0.03 g of benzoisothiazolinone, 2.2 g of sodium polyethylenesulfonate, 0.2 g of a blue-coloring dye compound 14, 3.9 g of a yellow-coloring dye compound 15, and 844 ml of water, were mixed, to prepare an anti-halation layer coating solution.

<Making of Support>

For making light-sensitive materials, making of a support, and coating of an undercoat layer, an antistatic layer (1st backing layer), a magnetic recording layer (2nd backing layer), and the 3rd backing layer, were carried out as follows.

(1) Making of Support

The support to be used in this example was prepared by the following method. 100 parts by weight of polyethylene-2,6-naphthalatedicarboxyrate (PEN), and 2 parts by weight of Tinuvin P.326 (trade name, manufactured by Ciba-Geigy Co.) as a ultraviolet absorber, were mixed uniformly, and then the resultant mixture was melted at 300° C. The melted mixture was extruded from a T-die and stretched 3.3 times in a lengthwise direction at 140° C., and 4.0 times in a width direction. The resulting product was thermally fixed at 250° C. for 6 seconds, to obtain a PEN film with a thickness of 90 μm. To this PEN film were added a blue dye, a magenta dye, and a yellow dye (I-1, I-4, I-6, I-24, I-26, I-27 and II-5, as described in Kokai Giho: Kogi No. 94-6023) in appropriate amounts. Moreover, the PEN film was wound around a stainless core (spool) having a diameter of 30 cm, and thermal history was imparted thereto at 110° C. for 48 hours, to obtain a support having suppressed core set curl.

(2) Coating of an Undercoat Layer

Both surfaces of the PEN support were subjected to glow treatment according to the following procedure. Four rod-like electrodes, each having a diameter of 2 cm and a length of 40 cm, were fixed onto an insulator plate, at an interval of 10 cm, in a vacuum tank. In this case, an arrangement was made such that the film traveled at a distance of 15 cm from the electrodes. Further, a heating roller, which had a diameter of 50 cm and was equipped with a temperature controller, was positioned immediately before the electrodes such that the film would contact ¾ periphery of the heating roll. A biaxially stretched film, which had a thickness of 90 μm and a width of 30 cm, was caused to travel, and the heating roller was heated so that the temperature of the film face between the heating roller and the electrode zone would be 115° C. Then, the film was transferred at a speed of 15 cm/second, and glow treatment was carried out.

The pressure inside the vacuum tank was 26.5 Pa and the $H_2O$ partial pressure of the atmospheric gas was 75%. The discharge frequency was 30 kHz, the output power was 2500 W, the processing intensity was 0.5 kV.A.min/m$^2$. The electrode for vacuum glow discharge was in accordance with the method described in JP-A-7-003056.

One surface (i.e., emulsion side) of the PEN support after the glow treatment was coated with the undercoat layer having the following composition. The dry film thickness was designed to become 0.02 μm. The drying temperature was 115° C. and the drying time was 3 minutes.

| | |
|---|---|
| Gelatin | 83 parts by weight |
| Water | 291 parts by weight |
| Salicylic acid | 18 parts by weight |
| Aerosil R972 | 1 part by weight |

(trade name, manufactured by Nippon Aerosil Co., Ltd., colloidal silica)

| | |
|---|---|
| Methanol | 6900 parts by weight |
| n-Propanol | 830 parts by weight |
| Polyamide/epichlorohydrin resin described in JP-A-51-3619 | 25 parts by weight |

(3) Coating of an Antistatic Layer (1st Backing Layer)

A mixture of 40 parts by weight of SN-100 (trade name, manufactured by Ishihara Sangyo Kaisha, Ltd., electroconductive fine-particles) and 60 parts of water was stirred by a mixer, while adding a 1N sodium hydroxide aqueous solution to the mixture, to carry out dispersing roughly. After that, the resultant mixture was dispersed in a horizontal sand mill. In this way a dispersion of electroconductive fine-particles having an average particle diameter of secondary particles of 0.06 μm (pH=7.0) was obtained.

A coating solution having the following composition was coated on the surface-treated PEN support (back side) such that the coating amount of the electroconductive fine-particles would be 270 mg/m$^2$. The drying condition was 115° C. and 3 minutes.

| | |
|---|---|
| SN-100 | 270 parts by weight |

(trade name, manufactured by Ishihara Sangyo Kaisha, Ltd., electroconductive fine-particles)

| | |
|---|---|
| Gelatin | 23 parts by weight |
| Rheodol TW-L120 | 6 parts by weight |

(trade name, manufactured by Kao Corporation., surfactant)

| | |
|---|---|
| Denakol EX-521 | 9 parts by weight |

(trade name, manufactured by Naqase Chemicals, Ltd., hardner)

| | |
|---|---|
| Water | 5000 parts by weight |

(4) Coating of a Magnetic Recording Layer (2nd Backing Layer)

Magnetic particles CSF-4085V2 (Co-coated β—$Fe_2O_3$, trade name, manufactured by Toda Kogyo Corp.) was surface-treated with X-12-641 (a silane coupling agent, trade name, manufactured by Shin-Etsu Chemical Co., Ltd.) in an amount of 16% by weight relative to the magnetic particles.

A coating solution having the following composition was coated on the 1st backing layer such that the coating amount of the CSF-4085V2 treated with the silane coupling agent became 62 mg/$m^2$. The method for dispersing the magnetic particles and abrasive particles was in accordance with the method described in JP-A-6-035092. The drying condition was 115° C. and 1 minute.

| | |
|---|---|
| Diacetyl cellulose (binder) | 1140 parts by weight |
| X-12-641-treated CSF-4085V2 (magnetic particles) | 62 parts by weight |
| AKP-50 | 40 parts by weight |

(trade name, alumina manufactured by Sumitomo Chemical Co., Ltd., abrasive)

| | |
|---|---|
| Millionate MR-400 | 71 parts by weight |

(trade name, manufactured by Nippon Polyurethane Industry Co., Ltd., hardener)

| | |
|---|---|
| Cyclohexanone | 12000 parts by weight |
| Methyl ethyl ketone | 12000 parts by weight |

The color density increment of $D_B$ of the magnetic recording layer according to X-light (blue filter) was about 0.1; the saturation magnetization moment of the magnetic recording layer was 4.2 emu/g; the coercive force was $7.3\times10^4$ A/m; and the angularity ratio was 65%.

(5) Coating of the 3rd Backing Layer

The 3rd backing layer was coated on the magnetic recording layer of the light-sensitive material.

Wax (1–2) of the following structure was dispersed by emulsification in water by means of a high-pressure homogenizer, and a wax aqueous dispersion having a concentration of 10% by weight and a weight average particle diameter of 0.25 μm was obtained.

$$\text{Wax(1–2)n—}C_{17}H_{35}COOC_{40}H_8\text{—n}$$

A coating solution having the following composition was coated on the magnetic recording layer (2nd backing layer) such that the coating amount of the wax became 27 mg/$m^2$. The drying condition was 115° C. and 1 minute.

| | |
|---|---|
| Wax aqueous dispersion (10% by weight) as described above | 270 parts by weight |
| Pure water | 176 parts by weight |
| Ethanol | 7123 parts by weight |
| Cyclohexanone | 841 parts by weight |

<Preparation of Dispersions of Fine-crystalline Particles of a Color-developing Agent, a Coupler, and a Thermal Solvent>

The dispersions of fine crystals of a color-developing agent, a coupler, and a thermal solvent were all prepared according to the following method. To a mixture of 50 g of the intended compound and 30 g of a 10% by weight aqueous solution of modified polyvinyl alcohol (Poval MP203, trade name, manufactured by Kuraray Co., Ltd.), were added 0.5 g of Alkanol XC (trade name) and 100 g of water, and these were mixed well so as to prepare a slurry. The slurry was fed by means of a diaphragm pump and dispersed for 6 hours in a horizontal sand mill (UVM-2, trade name, manufactured by Imex Co., Ltd.) loaded with zirconia beads having an average diameter of 0.5 mm. After that, water was added to the dispersion thus obtained such that the concentration of the intended compound became 10% by weight. In this way, the dispersion of the intended compound was obtained. The particles contained in the dispersion of the intended compound had a median diameter of 0.40 μm and a maximum particle diameter of 2.0 μm or less. The dispersion of the intended compound was filtered through a polypropylene filter having a pore diameter of 10.0 μm so that foreign matters, such as foreign particles, were eliminated. After that, the dispersion was stored. Immediately before use, the dispersion was filtered again through a polypropylene filter having a pore diameter of 10 μm.

By using these emulsions, dispersions, and support, Samples 101 to 105 of multilayer color heat-developable light-sensitive materials, as shown in Table 1 and Table 2, were prepared.

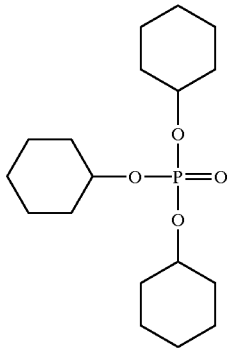

High-boiling organic solvent (g)

-continued

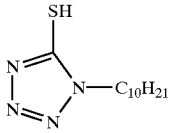

Antifoggant (d)

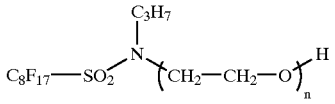

n = 14–16
Surfactant (q)

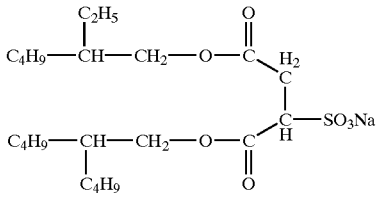

Surfactant (r)

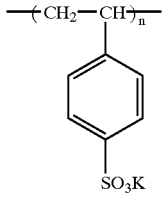

Water-soluble polymer (s)

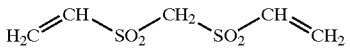

Hardener (t)

-continued

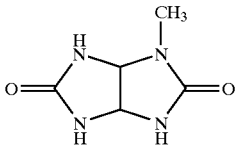

Formalin scavenger (u)
Surfacyant (y)
AlkanolXC (Preparation of an Emulsified Dispersion for making Light-Sensitive Materials of Comparative Example)

Emulsified dispersions of a color-developing agent and a coupler each were prepared in accordance with the following procedure.

21.6 g of a target compound, 10.8 g of High-boiling organic solvent (g), and 40.0 ml of ethyl acetate were dissolved at a temperature of 60° C. The resulting solution was mixed with 300 g of an aqueous solution containing 18.7 g of lime-processed gelatin and 1.8 g of sodium dodecylbenzenesulfonate dissolved therein, and the resultant mixture was emulsified and dispersed at 10,000 rpm for 20 minutes using a dissolver stirrer. After the dispersion, distilled water was added to bring the total weight to 540 g, and they were mixed at 2,000 rpm for 10 minutes.

Samples 201, 202 and 203 of the multi-layer color heat-developable light-sensitive materials, which are shown in Tables 1 and 3, were prepared by using the thus-prepared emulsified dispersion which used the high-boiling-point organic solvent, in place of the corresponding dispersion of fine crystals, and using the emulsion, the dispersion and the support described above.

In Table 1, unit for each numerical value is part(s) by mass.

TABLE 1

| | Samples 101~105 | | Samples 201~203 | |
|---|---|---|---|---|
| Protective layer | Lime-processed gelatin | 914 | Lime-processed gelatin | 914 |
| | Matt agent (silica) | 50 | Matt agent (silica) | 50 |
| | Surfactant (q) | 30 | Surfactant (q) | 30 |
| | Surfactant (r) | 40 | Surfactant (r) | 40 |
| | Water soluble polymer (s) | 15 | Water soluble polymer (s) | 15 |
| | Hardener (t) | 110 | Hardener (t) | 110 |
| Intermediate layer | Lime-processed gelatin | 461 | Lime-processed gelatin | 461 |
| | Surfactant (r) | 5 | Surfactant (r) | 5 |
| | Formalin scavenger (u) | 300 | Formalin scavenger (u) | 300 |
| | Water soluble polymer (s) | 15 | Water soluble polymer (s) | 15 |
| Yellow-color forming layer (high-sensitivity layer) | Lime-processed gelatin | 1750 | Lime-processed gelatin | 1750 |
| | Emulsion (in terms of | A-1b | Emulsion (in terms of | A-1b |
| | coating amount of silver) | 550 | coating amount of silver) | 550 |
| | Silver 5-butyl-benzotriazole | 165 | Silver 5-butyl-benzotriazole | 165 |
| | Yellow coupler | 179 | Yellow coupler | 179 |
| | Color-developing agent | 215 | Color-developing agent | 215 |
| | Antifogging agent (d) | 6.2 | Antifogging agent (d) | 6.2 |
| | Surfactant (y) | 27 | Surfactant (y) | 27 |
| | | | High-boiling organic solvent (g) | 197 |
| | Thermal solvent | 350 | Thermal solvent | 350 |
| Yellow-color forming layer (medium-sensitivity layer) | Lime-processed gelatin | 1470 | Lime-processed gelatin | 1470 |
| | Emulsion (in terms of | A-2b | Emulsion (in terms of | A-2b |
| | coating amount of silver) | 263 | coating amount of silver) | 263 |
| | Silver 5-butyl-benzotriazole | 185 | Silver 5-butyl-benzotriazole | 185 |
| | Yellow coupler | 269 | Yellow coupler | 269 |
| | Color-developing agent | 323 | Color-developing agent | 323 |
| | Antifogging agent (d) | 5.9 | Antifogging agent (d) | 5.9 |
| | Surfactant (y) | 26 | Surfactant (y) | 26 |
| | | | High-boiling organic solvent (g) | 296 |
| | Thermal solvent | 294 | Thermal solvent | 294 |
| Yellow-color | Lime-processed gelatin | 1680 | Lime-processed gelatin | 1680 |

TABLE 1-continued

| | Samples 101~105 | | Samples 201~203 | |
|---|---|---|---|---|
| forming layer (low-sensitivity layer) | Emulsion (in terms of coating amount of silver) | A-3b 240 | Emulsion (in terms of coating amount of silver) | A-3b 240 |
| | Silver 5-butyl-benzotriazole | 206 | Silver 5-butyl-benzotriazole | 206 |
| | Yellow coupler | 448 | Yellow coupler | 448 |
| | Color-developing agent | 539 | Color-developing agent | 539 |
| | Antifogging agent (d) | 5.4 | Antifogging agent (d) | 5.4 |
| | Surfactant (y) | 30 | Surfactant (y) | 30 |
| | | | High-boiling organic solvent (g) | 493 |
| | Thermal solvent | 336 | Thermal solvent | 336 |
| Intermediate layer | Lime-processed gelatin | 560 | Lime-processed gelatin | 560 |
| | Surfactant (y) | 15 | Surfactant (y) | 15 |
| | Water soluble polymer (s) | 15 | Water soluble polymer (s) | 15 |
| Magenta color-forming layer (high-sensitivity layer) | Lime-processed gelatin | 781 | Lime-processed gelatin | 781 |
| | Emulsion (in terms of coating amount of silver) | A-1g 488 | Emulsion (in terms of coating amount of silver) | A-1g 488 |
| | Silver 5-butyl-benzotriazole | 62 | Silver 5-butyl-benzotriazole | 62 |
| | Magenta coupler | 47 | Magenta coupler | 47 |
| | Color-developing agent | 81 | Color-developing agent | 81 |
| | Antifogging agent (d) | 5.5 | Antifogging agent (d) | 5.5 |
| | Surfactant (y) | 8 | Surfactant (y) | 8 |
| | | | High-boiling organic solvent (g) | 64 |
| | Thermal solvent | 156 | Thermal solvent | 156 |
| Magenta color-forming layer (medium-sensitivity layer) | Lime-processed gelatin | 659 | Lime-processed gelatin | 659 |
| | Emulsion (in terms of coating amount of silver) | A-2g 492 | Emulsion (in terms of coating amount of silver) | A-2g 492 |
| | Silver 5-butyl-benzotriazole | 93 | Silver 5-butyl-benzotriazole | 93 |
| | Magenta coupler | 94 | Magenta coupler | 94 |
| | Color-developing agent | 163 | Color-developing agent | 163 |
| | Antifogging agent (d) | 11.1 | Antifogging agent (d) | 11.1 |
| | Surfactant (y) | 11 | Surfactant (y) | 11 |
| | | | High-boiling organic solvent (g) | 128 |
| | Thermal solvent | 132 | Thermal solvent | 132 |
| Magenta color-forming layer (low-sensitivity layer) | Lime-processed gelatin | 711 | Lime-processed gelatin | 711 |
| | Emulsion (in terms of coating amount of silver) | A-3g 240 | Emulsion (in terms of coating amount of silver) | A-3g 240 |
| | Silver 5-butyl-benzotriazole | 155 | Silver 5-butyl-benzotriazole | 155 |
| | Magenta coupler | 234 | Magenta coupler | 234 |
| | Color-developing agent | 407 | Color-developing agent | 407 |
| | Antifogging agent (d) | 5.4 | Antifogging agent (d) | 5.4 |
| | Surfactant (y) | 29 | Surfactant (y) | 29 |
| | | | High-boiling organic solvent (g) | 320 |
| | Thermal solvent | 142 | Thermal solvent | 142 |
| Intermediate layer | Lime-processed gelatin | 850 | Lime-processed gelatin | 850 |
| | Surfactant (y) | 15 | Surfactant (y) | 15 |
| | Formalin scavenger (u) | 300 | Formalin scavenger (u) | 300 |
| | Water soluble polymer (s) | 15 | Water soluble polymer (s) | 15 |
| Cyan color-forming layer (high-sensitivity layer) | Lime-processed gelatin | 842 | Lime-processed gelatin | 842 |
| | Emulsion (in terms of coating amount of silver) | A-1r 550 | Emulsion (in terms of coating amount of silver) | A-1r 550 |
| | Silver 5-butyl-benzotriazole | 59 | Silver 5-butyl-benzotriazole | 59 |
| | Cyan coupler | 19 | Cyan coupler | 19 |
| | Color-developing agent | 77 | Color-developing agent | 77 |
| | Antifogging agent (d) | 6.2 | Antifogging agent (d) | 6.2 |
| | Surfactant (y) | 5 | Surfactant (y) | 5 |
| | | | High-boiling organic solvent (g) | 48 |
| | Thermal solvent | 168 | Thermal solvent | 168 |
| Cyan color-forming layer (medium-sensitivity layer) | Lime-processed gelatin | 475 | Lime-processed gelatin | 475 |
| | Emulsion (in terms of coating amount of silver) | A-2r 600 | Emulsion (in terms of coating amount of silver) | A-2r 600 |
| | Silver 5-butyl-benzotriazole | 132 | Silver 5-butyl-benzotriazole | 132 |
| | Cyan coupler | 56 | Cyan coupler | 56 |
| | Color-developing agent | 231 | Color-developing agent | 231 |
| | Antifogging agent (d) | 13.5 | Antifogging agent (d) | 13.5 |
| | Surfactant (y) | 10 | Surfactant (y) | 10 |
| | | | High-boiling organic solvent (g) | 143 |
| | Thermal solvent | 95 | Thermal solvent | 95 |
| Cyan color-forming layer (low-sensitivity | Lime-processed gelatin | 825 | Lime-processed gelatin | 825 |
| | Emulsion (in terms of coating amount of silver) | A-3r 300 | Emulsion (in terms of coating amount of silver) | A-3r 300 |
| | Silver 5-butyl-benzotriazole | 157 | Silver 5-butyl-benzotriazole | 157 |
| | Cyan coupler | 99 | Cyan coupler | 99 |

TABLE 1-continued

| | Samples 101~105 | | Samples 201~203 | |
|---|---|---|---|---|
| layer) | Color-developing agent | 411 | Color-developing agent | 411 |
| | Antifogging agent (d) | 6.8 | Antifogging agent (d) | 6.8 |
| | Surfactant (y) | 17 | Surfactant (y) | 17 |
| | | | High-boiling organic solvent (g) | 255 |
| | Thermal solvent | 165 | Thermal solvent | 165 |
| Antihalation layer | Lime-processed gelatin | 3000 | Lime-processed gelatin | 3000 |
| | Surfactant (y) | 30 | Surfactant (y) | 30 |
| | Base precursor BP-35 | 2000 | Base precursor BP-35 | 2000 |
| | Cyanine dye compound | 260 | Cyanine dye compound | 260 |
| | Surfactant (r) | 120 | Surfactant (r) | 120 |
| | Water soluble polymer (s) | 15 | Water soluble polymer (s) | 15 |

Transparent PEN Base (96 $\mu$m)

TABLE 2

| | | Sample 101 | Sample 102 | Sample 103 | Sample 104 | Sample 105 |
|---|---|---|---|---|---|---|
| Yellow color-forming layers[1)] | Yellow coupler | CP-107 | CP-111 | CP-214 | CP-115 | CP-105 |
| | Color-developing agent | DEVP-17 | DEVP-15 | D-21 | D-21 | D-5 |
| | Thermal solvent | TS-9 | TS-12 | TS-13 | TS-8 | TS-4 |
| Magenta color-forming layers[1)] | Magenta coupler | CP-219 | CP-220 | CP-331 | CP-331 | CP-218 |
| | Color-developing agent | DEVP-21 | DEVP-25 | D-21 | D-21 | SA-1 |
| | Thermal solvent | TS-9 | TS-12 | TS-13 | TS-8 | TS-4 |
| Cyan color-forming layers[1)] | Cyan coupler | CP-325 | CP-319 | CP-331 | CP-319 | CP-324 |
| | Color-developing agent | DEVP-17 | DEVP-15 | D-1 | D-1 | SA-1 |
| | Thermal solvent | TS-9 | TS-12 | TS-13 | TS-8 | TS-4 |

Note:
[1)]The same combination was applied in each of the high-sensitivity layer, the medium-sensitivity layer, and the low-sensitivity layer.

TABLE 3

| | | Sample 201 | Sample 202 | Sample 203 |
|---|---|---|---|---|
| Yellow color-forming layer[1)] | Yellow coupler | CP-107 | CP-107 | CP-107 |
| | Color-developing agent | DEVP-17 | DEVP-17 | DEVP-17 |
| | Thermal solvent | TS-9 | d-sorbitol | succinimide |
| Magenta color-forming layer[1)] | Magenta coupler | CP-219 | CP-219 | CP-219 |
| | Color-developing agent | DEVP-21 | DEVP-21 | DEVP-21 |
| | Thermal solvent | TS-9 | d-sorbitol | succinimide |
| Cyan color-forming layer[1)] | Cyan coupler | CP-325 | CP-325 | CP-325 |
| | Color-developing agent | DEVP-17 | DEVP-17 | DEVP-17 |
| | Thermal solvent | TS-9 | d-sorbitol | succinimide |

Note:
[1)]The same combination was applied in each of the high-sensitivity layer, the medium-sensitivity layer, and the low-sensitivity layer.

Test pieces were cut out of the light-sensitive material samples 101 to 105 and 201 to 203. After that, the test pieces were exposed to light of 500 lux from a while light source, for 1/100 second, through a continuous optical wedge, in accordance with a method for determining ISO sensitivity (ANSI PH2.27).

After the exposure, the test pieces were subjected to heat development processing at 160° C. for 20 seconds, using a heating drum.

After the heat development, the transmission densities of the thus-obtained color-formed samples were measured, as well as fogging and the maximum densities (Dmax) were determined. The results are shown in Table 4.

TABLE 4

Results

| Sample No. | Remarks | With respect to Samples immediately after coating: ISO sensitivity | B fog | G fog | R fog | B Dmax | G Dmax | R Dmax | With respect to Samples stored for 1 week at 60° C. 60% RH: ISO sensitivity | B fog | G fog | R fog |
|---|---|---|---|---|---|---|---|---|---|---|---|---|
| 101 | This invention | 320 | 0.86 | 0.65 | 0.45 | 3.2 | 3.5 | 3.3 | 320 | 0.91 | 0.71 | 0.52 |
| 102 | This invention | 320 | 0.84 | 0.72 | 0.55 | 2.90 | 3.4 | 3.6 | 320 | 0.86 | 0.71 | 0.61 |
| 103 | This invention | 400 | 0.79 | 0.54 | 0.35 | 3.30 | 3.5 | 3.1 | 400 | 0.83 | 0.58 | 0.36 |
| 104 | This invention | 320 | 0.82 | 0.63 | 0.41 | 3.4 | 3.5 | 2.9 | 320 | 0.82 | 0.66 | 0.42 |
| 105 | This invention | 250 | 0.83 | 0.69 | 0.52 | 2.80 | 3.3 | 2.8 | 250 | 0.83 | 0.72 | 0.55 |
| 201 | Comparative example | 160 | 0.83 | 0.62 | 0.32 | 2.20 | 2.4 | 1.8 | 100 | 1.05 | 1.25 | 0.86 |
| 202 | Comparative example | 160 | 0.83 | 0.55 | 0.35 | 2.10 | 2.2 | 2.1 | 80 | 1.15 | 1.32 | 0.95 |
| 203 | Comparative example | 200 | 0.85 | 0.62 | 0.4 | 2.20 | 2.6 | 2.2 | 80 | 1.32 | 1.28 | 0.84 |

Samples 101 to 105 according to the present invention, in which the color-developing agent in the form of a dispersion of fine crystals and the coupler in the form of a dispersion of fine crystals were combined with the thermal solvent in the form of a dispersion of fine crystals, each exhibited high maximum densities of developed color and low fogging densities. On the contrary, Sample 201 for comparison, in which the color-developing agent and the coupler, each dispersed by emulsification using a high-boiling-point organic solvent, were combined with the thermal solvent in the form of a dispersion of fine crystals, and Samples 202 and 203 for comparison, in which the color-developing agent and the coupler, each dispersed by emulsification using a high-boiling-point organic solvent, were combined with a water-soluble thermal solvent, i.e., d-sorbitol or succinimide, each exhibited quite low color-forming property.

Test pieces were cut out of the light-sensitive material samples 101 to 105 and 201 to 203, and stored for one week in an environment of 60° C. and a relative humidity of 60%. After that, the test pieces were exposed to light of 500 lux from a while light source, for 1/100 second, through a continuous optical wedge, in accordance with a method for determining ISO sensitivity (ANSI PH2.27).

After the exposure, the test pieces were subjected to heat development processing at 160° C. for 20 seconds, using a heating drum. After the heat development, the transmission densities of the color-formed samples were measured, and fogging densities were determined. The results are also shown in Table 4.

In the case of Samples 101 to 105 according to the present invention, the fluctuation of the fogging densities of the samples as processed in the above from the fogging densities of the samples stored at room temperature were not large. By contrast, fogging densities rose conspicuously, in the case of Samples 201 to 203 for comparison.

Example 2

<Method for preparing Silver 1-phenyl-5-mercaptotetrazole>

431 g of lime-processed gelatin and 6569 ml of distilled water were placed in a reaction vessel. Then, solution B was prepared by mixing 320 g of 1-phenyl-5-mercaptotetrazole dissolved in 2044 ml of distilled water and 790 g of 2.5 Msodium hydroxide aqueous solution. The solution B and, if necessary, nitric acid or sodium hydroxide, were added to the reaction mixture in the reaction vessel, so that the pAg and the pH were adjusted to 7.25 and 8.00, respectively.

To the above-mentioned reaction vessel was added 3200 ml of 0.54M silver nitrate aqueous solution, at the rate of 250 ml/min, with vigorous stirring, and simultaneously, the soution B was added to the reaction mixture near the stirrer, while controlling so as to maintain 7.25 of the pAg of the reaction mixture. After the completion of the addition, the mixture was condensed by subjecting to ultrafiltration, so that a dispersion containing fine particles of the silver salt of 1-phenyl-5-mercaptotetrazole was obtained.

<Method for Preparing Silver Benzotriazole>

0.34 g of benzotriazole, 0.24 g of sodium hydroxide, and 25 g of phthalated gelatin were dissolved in 700 mL of water. The solution was kept at 60° C. and stirred. Then, to the solution, were added a solution prepared by dissolving 3.4 g of benzotriazole and 1.2 g of sodium hydroxide in 150 mL of water, and a solution prepared by dissolving 5 g of silver nitrate in 150 mL of water, simultaneously, near a stirrer, over a period of time of 4 minutes. The resulting solution was stirred for 5 minutes. After that, to the solution were added a solution prepared by dissolving 3.4 g of benzotriazole and 1.2 g of sodium hydroxide in 150 mL of water, and a solution prepared by dissolving 5 g of silver nitrate in 150 mL of water, simultaneously, near the stirrer, over a period of time of 6 minutes. The pH of the resulting emulsion was adjusted so as to cause precipitation, and excess salt was removed. After that, the pH was adjusted to 6.0, and a silver benzotriazole emulsion in an yield of 470 g was obtained.

(Preparation of an Emulsified Dispersion Containing a Development Accelerator)

0.90 g of Development accelerator (X), 4.54 g of Compound (f), and 50.0 ml of ethyl acetate were dissolved at a temperature of 60° C. The resulting solution was mixed with 200 g of an aqueous solution containing 18.0 g of lime-processed gelatin and 0.4 g of sodium dodecylbenzenesulfonate dissolved therein, and the resultant mixture was emulsified and dispersed at 10,000 rpm for 20 minutes, using a dissolver stirrer. After the dispersion, distilled water was added to bring the total weight to 300 g, and they were mixed at 2,000 rpm for 10 minutes.

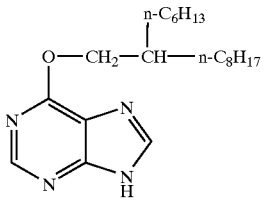

Development accelerator (X)

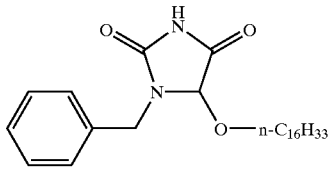

Compound (f)

<Preparation of Dispersions of Fine Crystals of a Coupler and a Thermal Solvent>

The dispersions of fine crystals of the coupler CP-107, CP-116, CP-205, CP-219, CP-311, CP-320, CP-324 or CP-325, and the thermal solvent TS-14 were prepared, respectively, in the same manner as in Example 1.

<Preparation of Dispersions of Solid of a Developing Agent>

The dispersion of fine crystals of the developing agent DEVP-28 to be built-in the light-sensitive material was prepared according to the following method. To 50 g of the incorporated developing agent DEVP-28 and 30 g of a 10% by weight aqueous solution of modified polyvinyl alcohol (Poval MP203, trade name, manufactured by Kuraray Co., Ltd.), were added 1.0 g of Surfactant 10 G (trade name, manufactured by Arch Chemicals Co.) and 100 g of water, and these were mixed well so as to prepare a slurry. The slurry was fed by means of a diaphragm pump and dispersed for 6 hours in a horizontal sand mill (UVM-2: trade name, manufactured by Imex Co., Ltd.) loaded with zirconia beads having an average diameter of 0.5 mm. After that, water was added to the dispersion thus obtained such that the concentration of the intended compound became 10% by weight. In this way, the dispersion of the intended compound was obtained. The particles contained in the dispersion of the intended compound had a median diameter of 0.50 μm and a maximum particle diameter of 1.5 μm or less. The dispersion of the intended compound was filtered through a polypropylene filter having a pore diameter of 10.0 μm so that foreign matters, such as foreign particles, were eliminated. After that, the dispersion was stored. Immediately before use, the dispersion was filtered again through a polypropylene filter having a pore diameter of 10 μm.

The dispersion of fine crystals of the developing agent DEVP-32 to be incorporated was prepared according to the following method. To 50 g of the incorporated developing agent DEVP-32 and 30 g of a 10% by weight aqueous solution of modified polyvinyl alcohol (Poval MP203, manufactured by Kuraray Co., Ltd.), were added 0.5 g of Alkanol XC and 100 g of water, and these were mixed well so as to prepare a slurry. The slurry was fed by means of a diaphragm pump and dispersed for 6 hours in a horizontal sand mill (UVM-2, manufactured by Imex Co., Ltd.) loaded with zirconia beads having an average diameter of 0.1 mm. After that, water was added to the dispersion thus obtained such that the concentration of the intended compound became 10% by weight. In this way, the dispersion of the intended compound was obtained. The particles contained in the dispersion of the intended compound had a median diameter of 0.30 μm and a maximum particle diameter of 1.0 μm or less. The dispersion of the intended compound was filtered through a polypropylene filter having a pore diameter of 10.0 μm so that foreign matters, such as foreign particles, were eliminated. After that, the dispersion was stored. Immediately before use, the dispersion was filtered again through a polypropylene filter having a pore diameter of 10 μm.

Further, a dispersion of a dye, which is decolored at the time of heating, to color an intermediate layer, as a filter layer and an antihalation layer, was prepared in the following manner.

(Preparation of a Dispersion of a Dye for Yellow Filter (YH) Layer)

10 g of leuco dye (1), 20 g of stearyl alcohol and 10 g of color developer (SD-1) were dissolved in 200 ml of ethyl acetate. The resulting solution was mixed with 600 g of an aqueous solution containing 2.0 g of surfactant (r) dissolved therein, and the resultant mixture was emulsified and dispersed at 10,000 rpm for 20 minutes using a dissolver stirrer. After the dispersion, ethyl acetate was removed from the dispersion by a desolvation of stirring for 30 minutes, under a nitrogen atmosphere, at a temperature of 50° C., and then, 30 g of lime-processed gelatin was added. Thereafter, distilled water was added thereto to bring the total weight to 750 g, and they were mixed at 2,000 rpm for 10 minutes.

Further, a magenta filter (MF) dye dispersion and an antihalation (AH) dye dispersion were prepared in the same manner, except that leuco dye (2) or (3) was used in place of leuco dye (1).

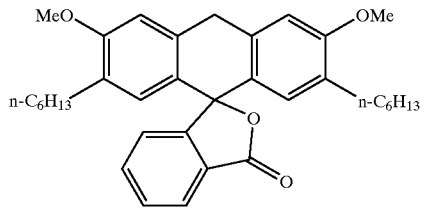

Leoco dye L1

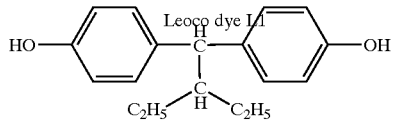

Color Developer (SD-1)

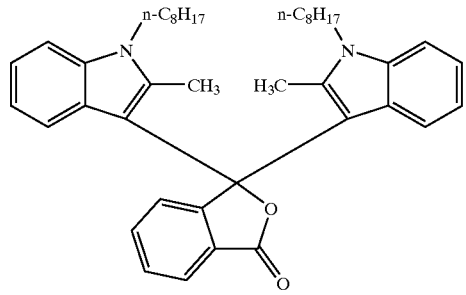

Leoco dye L2

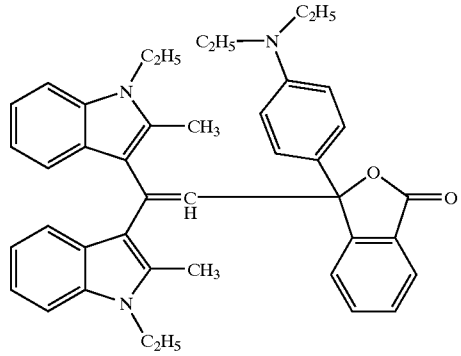

Leoco dye L3

By using these emulsions, Samples 301 and 302 of multilayer color heat-developable light-sensitive materials, as shown in Table 5, were prepared.

In Table 5, unit for each numerical value is part(s) by mass.

TABLE 5

| | Light sensitive material Sample 301 | | Light sensitive material Sample 302 | |
|---|---|---|---|---|
| Protective layer | Lime processed gelatin | 914 | Lime processed gelatin | 914 |
| | Matt agent (silica) | 50 | Matt agent (silica) | 50 |
| | Surfactant (q) | 30 | Surfactant (q) | 30 |
| | Surfactant (r) | 40 | Surfactant (r) | 40 |
| | Water soluble polymer (s) | 15 | Water soluble polymer (s) | 15 |
| | Hardener (t) | 110 | Hardener (t) | 110 |
| Intermediate layer | Lime processed gelatin | 461 | Lime processed gelatin | 461 |
| | Surfactant (r) | 5 | Surfactant (r) | 5 |
| | Salicylanilide | 200 | Salicylanilide | 200 |
| | Formalin scavenger (u) | 150 | Formalin scavenger (u) | 150 |
| | Water soluble polymer (s) | 15 | Water soluble polymer (s) | 15 |
| Yellow color-forming layer (high-sensitivity layer) | Lime processed gelatin | 1750 | Lime processed gelatin | 1750 |
| | Emulsion (in terms of coating amount of silver) | A-1b 550 | Emulsion (in terms of coating amount of silver) | A-1b 550 |
| | Silver benzotriazole (in terms of coating amount of silver) | 165 | Silver benzotriazole (in terms of coating amount of silver) | 165 |
| | Silver 1-phenyl-5-mercaptotetrazole | 437 | 1-Dodecyl-5-mercaptotetrazole | 12 |
| | Yellow coupler (CP-107) | 179 | Yellow coupler (CP-107) | 179 |
| | DEVP-28 | 230 | DEVP-32 | 230 |
| | Development accelerator (X) | 18.0 | Development accelerator (X) | 18.0 |
| | Compound (f) | 91 | Compound (f) | 91 |
| | Surfactant (y) | 27 | Surfactant (y) | 27 |
| | Salicylanilide | 200 | Salicylanilide | 200 |
| | Water soluble polymer (s) | 1 | Water soluble polymer (s) | 1 |
| Yellow color-forming layer (medium-sensitivity layer) | Lime processed gelatin | 1470 | Lime processed gelatin | 1470 |
| | Emulsion (in terms of coating amount of silver) | A-2b 263 | Emulsion (in terms of coating amount of silver) | A-2b 263 |
| | Silver benzotriazole (in terms of coating amount of silver) | 79 | Silver benzotriazole (in terms of coating amount of silver) | 79 |
| | Silver 1-phenyl-5-mercaptotetrazole | 209 | 1-Dodecyl-5-mercaptotetrazole | 6 |
| | Yellow coupler (CP-116) | 269 | Yellow coupler (CP-116) | 269 |
| | DEVP-28 | 380 | DEVP-32 | 380 |
| | Development accelerator (X) | 18.0 | Development accelerator (X) | 18.0 |
| | Compound (f) | 91 | Compound (f) | 91 |
| | Surfactant (y) | 26 | Surfactant (y) | 26 |
| | Salicylanilide | 300 | Salicylanilide | 300 |
| | Water soluble polymer (s) | 2 | Water soluble polymer (s) | 2 |
| Yellow color-forming layer (low-sensitivity layer) | Lime processed gelatin | 1680 | Lime processed gelatin | 1680 |
| | Emulsion (in terms of coating amount of silver) | A-3b 240 | Emulsion (in terms of coating amount of silver) | A-3b 240 |
| | Silver benzotriazole (in terms of coating amount of silver) | 72 | Silver benzotriazole (in terms of coating amount of silver) | 72 |
| | Silver 1-phenyl-5-mercaptotetrazole | 191 | 1-Dodecyl-5-mercaptotetrazole | 5 |
| | Yellow coupler (CP-116) | 448 | Yellow coupler (CP-116) | 448 |
| | DEVP-28 | 590 | DEVP-32 | 590 |
| | Development accelerator (X) | 18.0 | Development accelerator (X) | 18.0 |
| | Compound (f) | 91 | Compound (f) | 91 |
| | Surfactant (y) | 30 | Surfactant (y) | 30 |
| | Salicylanilide | 600 | Salicylanilide | 600 |
| | Water soluble polymer (s) | 3 | Water soluble polymer (s) | 3 |
| Intermediate layer (yellow filter layer) | Lime processed gelatin | 560 | Lime processed gelatin | 560 |
| | Surfactant (y) | 15 | Surfactant (y) | 15 |
| | Surfactant (r) | 60 | Surfactant (r) | 60 |
| | Stearyl alcohol | 300 | Stearyl alcohol | 300 |
| | Leoco dye (L1) | 150 | Leoco dye (L1) | 150 |
| | Color developer (SD-1) | 150 | Color developer (SD-1) | 150 |
| | Water soluble polymer (s) | 15 | Water soluble polymer (s) | 15 |
| Magenta color-forming layer (high-sensitivity layer) | Lime processed gelatin | 781 | Lime processed gelatin | 781 |
| | Emulsion (in terms of coating amount of silver) | A-1g 488 | Emulsion (in terms of coating amount of silver) | A-1g 488 |
| | Silver benzotriazole (in terms of coating amount of silver) | 146 | Silver benzotriazole (in terms of coating amount of silver) | 146 |
| | Silver 1-phenyl-5-mercaptotetrazole | 388 | 1-Dodecyl-5-mercaptotetrazole | 11 |
| | Magenta coupler (CP-205) | 71 | Magenta coupler (CP-205) | 71 |
| | DEVP-28 | 74 | DEVP-32 | 74 |

TABLE 5-continued

| | Light sensitive material Sample 301 | | Light sensitive material Sample 302 | |
|---|---|---|---|---|
| | Compound (f) | 91 | Compound (f) | 91 |
| | Surfactant (y) | 30 | Surfactant (y) | 30 |
| | Salicylanilide | 100 | Salicylanilide | 100 |
| | Water soluble polymer (s) | 8 | Water soluble polymer (s) | 8 |
| Magenta color-forming layer (medium-sensitivity layer) | Lime processed gelatin | 659 | Lime processed gelatin | 659 |
| | Emulsion (in terms of coating amount of silver) | A-2g 492 | Emulsion (in terms of coating amount of silver) | A-2g 492 |
| | Silver benzotriazole (in terms of coating amount of silver) | 148 | Silver benzotriazole (in terms of coating amount of silver) | 148 |
| | Silver 1-phenyl-5-mercaptotetrazole | 391 | 1-Dodecyl-5-mercaptotetrazole | 11 |
| | Magenta coupler (CP-219) | 142 | Magenta coupler (CP-219) | 142 |
| | DEVP-28 | 140 | DEVP-32 | 140 |
| | Salicylanilide | 80 | Salicylanilide | 80 |
| | Water soluble polymer (s) | 14 | Water soluble polymer (s) | 14 |
| Magenta color-forming layer (low-sensitivity layer) | Lime processed gelatin | 711 | Lime processed gelatin | 711 |
| | Emulsion (in terms of coating amount of silver) | A-3g 240 | Emulsion (in terms of coating amount of silver) | A-3g 240 |
| | Silver benzotriazole (in terms of coating amount of silver) | 72 | Silver benzotriazole (in terms of coating amount of silver) | 72 |
| | Silver 1-phenyl-5-mercaptotetrazole | 191 | 1-Dodecyl-5-mercaptotetrazole | 5 |
| | Magenta coupler (CP-219) | 353 | Magenta coupler (CP-219) | 353 |
| | DEVP-28 | 349 | DEVP-32 | 349 |
| | Salicylanilide | 80 | Salicylanilide | 80 |
| | Water soluble polymer (s) | 14 | Water soluble polymer (s) | 14 |
| Intermediate layer (magenta filter layer) | Lime processed gelatin | 850 | Lime processed gelatin | 850 |
| | Surfactant (y) | 15 | Surfactant (y) | 15 |
| | Surfactant (r) | 24 | Surfactant (r) | 24 |
| | Stearyl alcohol | 150 | Stearyl alcohol | 150 |
| | Leoco dye (L2) | 75 | Leoco dye (L2) | 75 |
| | Color developer (SD-1) | 75 | Color developer (SD-1) | 75 |
| | Formalin scavenger (u) | 300 | Formalin scavenger (u) | 300 |
| | Water soluble polymer (s) | 15 | Water soluble polymer (s) | 15 |
| Cyan color-forming layer (high-sensitivity layer) | Lime processed gelatin | 842 | Lime processed gelatin | 842 |
| | Emulsion (in terms of coating amount of silver) | A-1r 550 | Emulsion (in terms of coating amount of silver) | A-1r 550 |
| | Silver benzotriazole (in terms of coating amount of silver) | 165 | Silver benzotriazole (in terms of coating amount of silver) | 165 |
| | Silver 1-phenyl-5-mercaptotetrazole | 437 | 1-Dodecyl-5-mercaptotetrazole | 12 |
| | Cyan coupler (CP-311) | 19 | Cyan coupler (CP-311) | 19 |
| | Cyan coupler (CP-325) | 44 | Cyan coupler (CP-325) | 44 |
| | DEVP-28 | 91 | DEVP-32 | 91 |
| | Development accelerator (X) | 18.0 | Development accelerator (X) | 18.0 |
| | Compound (f) | 91 | Compound (f) | 91 |
| | Salicylanilide | 150 | Salicylanilide | 150 |
| | Water soluble polymer (s) | 18 | Water soluble polymer (s) | 18 |
| Cyan color-forming layer (medium-sensitivity layer) | Lime processed gelatin | 475 | Lime processed gelatin | 475 |
| | Emulsion (in terms of coating amount of silver) | A-2r 600 | Emulsion (in terms of coating amount of silver) | A-2r 600 |
| | Silver benzotriazole (in terms of coating amount of silver) | 180 | Silver benzotriazole (in terms of coating amount of silver) | 180 |
| | Silver 1-phenyl-5-mercaptotetrazole | 477 | 1-Dodecyl-5-mercaptotetrazole | 13 |
| | Cyan coupler (CP-320) | 56 | Cyan coupler (CP-320) | 56 |
| | Cyan coupler (CP-324) | 131 | Cyan coupler (CP-324) | 131 |
| | DEVP-28 | 209 | DEVP-32 | 209 |
| | Development accelerator (X) | 9.0 | Development accelerator (X) | 9.0 |
| | Compound (f) | 45 | Compound (f) | 45 |
| | Salicylanilide | 150 | Salicylanilide | 150 |
| | Water soluble polymer (s) | 15 | Water soluble polymer (s) | 15 |
| Cyan color-forming layer (low-sensitivity layer) | Lime processed gelatin | 825 | Lime processed gelatin | 825 |
| | Emulsion (in terms of coating amount of silver) | A-3r 300 | Emulsion (in terms of coating amount of silver) | A-3r 300 |
| | Silver benzotriazole (in terms of coating amount of silver) | 90 | Silver benzotriazole (in terms of coating amount of silver) | 90 |
| | Silver 1-phenyl-5-mercaptotetrazole | 239 | 1-Dodecyl-5-mercaptotetrazole | 7 |

TABLE 5-continued

| | Light sensitive material Sample 301 | | Light sensitive material Sample 302 | |
|---|---|---|---|---|
| | Cyan coupler (CP-320) | 99 | Cyan coupler (CP-320) | 99 |
| | Cyan coupler (CP-324) | 234 | Cyan coupler (CP-324) | 234 |
| | DEVP-28 | 373 | DEVP-32 | 373 |
| | Development accelerator (X) | 9.0 | Development accelerator (X) | 9.0 |
| | Compound (f) | 45 | Compound (f) | 45 |
| | Salicylanilide | 200 | Salicylanilide | 200 |
| | Water soluble polymer (s) | 10 | Water soluble polymer (s) | 10 |
| Antihalation layer | Lime processed gelatin | 440 | Lime processed gelatin | 440 |
| | Surfactant (y) | 14 | Surfactant (y) | 14 |
| | Base precursor compound BP-35 | 207 | Stearyl alcohol | 1200 |
| | Cyanine dye compound | 260 | Leoco dye (L3) | 600 |
| | | | Color developer (SD-1) | 600 |
| | | | Surfactant (r) | 120 |
| | Water soluble polymer (s) | 15 | Water soluble polymer (s) | 15 |

Transparent PEN Base (96 μm)

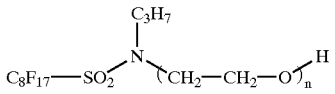

n = 14–16
Surfactant (q)

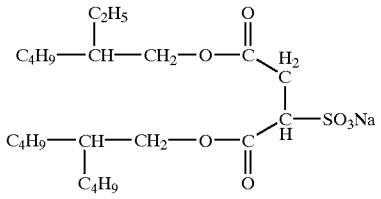

Surfactant (r)

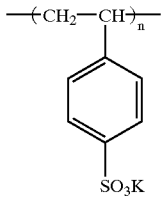

Water-soluble polymer (s)

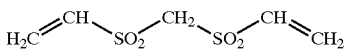

Hardener (t)

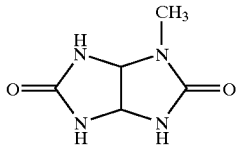

Formalin scavenger (u)
Surfactant (y)
AlkanolXC

Test pieces were cut out of the light-sensitive material samples 301 and 302, and the test pieces were exposed to light of 500 lux from a white light source, for 1/100 second, through a continuous optical wedge, in accordance with a method for determining ISO sensitivity (ANSI PH2.27). After the exposure, the test pieces were subjected to heat development processing using a heating drum, wherein the conditions were 155° C. for 20 seconds for the sample 301, and 145° C. for 20 seconds for the sample 302, respectively.

Both of the light-sensitive materials provided the color image exhibiting good discrimination.

Separately, the pieces cut out of the light-sensitive material samples 301 and 302 were stored for two weeks in a dark environment of 50° C. and a relative humidity of 50%. After that, the test pieces were subjected to exposure and development processing in the same manner as above.

The sensitivity and fogging of the samples 301 and 302 immediately after preparing, were compared with the sensitivity and fogging of the samples 301 and 302 after being stored for 2 weeks in the above-mentioned condition. As in Example 1, the fluctuation of the sensitivity was very small, and the increase of fogging was also a slight amount.

The light-sensitive material samples 301 and 302 were each cut into a 135-negative film size and punched. The thus-made films were then loaded into a camera, respectively, and a photograph of a person and a Macbeth chart was taken. The films were subjected to heat development in the same manner as above, and the resultant image on the light-sensitive material after the processing was read out by a digital image readout apparatus, Frontier SP-1000 (trade name, manufactured by Fuji Photo Film Co., Ltd.). After being subjected to image processing on a workstation, the image was outputted by a heat development printer (PICTROGRAPHY 3000, trade name, manufactured by Fuji Photo Film Co., Ltd.).

The readout of the sample 301 was carried out at room temperature. The readout of the sample 302 was carried out, while keeping the film surface temperature at 60 to 70° C., by supplying warm air using a drier to the surface of the light-sensitive material at the time of readout. Utilizing the Macbeth chart in the obtained image, prints having a high chroma level were obtained, by carrying out a color compensation processing to raise chroma by a digital signal processing, while maintaining color reproduction.

Separately, the test pieces, which had been cut out of the light-sensitive material samples 301 and 302 and stored for two weeks in a dark environment of 50° C. and a relative humidity of 50%, were used for photographing and subjected to development processing in the same manner as above.

The samples 301 and 302 after being stored for 2 weeks in the above-mentioned condition also provided good prints.

Example 3

Silver halide emulsions composed of tabular grains having a high silver chloride content were prepared, in accordance with the methods described in the example of U.S. Pat. No. 5,840,475.

Silver Iodochloride (100) Tabular Grain Emulsion 1.48 g of sodium chloride, 0.28 g of potassium iodide, 38.8 g of lime-treated gelatin that had been subjected to oxidizing treatment, and distilled water in an amount to make 4.5 L were placed in a reaction vessel, and the temperature of the resultant solution was kept at 35° C. To this solution, which was vigorously stirred, were added a 4M silver nitrate aqueous solution (hereinafter referred to as Solution 1) containing 0.32 g/L of mercuric chloride, and a 4M sodium chloride aqueous solution, over a period of time of 30 seconds, at an adding rate of 21 mL/minute for each solution. In this way, nuclei were formed.

Immediately after the completion of the addition, 9.1 L of a solution containing 0.39 g/L of sodium chloride and 0.12 g/L of potassium iodide was added and the reaction solution was kept for 8 minutes. Then, the above Solution 1 was added according to the conditions listed below, so as to form silver halide grains. During the addition, a 4M sodium chloride aqueous solution was added at the same time in a controlled manner, such that the pCl of the reaction solution became 2.2.

| Grain growth | Initial flow rate | Final flow rate | Adding time |
|---|---|---|---|
| I | 14 mL/min | 14 mL/min | 5 min |
| II | 14 mL/min | 42 mL/min | 52 min |

Upon completion of the above-described grain growth stage II, a 4M sodium chloride aqueous solution was added at an adding rate of 14 mL/minute over a period of 5 minutes, and the reaction solution was kept for 30 minutes. After that, Solution 1 was added at an adding rate of 14 mL/minute over a period of 5 minutes. Subsequently, 70 mL of an aqueous solution containing 5.25 g of potassium iodide was added. Then, after the reaction solution was kept for 20 minutes, the Solution 1 was added at an adding rate of 14 mL/minute over a period of 8 minutes, while a 4M sodium chloride aqueous solution was added at the same time in a controlled manner such that the pCl of the system became 2.2. In this case, the sodium chloride aqueous solution was incorporated with potassium hexacyanoruthenate such that the concentration thereof was $3\times10^{-5}$ mol/mol of total silver halides. After completion of the grain formation, precipitation, water-washing, and desalting were performed by a usual manner.

The emulsion thus obtained was composed of tabular grains whose average equivalent-circle diameter (average of the diameter of the circle having an area equivalent to the projected area of an individual grain) was 0.56 μm and average grain thickness was 0.09 μm, in which the tabular grains having (100) plane as a main face accounted for 70% or more of the entire projected area of all the silver halide grains. This emulsion was designated as Emulsion u.

Then, Emulsion m, which was composed of tabular grains whose average equivalent-circle diameter was 1.60 μm and average grain thickness was 0.114 μm, wherein the tabular grains having (100) plane as a main face accounted for 70% or more of the entire projected area of all silver halide grains, was prepared, by adjusting the temperature and time period for grain growth.

Further, Emulsion o, which was composed of tabular grains whose average equivalent-circle diameter was 2.90 μm and average grain thickness was 0.121 μm, wherein the tabular grains having (100) plane as a main face accounted for 70% or more of the entire projected area of all silver halide grains, was prepared, by adjusting the temperature and time period for grain growth.

These emulsions were subjected to chemical sensitization and spectral sensitization in the same manner as in Example 1, and blue-sensitive emulsions, green-sensitive emulsions, and red-sensitive emulsions were prepared, respectively. In this way, Blue-sensitive emulsions o-b, m-b, and u-b, Green-sensitive emulsions o-g, m-g, and u-g, and Red-sensitive emulsions o-r, m-r, and u-r, were obtained.

A light-sensitive material 401 was prepared in the same manner as in Example 2, except that the emulsions A-1b, A-2b, A-3b, A-1g, A-2g, A-3g, A-1r, A-2r, and A-3r of the light-sensitive material sample 301 were replaced, respectively, with the Blue-sensitive emulsions o-b, m-b, and u-b, the Green-sensitive emulsions o-g, m-g, and u-g, and the Red-sensitive emulsions o-r, m-r, and u-r. Likewise, a light-sensitive material sample 402, in which the emulsions of the light-sensitive material sample 302 of Example 2 were replaced in the same manner as above, was prepared.

These light-sensitive material samples 401 and 402 were subjected to exposure and heat development processing in the same manner as in Example 2. As a result, it was found that with respect to these light-sensitive material samples according to the present invention, the discrimination was good and storability was also excellent.

Silver Iodochloride (111) Tabular Grain Emulsion 9.3 g of sodium chloride, 2.84 g of 7-azaindole, 80 g of lime-treated bone gelatin, and distilled water in an amount to make 3.9 L were placed in a reaction vessel, and the temperature of the resultant solution was kept at 50° C. After adjusting the pH of the solution to 5.5, to this solution, which was vigorously stirred, were added a 2M silver nitrate aqueous solution over a period of 36 seconds at an adding rate of 8 mL/minute for each solution. In this way, nuclei were formed.

Immediately after the completion of the addition, a silver nitrate aqueous solution was added according to the conditions listed below so as to form silver halide grains. During the addition, a 4M sodium chloride aqueous solution was added at the same time in a controlled manner such that the pCl of the reaction solution became 1.5.

| Grain growth | $AgNO_3$ solution | Initial flow rate | Final flow rate | Adding time |
|---|---|---|---|---|
| I | 2M | 8 mL/min | 16 mL/min | 2.8 min |
| II | 4M | 8 mL/min | 30 mL/min | 15 min |
| III | 4M | 30 mL/min | 30 mL/min | 14 min |

One minute after the completion of the above-described grain growth stage, a 4M silver nitrate aqueous solution was added at an adding rate of 23 mL/minute over a period of 2.4 minutes. A 3.6M sodium chloride/0.4M potassium iodide aqueous solution was added at the same time in a controlled manner such that the pCl of the system became 1.5. In this case, the sodium chloride/potassium iodide aqueous solution was incorporated with potassium hexacyanoruthenate such that the concentration thereof was $3\times10^{-5}$ mol/mol of total silver halides. After completion of the grain formation, precipitation, water-washing, and desalting were performed by a usual manner.

The emulsion thus obtained was composed of tabular grains whose average equivalent-circle diameter was 0.86 μm and average grain thickness was 0.10 μm, wherein the tabular grains having (111) plane as a main face accounted for 70% or more of the entire projected area of all silver halide grains. This emulsion was designated as Emulsion u'.

Then, Emulsion m', which was composed of tabular grains whose average equivalent-circle diameter was 1.58 μm and average grain thickness was 0.119 μm, wherein the tabular grains having (111) plane as a main face accounted for 70% or more of the entire projected area of all silver halide grains, was prepared by adjusting the temperature and time period for grain growth.

Further, Emulsion o', which was composed of tabular grains whose average equivalent-circle diameter was 2.85 μm and average grain thickness was 0.131 μm, wherein the tabular grains having (111) plane as a main face accounted for 70% or more of the entire projected area of all silver halide grains, was prepared by adjusting the temperature and time period for grain growth.

These emulsions were subjected to chemical sensitization and spectral sensitization in the same manner as in Example 1, and blue-sensitive emulsions, green-sensitive emulsions, and red-sensitive emulsions were prepared, respectively. In this way, Blue-sensitive emulsions o'-b, m'-b, and u'-b, Green-sensitive emulsions o'-g, m'-g, and u'-g, and Red-sensitive emulsions o'-r, m'-r, and u'-r, were obtained.

A light-sensitive material, Sample 501 was prepared in the same manner as in Example 2, except that the emulsions A-1b, A-2b, A-3b, A-1g, A-2g, A-3g, A-1r, A-2r, and A-3r of the light-sensitive material sample 301 were replaced, respectively, with the Blue-sensitive emulsions o'-b, m'-b, and u'-b, the Green-sensitive emulsions o'-g, m'-g, and u'-g, and the Red-sensitive emulsions o'-r, m'-r, and u'-r. Likewise, a light-sensitive material, Sample 502, in which the emulsions of the light-sensitive material, Sample 302, of Example 2 were replaced in the same manner as above, was prepared.

These light-sensitive materials, Samples 501 and 502, were subjected to exposure and heat development processing in the same manner as in Example 2. As a result, it was found that with respect to these light-sensitive material samples according to the present invention, the discrimination was good and storability was also excellent.

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-developable light-sensitive material, at least containing:

(a) a photosensitive silver halide;

(b) a reducible silver salt;

(c) a dispersion of fine crystalline particles of a color-developing agent;

(d) a dispersion of fine crystalline particles of a coupler capable of reacting with an oxidized product of the color-developing agent, to form a dye;

(e) a dispersion of fine crystalline particles of a thermal solvent; and (f) a binder, each of which is contained on the same side of a support.

2. The heat-developable light-sensitive material according to claim 1, wherein the melting point mp (C) of the color-developing agent, the melting point mp (D) of the coupler, and the melting point mp (E) of the thermal solvent are all 80° C. or above.

3. The heat-developable light-sensitive material according to claim 1, wherein the color-developing agent is compatible with the thermal solvent, and the coupler is compatible with the thermal solvent.

4. The heat-developable light-sensitive material according to claim 1, wherein the color-developing agent is incompatible with the coupler.

5. The heat-developable light-sensitive material according to claim 1, wherein the melting point mp (C) of the color-developing agent is equal to or higher than a development processing temperature, and the melting point mp (E) of the thermal solvent is equal to or lower than the development processing temperature.

6. The heat-developable light-sensitive material according to claim 1, wherein the melting point mp (C) of the color-developing agent, and the melting point mp (D) of the coupler, are each equal to or higher than a development processing temperature, and the melting point mp (E) of the thermal solvent is equal to or lower than the development processing temperature.

7. The heat-developable light-sensitive material according to claim 1, comprising a silver halide emulsion in which the projected area of silver halide tabular grains whose aspect ratio is 8 to 50, accounts for 50% or more of the projected area of all grains.

8. The heat-developable light-sensitive material according to claim 1, wherein the color-developing agent has a water-solubility of 1 g/cubic meter or less.

9. The heat-developable light-sensitive material according to claim 1, wherein the thermal solvent has a water-solubility of 1 g/cubic meter or less.

10. The heat-developable light-sensitive material according to claim 1, wherein the reducible silver salt is a complex of an organic or inorganic silver salt, in which a ligand to silver ion in the complex has a gross stability constant within the range of 4.0 to 10.0.

11. An image-forming method, comprising the steps of:

exposing image-wise the heat-developable light-sensitive material according to claim 1;

heating the exposed light-sensitive material at a temperature within a range of 60 to 180° C. for 5 to 60 seconds, to form a color image;

reading photoelectrically the image information produced on the light-sensitive material; and forming an image on another recording material based on the image information.

12. The image-forming method according to claim 11, wherein the another recording material is a recording material selected from the group consisting of a light-sensitive material, a sublimation-type heat-sensitive recording material, a material for ink-jet, an electrophotographic material, and a full-color direct heat-sensitive recording material.

13. The image-forming method according to claim 11, wherein the step of forming an image on another recording material is carried out by:

converting the image information produced on the light-sensitive material into digital signals;

image-processing the digital signals; and outputting the objective image on the another recording material by means of a heat development color printer.

14. The image-forming method according to claim 11, wherein the color-developing agent is compatible with the thermal solvent, and the coupler is compatible with the thermal solvent.

15. The image-forming method according to claim 11, wherein the color-developing agent is incompatible with the coupler.

16. The image-forming method according to claim 11, wherein the melting point mp (C) of the color-developing agent is equal to or higher than a development processing temperature, and the melting point mp (E) of the thermal solvent is equal to or lower than the development processing temperature.

17. The image-forming method according to claim 11, wherein the melting point mp (C) of the color-developing agent, and the melting point mp (D) of the coupler, are each equal to or higher than a development processing temperature, and the melting point mp (E) of the thermal solvent is equal to or lower than the development processing temperature.

18. The image-forming method according to claim 11, wherein the heat-developable light-sensitive material comprises a silver halide emulsion in which the projected area of silver halide tabular grains whose aspect ratio is 8 to 50, accounts for 50% or more of the projected area of all grains.

19. The image-forming method according to claim 11, wherein the step of reading photoelectrically the image information produced on the light-sensitive material is carried out by using an area CCD.

* * * * *